US010450749B2

(12) United States Patent
Render

(10) Patent No.: US 10,450,749 B2
(45) Date of Patent: Oct. 22, 2019

(54) DEVICE FOR SPLICING REINFORCEMENT CAGES

(71) Applicant: Stephen Render, Hilton (GB)

(72) Inventor: Stephen Render, Hilton (GB)

( * ) Notice: Subject to any disclaimer, the term of this patent is extended or adjusted under 35 U.S.C. 154(b) by 119 days.

(21) Appl. No.: 15/737,416

(22) PCT Filed: Jun. 24, 2016

(86) PCT No.: PCT/GB2016/051899
§ 371 (c)(1),
(2) Date: Dec. 18, 2017

(87) PCT Pub. No.: WO2016/207652
PCT Pub. Date: Dec. 29, 2016

(65) Prior Publication Data

US 2018/0171635 A1 Jun. 21, 2018

(30) Foreign Application Priority Data

Jun. 25, 2015 (GB) ..... 1511237.8

(51) Int. Cl.
*E04C 5/06* (2006.01)
*E04C 5/16* (2006.01)
*E02D 5/52* (2006.01)

(52) U.S. Cl.
CPC ..... *E04C 5/0609* (2013.01); *E04C 5/0604* (2013.01); *E04C 5/0622* (2013.01);
(Continued)

(58) Field of Classification Search
CPC ..... E04C 5/0609; E04C 5/0622; E04C 5/166; E04C 5/167; E04C 5/0604; E02D 5/526
See application file for complete search history.

(56) References Cited

U.S. PATENT DOCUMENTS 7,850,399 B2 * 12/2010 Render ..... E04C 5/0618 405/239
2002/0189175 A1 * 12/2002 Lancelot, III ..... E04C 5/16 52/155

(Continued)

FOREIGN PATENT DOCUMENTS

CA 2892837 C * 7/2016 ..... E04B 5/32
DE 2614026 A1 * 10/1977 ..... E02D 5/30

(Continued)

OTHER PUBLICATIONS

International Search Report, PCT/GB2016/051899 (dated 2016).
Written Opinion of the International Searching Authority, PCT/GB2016/051899 (dated 2016).

*Primary Examiner* — Babajide A Demuren
(74) *Attorney, Agent, or Firm* — Walters & Wasylyna LLC

(57) ABSTRACT

A device (150) for splicing together a first reinforcement cage (10) and a second reinforcement cage (20), the first reinforcement cage (10) comprising a suspension band (18) adjacent one of its ends and the second reinforcement cage (20) carrying the said device (150) adjacent one of its ends, wherein the device (150) comprises: an anchoring portion (160) carried on a portion of the second reinforcement cage (20) adjacent its one end, e.g. via a bridging portion (170), and configured or configurable such that at least a portion thereof is radially spaced from the second reinforcement cage (20) so as to define a radial suspension gap (G) between the said portion and the second reinforcement cage (20), the suspension gap (G) being configured for receiving therein the suspension band (18) on the first reinforcement cage (10) as the first and second reinforcement cages (10, 20) are spliced together; and gate means (180) constructed and arranged so as to be selectively configurable in either an open configuration, in which the suspension band (18) on the (Continued)

first reinforcement cage (10) can be inserted into or received in the suspension gap (G) via the gate means (180), or a closed configuration in which the suspension band (18) on the first reinforcement cage (10), once located in the suspension gap (G), is prevented from being removed therefrom via the gate means (180), wherein the gate means (180) is moveable between its open and closed configurations by virtue of at least a portion thereof being moveable by pivoting.

22 Claims, 22 Drawing Sheets

(52) U.S. Cl.
CPC ..... *E04C 5/166* (2013.01); *E04C 5/167* (2013.01); *E02D 5/526* (2013.01)

(56) References Cited

U.S. PATENT DOCUMENTS

| | | | | |
|---|---|---|---|---|
| 2008/0118304 | A1* | 5/2008 | Carraher | B25H 3/04 403/396 |
| 2009/0169310 | A1* | 7/2009 | Render | E02D 5/30 405/239 |

FOREIGN PATENT DOCUMENTS

| | | | | |
|---|---|---|---|---|
| DE | 2831608 | A1 * | 1/1980 | E04C 5/166 |
| FR | 2033467 | A5 * | 12/1970 | E04C 5/167 |
| FR | 2289831 | A1 * | 5/1976 | B21F 27/125 |
| GB | 2 398 332 | | 8/2004 | |
| GB | 2 454 798 | | 5/2009 | |
| JP | 2004 003282 | | 1/2004 | |

* cited by examiner

DEVICE FOR SPLICING REINFORCEMENT CAGES

This application is a U.S. national phase application of Intl. App. No. PCT/GB2016/051899 filed on Jun. 24, 2016, which claims priority from GB1511237.8 filed on Jun. 25, 2015. The entire contents of PCT/GB2016/051899 and GB1511237.8 are incorporated herein by reference.

TECHNICAL FIELD

This invention relates to a device for splicing reinforcement cages, including pile cages and diaphragm wall cages. It also relates to a combination of at least two reinforcement cages spliced using the device. The invention further relates to a method for splicing reinforcement cages using the said device, and to piles, diaphragm walls and other structures formed using reinforcement cages spliced according to the said method.

BACKGROUND OF THE INVENTION AND PRIOR ART

Reinforcement cages such as pile cages are used in a wide range of civil engineering and construction applications, principally in the formation of concrete piles in the construction of buildings, underground car parks, road or rail or other bridges, and other structures. Pile cages not only provide reinforcement for the concrete of the pile, but they also provide a means of attaching or anchoring part(s) of the building, bridge or other structure to the built pile itself.

As used herein, the term "pile cage" means a generally cylindrical, or alternatively other cross-sectional shaped, assembly or network of a plurality (typically at least about 4, 5 or 6, or possibly more than six) of (usually) metallic, e.g. steel, cage bars extending in a generally longitudinal direction (defined as a direction parallel to the axis of the pile to be formed around the cage) and anchored together or interconnected by one or more frame elements, e.g. one or more wires or other supporting frame members, which maintain the relative positioning, separation and alignment of the cage bars. Thus, a pile cage is a relatively stiff, structurally relatively stable assembly, and is often manufactured off-site in a dedicated assembly plant and transported by vehicle to the building site ready for use in the building of the required piles.

Typically a hole of the required size and cross-sectional shape to form the pile is formed in the ground by drilling and is then at least partially lined (to prevent wall collapse) with a reusable casing. A pile cage is then lowered into the lined hole, and wet concrete is then poured therein, embedding the cage within it. The casing is then withdrawn, for re-use in the building of another pile, while the concrete is still wet, and the concrete is then allowed to cure to form the pile. Frequently, however, it is necessary to form particularly tall piles, i.e. of a height greater than the length of a single individual pile cage. In this case it is common practice to splice together at least two pile cages end-to-end, i.e. to connect the top end of a lower pile cage to the bottom end of an upper pile cage. Frequently as many as three, four or even more individual pile cage sections are spliced together end-to-end in a corresponding manner to form a single unified pile cage of the required total length. The complete pile cage assembly is typically built up incrementally as the individual cage sections are spliced together and lowered in a stagewise manner into the lined hole. During the splicing and stagewise lowering operation each successive pile cage section is generally accurately positioned (e.g. using a crane) directly above an exposed upper portion of the pile cage section below it, then spliced thereto by whatever means is being employed for that job.

In the formation of concrete structures other than circular piles, reinforcement cages of other types may be used. For example, diaphragm walls, such as those of rectangular, or even L-shaped or T-shaped, cross-section may be formed in an analogous manner to cylindrical piles, but instead of using a pile cage as such, a reinforcement cage of an appropriate alternative shape and configuration is used. Such an alternative form of reinforcement cage used to form diaphragm walls may thus be termed a "diaphragm wall cage".

Splicing together pairs of reinforcement cages, whether of the pile, diaphragm wall or other type, is however not a simple matter, and the job comes with ever increasing health and safety risks that have to addressed. Various methods and devices for splicing together reinforcement cages are therefore known, and in recent years these have not only been aimed at simplifying the mechanical job of uniting adjacent reinforcement cage lengths, but also to do so with greater attention paid to health and safety risks, such as of the need to avoid workers having to place their hands or arms inside the interior space within a part-assembled reinforcement cage during a splicing operation.

One such well-known and currently commercially widely used system for splicing together adjacent pile cages is disclosed in published International Patent Application WO2007/068898 (also published as EP1963579A). Here a supported lower pile cage is fitted with a circumferential suspension band, e.g. by welding to the longitudinal cage bars, and the upper pile cage is fitted with at least one support plate (preferably a plurality, e.g. three, thereof, equi-angularly spaced) such as by welding thereof to a respective cage bar. Each support plate has a screw-threaded aperture therein, into which is screwable from outside the cage a respective suspension bolt. Once the upper pile cage has been lowered (e.g. by a crane) and accurately positioned above the lower pile cage with the support plates on the upper pile cage positioned adjacent the suspension band on the lower pile cage and the axis of the threaded apertures in the support plates located below the suspension band, the suspension bolts are inserted into their respective threaded apertures in the support plates so as to protrude radially inwardly of the pile cages (i.e. transverse to the longitudinal axes of the pile cages and directed generally towards those axes) and beneath the suspension band on the lower pile cage. Once screwed home, the suspension bolts thus collectively abut the underside of the suspension band and so serve to carry the lower pile cage beneath the upper pile cage as the latter is lifted or craned into a new position, such as a new location on site or to be lowered into a casing ready for pouring of concrete to form a pile around the combined pile cages.

In an alternative configuration to the above, the support plates may instead be provided on the lower pile cage and the suspension band on the upper pile cage. In this case, in the step of lowering and positioning the upper pile cage above the lower pile cage, the axis of the threaded apertures in the support plates is located above the suspension band, so that once the suspension bolts have been inserted into their respective apertures in the support plates and screwed home, the suspension bolts thus collectively abut the topside of the suspension band. In this manner the suspension band (on the upper pile cage) still serves to carry the lower pile cage beneath the upper pile cage as the latter is lifted or craned into a new position, it simply being that the support plates and the suspension band have been inverted in their relative positioning on the respective upper and lower pile cages.

We have found that in practice this known pile cage splicing system has several disadvantages:

These known radially-inwardly extending suspension bolts are anchored and supported substantially only at their radially outer ends, i.e. in their respective support plates only. This "encastré" cantilevering means that in the event that load is placed on a bolt at a point a distance "x" away from its cantilevered anchoring in its respective plate, then any lateral deflection suffered by the bolt at that loading point is proportional to "$x^3$". Thus, any loads applied to the bolts at increasing radial distances from their respective anchoring points in the respective support plates can give rise to especially large lateral bolt deflections. This can be critical for suspension bolts of a given diameter and/or strength, since even modest loadings on such bolts at increasing distances from their respective support plates can cause moderate or even excessive bending of the bolts, or even their breaking altogether. Such mechanical failure of at least some of the suspension bolts means that they can no longer be expected to properly support and carry the suspension band of the lower pile cage, which as a result may all too easily slide off at least some of the suspension bolts or even the entire collective support provided by the complete array of bolts. At worst the lower pile cage may even fall off it completely, the suspension band having slid off the bolts entirely, and become separated from the pile cage assembly. Clearly this can lead to highly risky working conditions for site workers and may have highly serious consequences for health and safety.

This application of loading forces, especially eccentric loading forces, on the suspension bolts at increasing distances from their respective anchoring locations on the support plates may be commonly encountered in any instance where a given pile cage is free to move laterally (i.e. transversely relative to the longitudinal direction of the pile cage) with respect to an adjacent pile cage. Such freedom of movement may occur for example where a pile cage has been damaged, e.g. bent, in transit or in storage, possibly as a result of mis-handling or lack of supervision. In the case of pile cages which incorporate spacers that are used to centralise adjacent pile cages with respect to one another and/or within a casing, it may also result from damage or flattening to such spacers. It may also result from asymmetrical misalignments in the relative configurations of the cage bars of adjacent pile cages where one is "cranked" with respect to the other, i.e. the cage bars of one cage in an end region thereof are configured so as to be bent to lie a short distance radially inwardly of the main body of the other cage, in order to improve the flow of liquid concrete into the cage when poured therein and also to assist in the alignment of one pile cage with respect to the next.

Moreover, the exertion of an excessive bending load on one suspension bolt only can easily lead to overloading of other bolts at other circumferential locations around the cage, possibly leading to progressive failure of all the bolts. It is thus a potentially particularly serious shortcoming of this known system of splicing pile cages that relies on cantilevered suspension bolts to perform a stable and reliable cage suspending function.

Corresponding problems can occur in the use of known reinforcement cages of other types, including diaphragm wall cages, which are constructed and utilised in an analogous manner and using corresponding principles to pile cages.

It might be suggested that an amelioration of these problems might be to use longer and/or thicker or stronger suspension bolts. However in practice this is not a good solution. For one thing, it would require the use of heavier and bulkier components and equipment, which not only increases cost, but also makes manual fixing and screwing home of the suspension bolts more difficult and time consuming, which may be especially troublesome in the case of congested cages where small circumferential gaps between bars may not allow the insertion of thicker bolts. For another thing, it does not address the fundamental problems arising from overloading and excessive bending of even such longer and/or stronger bolts as a result of loading points increasingly spaced from their "encastré" cantilevered fixings in the respective support plates, which can still occur for the practical reasons discussed above. Furthermore, the use of longer bolts would generally be undesirable anyway, since they would hinder the placement into the interior of the spliced cages, once in position in the relevant hole in the ground, of the (circular) concreting tube ("tremmie") used to fill the hole with wet concrete during the pouring stage of the pile- or wall-forming operation.

Another practical problem with known cage splicing devices such as those of EP1963579A above is that the use of threaded bolts inserted in the threaded apertures of the support plates requires very precisely engineered components made from high-quality, high carbon-footprint materials, which increases manufacturing costs. It can sometimes occur that as-manufactured threaded components may not always fit together exactly, and moreover during transport or while on-site threads can become damaged, e.g. by impact with other components, or clogged with dirt or debris, all of which issues can cause unnecessary delays in the running of an efficient pile building operation.

A further practical problem associated with the use of suspension bolts as in EP1963579A is that the use of bolts as separate components means that any given cage splicing job relies on the provision to site and utilisation of loose items which can sometimes get dropped or lost, even down the hole above which the cages are being spliced. Again, this can result in delays and also unnecessary wastage of usable components.

SUMMARY OF THE INVENTION

It is a primary object of the present invention to solve or ameliorate, at least partially, at least some of the above problems associated with prior art reinforcement cage splicing systems, in particular the pile cage splicing system of WO2007/068898 (EP19663579A), by providing a reinforcement cage splicing device that does not rely on mere cantilevered suspension bolts.

Accordingly, in a first aspect the present invention provides a device for splicing together a first reinforcement cage and a second reinforcement cage, the first reinforcement cage comprising a suspension band adjacent one of its ends and the second reinforcement cage carrying the said device adjacent one of its ends, wherein the device comprises:

an anchoring portion carried on a portion of the second reinforcement cage adjacent its one end and configured or configurable such that at least a portion thereof is radially spaced from the second reinforcement cage so as to define a radial suspension gap between the said portion and the second reinforcement cage, the suspension gap being configured for receiving therein the suspension band on the first reinforcement cage as the first and second reinforcement cages are spliced together; and gate means constructed and arranged so as to be selectively configurable in either an open configuration, in which the suspension band on the first reinforcement cage can be inserted into or received in the suspension gap via the gate means, or a closed configuration in which the suspension band on the first reinforcement cage, once located in the suspension gap, is prevented from being removed therefrom via the gate means, wherein the gate means is moveable between its open and closed configurations by virtue of at least a portion thereof being moveable by pivoting.

Thus, in accordance with many embodiments of the invention, what is now proposed is that the first and second reinforcement cages are spliceable and thus liftable together by virtue of the suspension band on the first reinforcement cage being engageable, especially abuttingly engageable, by or with a portion of the pivotally closable gate means which is configurable to effectively "trap" the suspension band in the suspension gap formed between the second reinforcement cage and the anchoring portion of the device carried thereon, in which "closed" configuration the suspension band is prevented from being withdrawn therefrom via the gate means when configured in its pivotally closed configuration.

As a result of the gate means being moveable between its open and closed configurations by virtue of at least a portion thereof being moveable by pivoting, a mechanically simple yet efficient suspension gap-closure mechanism is provided in order to enable the gate closure portion to securely engage the suspension band when the cages are in their spliced relationship and during the operation of lifting the thus spliced cages together. Moreover, in many embodiments this mechanism may allow the principal operational components of the splicing device all to be provided in situ as integral components of a pre-assembled or pre-attached device, thereby dispensing with the need to provide and handle separate auxiliary components on-site which may be dropped or get lost. Additionally, the novel manner of detaining the suspension band in the suspension gap by the pivotable gate means (or portion thereof) may tend to hinder or even substantially prevent any, or any excessive, lateral transverse movement of the reinforcement cages relative to one another, which is also an advantage in assisting the reduction or amelioration of problems associated with excessive lateral loadings on cantilevered suspension bolts characteristic of prior art splicing devices.

According to a second aspect of the present invention, there is provided a splicing device per se for splicing together a first reinforcement cage and a second reinforcement cage, the first reinforcement cage comprising a suspension band adjacent one of its ends and the device being attachable to the second reinforcement cage adjacent one of its ends, wherein the said splicing device comprises:

an anchoring portion attachable to a portion of said second reinforcement cage adjacent said one end thereof and configurable, once attached to said second reinforcement cage, such that at least a portion thereof is radially spaced from the second reinforcement cage so as to define a radial suspension gap between the said portion and the second reinforcement cage, the suspension gap being configurable for receiving therein the suspension band on the first reinforcement cage as the first and second reinforcement cages are spliced together; and gate means constructed and arranged so as to be selectively configurable, once the device has been attached to the second reinforcement cage, in either an open configuration, in which the suspension band on the first reinforcement cage is insertable into or receivable in the suspension gap via the gate means, or a closed configuration in which the suspension band on the first reinforcement cage, once located in the suspension gap, is preventable from being removed therefrom via the gate means, wherein the gate means is moveable, once the device has been attached to the second reinforcement cage, between its open and closed configurations by virtue of at least a portion thereof being moveable by pivoting.

Thus, according to this second aspect the splicing device may be provided as a discrete item per se, independent of the first and second reinforcement cages that are to be spliced together by means thereof. The structural components of the splicing device per se may for example be pre-manufactured and supplied separately, e.g. for attachment to or assembly with a second reinforcement cage in a dedicated off-site facility, ready for transport of the prepared second—and optionally also first—reinforcement cage(s) to a particular desired site at which the splicing together of the cages is actually to take place during a pile or reinforcing wall construction operation. Alternatively the attaching of the splicing device per se to, or assembly thereof with, a second reinforcement cage may be carried out on-site, even at the actual site at which the splicing of the cages is to take place during the construction operation.

Embodiments or features of the above-defined splicing device per se according to this second aspect of the invention may correspond to any respective embodiments or features of the splicing device of the first aspect of the invention discussed and/or defined and/or described hereinabove or hereinbelow.

According to a third aspect of the present invention, there is provided, in combination, a second reinforcement cage and a splicing device carried thereon adjacent one of the ends thereof, the second reinforcement cage being for splicing, by means of the device, to a first reinforcement cage comprising a suspension band adjacent one of its ends, wherein the device comprises:

an anchoring portion carried on a portion of the second reinforcement cage adjacent its one end and configured or configurable such that at least a portion thereof is radially spaced from the second reinforcement cage so as to define a radial suspension gap between the said portion and the second reinforcement cage, the suspension gap being definable or configurable such as to be able to receive therein the suspension band on the first reinforcement cage as the first and second reinforcement cages are spliced together; and gate means constructed and arranged so as to be selectively configurable in either an open configuration, in which the suspension band on the first reinforcement cage is insertable into or receivable in the suspension gap via the gate means, or a closed configuration in which the suspension band on the first reinforcement cage, once located in the suspension gap, is preventable from being removed therefrom via the gate means, wherein the gate means is moveable between its open and closed configurations by virtue of at least a portion thereof being moveable by pivoting.

Thus, according to this third aspect the splicing device and second reinforcement cage may be provided as a discrete assembly or unit, independent of the first reinforcement cage to which the second reinforcement cage is spliceable by means of the device. Again, the second reinforcement cage and the components of the attached splicing device may for example be pre-manufactured and pre-assembled in a discrete preparative step, e.g. in a dedicated off-site facility, ready for transport of the combined second reinforcement cage—with splicing device attached—to a particular desired site at which the splicing to the first reinforcement cage is actually to take place during a pile or reinforcing wall construction operation.

Embodiments or features of the splicing device of the above-defined combination of second reinforcement cage with attached splicing device according to this third aspect of the invention may correspond to any respective embodiments or features of the splicing device or splicing device per se of the first or second aspects of the invention discussed and/or defined and/or described hereinabove or hereinbelow.

According to a fourth aspect of the present invention, there is provided a method of splicing together a first reinforcement cage and a second reinforcement cage, the first reinforcement cage comprising a suspension band adjacent one of its ends and the second reinforcement cage carrying adjacent one of its ends a splicing device according to the second or third aspects of the invention or any embodiment thereof, wherein the method comprises:

(i) with the gate means of the device configured in its open configuration, bringing together the first and second reinforcement cages into a splicing spatial relationship such that the suspension band of the first reinforcement cage is inserted into or received in the suspension gap defined between the anchoring portion of the device and the portion of the second reinforcement cage on which the device is carried; and (ii) configuring the gate means, by pivotal movement of its said at least one pivotable portion, into its closed configuration in which the suspension band is prevented from being removed from the suspension gap via the gate means.

Thus, according to this fourth aspect, once the gate means has been configured, by pivotal movement of its said at least one pivotable portion, into its closed configuration, by virtue of the suspension band now being prevented from being removed from the suspension gap via the gate means the first and second reinforcement cages are thereby spliced together, in which condition at least a portion of the gate means and the suspension band are engaged, especially abuttingly engaged, so that as the relevant one, i.e. the upper one in many embodiments, of the first and second reinforcement cages is lifted so the other one of the first and second reinforcement cages spliced thereto is lifted with it.

Embodiments of the above-defined method according to this fourth aspect of the invention may employ any embodiment of splicing device or splicing device per se of the first or second aspects of the invention discussed and/or defined and/or described hereinabove or hereinbelow.

In practising embodiments of the above-defined splicing method, once the reinforcement cages have been spliced thereby there may then follow a conventional step or method of lifting the thus-spliced first and second reinforcement cages, with the weight of the lower reinforcement cage (preferably the first one, in preferred orientations) being borne, via its attached suspension band, by the closed gate means of the splicing device carried on the upper reinforcement cage (preferably the second one, in preferred orientations) and abutting or otherwise engaging the underside of the said suspension band.

According to a fifth aspect of the present invention, there is provided, in combination, a first reinforcement cage and a second reinforcement cage, the reinforcement cages being spliced together by a method according to the fourth aspect of the invention or any embodiment thereof, or by means of a splicing device according to the first aspect of the invention or any embodiment thereof, or by means of a splicing device per se according to the second aspect of the invention or any embodiment thereof.

In the practising of many embodiments of the invention, the splicing device may be arranged such that the second reinforcement cage on which it is carried is that reinforcement cage which is the uppermost one of the pair of reinforcement cages, the lowermost reinforcement cage of the pair being the first reinforcement cage and having the suspension band attached thereto.

Of course, however, in other embodiments of the invention, and within the scope thereof, the arrangement may be reversed or inversely transposed, so that the second reinforcement cage, on which the splicing device is carried, is that reinforcement cage which is the lowermost one of the pair of cages, and the first reinforcement cage, having the suspension band attached thereto, is the uppermost reinforcement cage of the pair. Thus, in different preferred embodiments the orientation of the "first" and "second" reinforcement cages and thus also the orientation of the splicing device may be inverted, whilst the interaction of the device with the relevant parts of both reinforcement cages and its practical function remain substantially the same. For the most part, however, the following discussion of embodiments and example arrangements of the invention will focus on the first orientation defined above, i.e. with the splicing device being carried on the upper, "second" reinforcement cage and the suspension band being carried on the lower, "first" reinforcement cage.

In accordance with the invention the splicing device is carried on or by the second reinforcement cage adjacent one end of that second cage, which is to say that the device is provided on a portion or region of that second cage near or towards or in the vicinity of one longitudinal end or end portion of that second cage. Likewise, in accordance with the invention the suspension band is provided on the first reinforcement cage adjacent one end of that first cage, which is to say that the suspension band is provided on a portion or region of that first cage near or towards or in the vicinity of one longitudinal end or end portion of that first cage. In practice, the respective end portions of the respective first and second cages are of a respective longitudinal extent such that those respective end portions of the two cages radially overlap or at least partially radially overlap as the first and second cages are brought into their splicing relationship and the splicing device operated to splice the two cages together.

The suspension band on the first reinforcement cage may be attached thereto by any suitable known means, e.g. by welding directly onto the bars of the first reinforcement cage bars, as is already known in the art.

In some embodiments the suspension band on the first reinforcement cage may be formed as a continuous suspension band whose length may extend over substantially the whole circumferential or lateral length of the first reinforcement cage (i.e. circumferential length thereof in the case of a cylindrical first reinforcement cage, or lateral length thereof in the case of a first reinforcement cage of another, especially a rectangular, cross-sectional shape), for example such that the suspension band may, in the case of a cylindrical first cage, be generally circular or annular in its overall extent, or in the case of a first cage of another, especially rectangular, cross-sectional shape may extend over substantially the whole lateral length of the first cage, and (in either case) may be attached, e.g. by welding, to the various cage bars substantially all the way along its length. Alternatively the suspension band may have a length sufficient merely to extend over and across only some of, e.g. at least 2 or 3 or more of, the individual cage bars of the first reinforcement cage, to each of which bars the band may again be attached by e.g. welding.

However, in other embodiments, e.g. in an effort to save on materials costs, the suspension band may be of a modular form, in which the suspension band comprises a plurality of discrete modular suspension band segments. Each suspension band segment may individually be generally arcuate or straight in its length direction, depending on the overall shape and configuration of the complete suspension band to be formed from the segments and/or of the first cage itself. Each respective such suspension band segment may have a suitable circumferential or lateral (as the case may be, depending on the cross-sectional shape of the first cage) length sufficient to span a circumferential or lateral (as the case may be) distance which is at least that distance between, especially between the centres of, two adjacent cage bars of the first cage, so that the respective band segment may be anchored at or adjacent each of its respective ends (again e.g. by welding) to those adjacent cage bars. The circumferential or lateral (as the case may be) positioning of the discrete suspension band segments may also be selected so that they are each located at an appropriate circumferential or lateral (as the case may be) position to match and facilitate their engagement with a respective one of the various splicing devices provided on the second reinforcement cage during the splicing operation.

Thus, as the term is used herein, "suspension band" is to be construed as encompassing any and all of the above forms, i.e. both continuous (i.e. circular or annular, or full-lateral-length), or part-continuous, as well as modular (i.e. plural discrete or segmented) suspension bands.

In many embodiments of the invention the anchoring portion, which is carried on a portion, e.g. a cage bar, of the second reinforcement cage adjacent its one end and configured or configurable so as to define the said radial suspension gap between the said portion and the second reinforcement cage, may be configured or configurable such that at least a portion of the anchoring portion is radially inwardly spaced from the second reinforcement cage. Furthermore, in such embodiments the anchoring portion may be oriented or orientable such that its general longitudinal dimension is generally substantially parallel, or near to parallel, to the axial direction of at least the second reinforcement cage, so that the anchoring portion is configured or configurable to bound the suspension band of the first reinforcement cage on a radial side of the suspension band opposite the radial side thereof facing the second reinforcement cage itself.

Thus, the anchoring portion may be configured or configurable such that at least a portion thereof is located or positioned radially further inwardly relative to the general radial location or position of the cage bar(s) of the second reinforcement cage, or relative to at least the radial location or position of the cage bar thereof which carries or is closest to the anchoring portion. Accordingly in many embodiments of the invention the suspension gap may be formed or defined radially inwardly of the main structure of the second reinforcement cage, and the suspension band may be located on the first reinforcement cage in a corresponding relatively further radially inward location than the main structure of the second reinforcement cage with which it is to be spliced, whereby the end or end portion of the first reinforcement cage may be overlappingly spliced with the end or end portion of the second reinforcement cage with the former being located radially inwardly of the latter.

However, in certain alternative embodiments the arrangement may be reversed, in the sense that the anchoring portion may be configured or configurable such that at least a portion thereof is radially outwardly spaced from the second reinforcement cage, whereby the suspension gap may be formed or defined radially outwardly of the main structure of the second reinforcement cage, with the suspension band likewise located on the first reinforcement cage in a corresponding relatively further radially outward location than the main structure of the second reinforcement cage with which it is to be spliced, whereby the end or end portion of the first reinforcement cage may be overlappingly spliced with the end or end portion of the second reinforcement cage with the former being located radially outwardly of the latter. However, for the most part the following discussion of embodiments and example arrangements of the invention will focus on the first of the aforementioned relative orientations, i.e. with the suspension gap being defined and formed, and thus the splicing of the two cages being effected, radially inwardly of the main structure of the second reinforcement cage.

In many embodiments of the invention the portion of the second reinforcement cage which carries the anchoring portion of the device may be a cage bar, or a portion of a cage bar, of the second reinforcement cage. The site of attachment of the device on the relevant cage bar may in many instances be on one lateral side of the cage bar, i.e. at approximately the same radial location as the cage bar itself (relative to the central axis of the second cage), although other attachment sites may be possible, e.g. radially inwardly of the relevant cage bar.

In various embodiments of the invention the anchoring portion of the splicing device which is carried on a portion of the second reinforcement cage adjacent its one end may be configured or configurable in various different ways such that at least a portion thereof is radially spaced from the second reinforcement cage so as to define the said radial suspension gap into which the suspension band on the first reinforcement cage may be received or inserted. In some embodiment arrangements the constructional arrangement by which the anchoring portion is carried on the second reinforcement cage may constitute or contribute to the means by which the gate means is variably configurable in either of its open or closed configurations.

For instance, in some embodiments the anchoring portion of the device may be carried on the cage bar or other portion of the second reinforcement cage directly, in particular by being attached directly to the relevant cage bar or other portion of the second cage, optionally via a mounting or attachment stub, boss, spigot, flange, bracket or other protruding member provided on, e.g. integral with or pre-attached to, the cage bar or other portion of the second cage, which provides a secure anchoring location for carrying the anchoring portion of the device.

In some such embodiments the anchoring portion may be substantially fixedly mounted on that portion of the second reinforcement cage on which it is carried, and configured such as to define a said radial suspension gap which is of substantially fixed width, especially radial width. In such embodiments the anchoring portion may carry, at an end thereof distal from the portion of the second reinforcement cage on which it is fixedly carried, at least a portion or component of the gate means. That portion or component of the gate means may in some embodiments be or comprise that portion of the gate means which is pivotable so as to render the gate means configurable in either of its open or closed configurations. However, in other embodiments one or more other portions or components of the gate means may be or comprise that portion of the gate means which is so pivotable so as to render the gate means configurable in either of its open or closed configurations.

Alternatively, in other such embodiments the anchoring portion itself may be pivotally mounted on that portion of the second reinforcement cage on which it is carried, and thereby configurable relative to the second reinforcement cage such as to define a said radial suspension gap which is of variable width, especially radial width. In some such embodiments a portion of the anchoring portion may thus constitute or provide the said portion of the gate means which is pivotable so as to enable the overall gate means to be variably configurable in either of its open or closed configurations. Such a pivotal mounting of the anchoring portion may for example comprise a rotational mounting, e.g. a mounting pin, rod, axle, spigot, bolt or other rotational joint which allows or provides for rotational relative movement between the respective parts. In this manner the pivotal mounting of the anchoring portion itself may constitute or contribute to the variable configuration of the gate means which enables it to be variably configurable in either of its open or closed configurations.

In certain of the above embodiments the anchoring portion may be constituted by or provided by an, or a portion of an, anchoring plate, bracket, strip or rod, or a discrete arm or leg thereof, fixedly carried on, e.g. by being fixedly attached to, the portion of the second reinforcement cage. The anchoring plate may be formed of any suitable metal, e.g. steel, especially that same steel as may be used to form the bars of the reinforcement cages themselves. Given the physical shape of such preferred forms of the anchoring portion of the device, in practising many embodiments of the invention this may for example lend them particularly advantageously to being made, formed or cut from scrap steel or other metal. The manner of fixed attachment may be of any suitable form, e.g. welding.

However, in other embodiments, the anchoring portion of the device may be carried on the cage bar or other portion of the second reinforcement cage indirectly, in particular via a bridging member, e.g. a bridging plate, bracket, strip or rod, which bridging member is attached, e.g. by welding or a suitable mechanical attachment, at one end thereof to the said anchoring portion and at an opposite end thereof attached to the said portion of the second reinforcement cage. In such embodiments the anchoring portion may carry, at an end thereof distal from the bridging member, at least a portion or component of the gate means.

In some such embodiments the bridging member may be constituted by an intermediate arm or leg section of a yoke, especially a plural-sectioned (e.g. 2- or 3-sectioned) substantially rigid yoke, of which one other arm or leg section thereof constitutes the said anchoring portion of the device and optionally a further arm or leg section thereof constitutes an attachment portion via which the remainder of the yoke is attached, e.g. by welding, to the portion of the second reinforcement cage. In any such embodiments comprising a yoke the respective sections thereof may for example be provided or constituted by respective integrally formed sections of a unitarily formed yoke, e.g. cut as one piece from a sheet or plate of the relevant suitable yoke material, or alternatively the respective sections of the yoke may be pre-formed as discrete components, e.g. cut from scrap steel or other metal, and e.g. welded together in a fixed configuration to form the complete yoke.

In cases where at least two or more of the sections of the yoke are shaped as plates, i.e. with at least one pair of major faces defining therebetween a relatively thin dimension (relative to those faces' length and width dimensions), the general planes of those plates may be oriented either generally parallel or generally perpendicular relative to one other. In one example form the intermediate bridging member section of the yoke may be oriented with its width direction generally substantially parallel to the longitudinal direction(s) of the or at least one or more other sections of the yoke, in order to enhance the overall stiffness and strength of the combined plural-sectioned yoke arrangement. Such arrangements may be particularly useful in the case of especially wide suspension gaps, e.g. in embodiments in which it is required to accommodate especially fat or wide suspension bands and/or cage bars therein. However, in some forms the possible presence of relatively narrow circumferential gaps between cage bars on the radially inner reinforcement cage may be accommodated by positioning the anchoring member radially inside the cage bars of the radially inner reinforcement cage by using a larger bridging member.

Thus, in some such embodiments in which the anchoring portion of the device is carried indirectly on the cage bar or other portion of the second reinforcement cage via a bridging member, the bridging member itself may preferably be substantially fixed relative to the portion of the second reinforcement cage on which it is carried, e.g. by virtue of being fixedly attached thereto, such as by welding, optionally as part of the aforementioned yoke. However, in various such embodiments the anchoring portion itself which defines the suspension gap may or may not be pivotable relative to the bridging member on which it is carried, depending for example on the constructional arrangement of the gate means, at least a portion of which may be carried on an end of the anchoring portion distal from the bridging member.

For instance, in certain embodiment arrangements the anchoring portion may carry, at an end thereof distal from the bridging member, at least the said portion or component of the gate means which is itself pivotable so as to render the gate means configurable in either of its open or closed configurations. However, in other embodiment arrangements one or more other portions or components of the gate means may be or comprise that portion of the gate means which is so pivotable so as to render the gate means configurable in either of its open or closed configurations. Further alternatively, in certain other embodiment arrangements the anchoring portion itself which defines the suspension gap may be pivotable relative to the bridging member on which it is carried, e.g. by virtue of being pivotally attached thereto, such as via a rotational mounting, e.g. via a mounting pin, rod, axle, spigot, bolt or other rotational joint which allows or provides for rotational relative movement between the respective parts. Thus, in this arrangement the anchoring portion may again be configurable, but now relative to the bridging member, such as to define a radial suspension gap which is of variable width, especially radial width. In this instance the pivotal mounting of the anchoring portion on the bridging member may again constitute or contribute to the variable configuration of the gate means which enables it to be variably configurable in either of its open or closed configurations.

In embodiments in which a bridging member is present, the arrangement of the bridging member may in many cases be such that the bridging member may serve to additionally close the suspension gap at an axial longitudinal location spaced from the gate means (which axial longitudinal location may be spaced from the gate means by a distance at least as great as (optionally slightly or somewhat greater than) the axial height of the suspension band), such that the bridging member may additionally trap the suspension band in the suspension gap but from the longitudinally opposite side from that which the gate means does so. In this manner the suspension band may be bounded on all its sides, e.g. all its four sides in many embodiments, by the various components of the overall splicing device, possibly including one or more of the cage bars of one or more of the cages themselves.

In general, in practical embodiments of the invention the anchoring portion which is configured or configurable relative to the second reinforcement cage, or in certain embodiments relative to the bridging member via which it is carried thereon, may be so configured or configurable such that the suspension gap thus defined is of a radial width at least sufficient to accommodate therein the thickness of the suspension band on the first reinforcement cage. It may however be preferred that the width of the suspension gap is not excessive over and above that distance, so that a significant or relatively large amount of play or free radial movement of the suspension band within the suspension gap, once received therein, may be avoided or minimised.

In some embodiments of the invention the anchoring portion of the device may comprise at least one portion, especially at least one side or edge or corner portion, in particular an upper such portion thereof (when the second reinforcement cage carrying the device is the upper one of the pair), which is chamfered, bevelled or convexly curved. This feature may serve to avoid or facilitate against its fouling with or against cage bars or other structural components of the first reinforcement cage as the two cages are brought together in the splicing operation, and also to avoid or facilitate against hindrance to the placement into the interior of the spliced cages, once in position in the relevant hole in the ground, of the (usually circular) concreting tube ("tremmie") used to fill the hole with wet concrete during the pouring stage of the pile- or wall-forming operation.

In embodiments of the invention in which the anchoring portion is itself pivotable relative to the second reinforcement cage, or in certain embodiments the bridging member via which it is carried thereon, such as to constitute or contribute to the variable configurability of the gate means in its respective open or closed configurations, if desired or necessary the device may further comprise locking means for locking the anchoring portion in at least one selected pivotal position thereof. Such an at least one selected pivotal position thereof may be a "closed" pivotal position which effects or contributes to the closed configuration of the gate means, whereby actuation of the locking means to lock the anchoring portion in said "closed" pivotal position, once it has been pivoted into that relative pivotal position, serves to lock the gate means into its closed configuration also.

In some practical forms the locking means may be constructed and arranged for locking the anchoring portion in each of at least two selected pivotal positions thereof, especially at least "closed" and "open" pivotal positions thereof. Such a "closed" pivotal position may correspond to the "closed" pivotal position mentioned above, whereas the said "open" pivotal position may effect or contribute to the open configuration of the gate means, whereby actuation of the locking means to lock the anchoring portion in said "open" position, once it has been pivoted into that relative pivotal position, serves to lock the gate means into its open configuration also.

In such embodiments the locking means may take any suitable form. For example, it may comprise a nut and bolt combination, one of said components being provided on one of the pivotal anchoring portion and a fixed location on e.g. a cage bar or other portion of the second reinforcement cage and the other of said components being provided for engagement with the first mentioned said component. Such an arrangement may optionally include an apertured bracket, flange, lug or plate at or on at least one of said pivotal anchoring portion and fixed location and through which the said bolt may be passed before engagement with said nut. As another example, the locking means may comprise a rotatable screw, bolt or pin provided on one of the pivotal anchoring portion and a fixed location on e.g. a cage bar or other portion of the second reinforcement cage, and an engagement hole or aperture, preferably screw-threaded, in the other of the said pivotal anchoring portion and fixed location and into which the screw, bolt or pin may be inserted, e.g. by screwing, such as in the manner of a grub screw. Other mechanical fixing arrangements in the form of one or more detents or other (inter)engagement elements may instead possibly be used. Any such locking means may serve to lock the anchoring portion in either or any of its relative positions either by virtue of penetrating into or through the material of the anchoring portion or fixed location, as the case may be, or alternatively by abuttingly engaging an edge or side thereof.

In other embodiment forms such locking means may be constructed and arranged merely—or even additionally—to urge or tend to maintain the anchoring portion in the, or each respective one of its two or more, e.g. "closed" and "open", pivotal positions. In such forms the locking means may comprise a cam member or a weighted nose provided on the anchoring portion and abuttingly engageable with a portion of the second reinforcement cage, wherein the weight of the relevant enlarged or protruding part of the cam member or nose, optionally under the additional force of the suspension band on the first reinforcement cage bearing thereagainst when the cages are in their spliced relationship and being lifted, urges the locking cam or nose into its "closed" position.

In certain embodiments, if desired or necessary a combination of two or more of any such locking means may be included for urging and maintaining in a substantially locked relative configuration the anchoring portion in either, or each of one or more respective ones, of its respective pivotal positions.

In some embodiments, whether or not comprising locking means such as any of those defined above, the device may additionally comprise one or more resilient members, especially one or more resilient urging members, e.g. one or more springs, such as one or more coil springs or leaf springs, arranged to urge or bias the anchoring portion into or towards either, or each of one or more respective ones of, its respective pivotal positions, especially its respective limiting pivotal positions.

In accordance with the invention the gate means of the splicing device is constructed and arranged such as to include at least a portion which is moveable by pivoting, whereby the gate means is selectively configurable in either an open configuration, in which the suspension band on the first reinforcement cage can be inserted into or received in the suspension gap via the gate means, or a closed configuration in which the suspension band on the first reinforcement cage, once located in the suspension gap, is prevented from being removed therefrom via the gate means.

In various embodiments the said pivotal portion of the gate means may be constituted by a discrete pivotal portion or component or group of components of the gate means itself, or alternatively the said pivotal portion of the gate means may be constituted by a portion or component of the anchoring portion of the device. Thus, in some embodiments the anchoring portion, which defines the suspension gap, may so define the suspension gap independently of the gate means, which is independently configurable into the said open or closed configurations to permit insertion of or to trap, as the case may be, the suspension band in the formed suspension gap. However, in other embodiments, in particular embodiments in which the anchoring portion is itself pivotable relative to the second reinforcement cage (or bridging member, if provided), the portion of the gate means which is pivotable to enable the gate means to assume its open or closed configurations may be constituted or provided by a portion of the anchoring portion itself, whereby the anchoring portion not only defines the suspension gap but also at least partially serves as the pivotable portion of the gate means which enable it to assume its open or closed configurations.

In some embodiments of the invention, in particular those in which the gate means comprises at least one portion which is independent of the anchoring portion and is itself moveable by pivoting, the said gate means—and preferably the said at least one portion thereof—may comprise at least one pivotable latch member, which latch member is pivotable between the said open and closed configurations to permit insertion of or to trap, as the case may be, the suspension band in the formed suspension gap. The or each pivotable latch member may be pivotable by virtue of being mounted on or in the device via a respective rotational pivot mounting, for example comprising a mounting pin, rod, axle, spigot, bolt or other rotational joint which allows or provides for rotational relative movement between the respective parts.

In many such embodiments the axis of such rotational pivoting of the at least one latch member may be oriented generally substantially circumferentially or tangentially or chordally or transversely relative to the general longitudinal axial arrangement of the reinforcement cages themselves.

However, in certain other embodiments it may be possible for the at least one latch member, or even the gate means entirely, to be oriented such that the axis of rotational pivoting of the at least one latch member is oriented generally substantially axially or longitudinally relative to the general longitudinal axial arrangement of, or parallel to the longitudinal axis of, the reinforcement cages. Some specific example arrangements according to such embodiments will be described further below in the context of various specifically described example embodiments as shown in certain ones of the accompanying drawings.

In some embodiments the at least one pivotable latch member may be pivotally moveable at least in a direction further into or within the said suspension gap as it pivots into its open position. In embodiments in which the anchoring portion is carried on the second reinforcement cage via a bridging member, the said at least one pivotable latch member may be pivotable such as to be pivotally moveable at least in a direction further into or within the said suspension gap and towards the said bridging member as it pivots into its open position. In such embodiments the at least one pivotable latch member may thus be pivotable further into or within the suspension gap such that when it assumes the gate means' open configuration it lies within the suspension gap towards or adjacent a or a respective radial side thereof, e.g. adjacent one of or a respective one of the anchoring portion itself (defining the suspension gap) and the second reinforcement cage (or a cage bar thereof). In this manner when in this open configuration the at least one latch member may allow the suspension band on the first reinforcement cage to pass substantially freely by it as the suspension band is inserted or received into the suspension gap as the two reinforcement cages are brought together into their splicing relationship. In some practical scenarios, as the suspension band is inserted or received into the suspension gap it may actually engage or abut a side or edge of the at least one latch member to cause it to pivot out of the way towards the or the respective said radial side of the suspension gap. In either case, once the suspension band has been inserted or received in the suspension gap to assume its trapped position therein, the at least one latch member may be pivoted back in the opposite direction to assume the gate means' closed configuration, in which the suspension band is now trapped within the suspension gap such as to be unable to be withdrawn therefrom via the gate means. In this configuration the suspension band thus may abut or be forced or borne against the closed at least one latch member as the spliced reinforcement cages are then lifted together.

In some such embodiments the pivoting of the at least one latch member may be assisted or forced in one direction only—preferably that in which the at least one latch member assumes the gate means' closed configuration—by means of at least one resilient member, especially at least one resilient urging member, e.g. one or more springs, such as one or more coil springs or leaf springs, arranged to urge the or the respective latch member into or towards the gate means' closed configuration.

Alternatively, in other embodiments the pivoting of the at least one latch member may be effected or assisted by use of a suitable tool, e.g. a tool (such as a screwdriver, allen key or other tool) manually manipulated by an operator from radially outside the cages during the splicing operation.

However, in other embodiments the said at least one pivotable latch member may be pivotable such as to be moveable at least in a direction out of the said suspension gap as it pivots into its open position. In embodiments in which the anchoring portion is carried on the second reinforcement cage via a bridging member, the said at least one pivotable latch member may be pivotable such as to be moveable at least in a direction out of the said suspension gap and away from the said bridging member as it pivots into its open position. As with the embodiments mentioned previously, in the aforementioned embodiments the pivoting movement of the at least one latch member may likewise be effected or assisted or biased, at least into or towards the gate means' closed configuration, by one or more springs, e.g. coil springs or leaf springs, or other resilient urging members, or alternatively by use of a manually manipulatable tool from radially outside the cages during the splicing operation.

In some embodiment forms the gate means may comprise a single such pivotable latch member, which single latch member may be shaped and/or configured and/or positionable, optionally in combination or interaction with a relevant portion of the second reinforcement cage or other portion of the device, to respectively open or close the said suspension gap.

However, in other embodiment forms the gate means may comprise a pair of such pivotable latch members, which are each or mutually shaped and/or configured and/or mutually positionable, optionally in combination or interaction with a relevant portion of the second reinforcement cage or other portion of the device, to respectively open or close the said suspension gap. In some such embodiments comprising a pair of latch members, the latch members may comprise a pair of symmetrically arranged and symmetrically pivotable latch members, especially pivotable in mutually opposite rotational pivoting directions and each being mounted on its own respective rotational pivot mounting, for example comprising a respective mounting pin, rod, axle, spigot, bolt or other rotational joint which allows or provides for rotational relative movement between the respective parts. In such embodiments comprising a pair of latch members, the pair of latch members, or at least respective end portions thereof, may or may not at least partially overlap, e.g. in a circumferential or tangential or chordal or transverse, or alternatively in an axial, direction when in their mutually closed configuration.

In some embodiments of the invention the gate means may comprise at least one pivotable latch member, which latch member is pivotable between the said open and closed configurations to permit insertion of or to trap, as the case may be, the suspension band in the formed suspension gap, and a or a respective locking member, e.g. a or a respective locking escutcheon, constructed and arranged for engaging and thereby locking or securing the or the respective latch member in its closed configuration, or alternatively in its open configuration. Optionally the or the respective locking member, e.g. the or the respective locking escutcheon, may be constructed and arranged for engaging and thereby locking or securing the or the respective latch member selectively in either of both of its closed and open configurations. The or each respective locking member, e.g. locking escutcheon, may for example be in the form of a plate, strip, rod or other elongate, optionally substantially flat, body of metal, e.g. steel, such as formed from scrap steel or other metal.

The or the respective locking member, e.g. locking escutcheon, may preferably be constructed and arranged to permit the or the respective latch member to be pivoted into its open configuration without hindrance from the or the respective locking member. Thus the locking member, e.g. locking escutcheon, may be constructed and arranged to act as a catch or detent to engage and thereby maintain the or the respective latch member at least in its closed configuration only once the latch member has been configured therein. For the aforementioned purposes the locking member, e.g. locking escutcheon, may itself be pivotally mounted on or in the device, such as by means of its own respective rotational pivot mounting, e.g. via a mounting pin, rod, axle, spigot, bolt or other rotational joint which allows or provides for rotational relative movement between the respective parts.

If desired or necessary the pivot mounting of the or the respective locking member, e.g. locking escutcheon, may be augmented by it being further provided with a resilient urging member, e.g. at least one coil or leaf spring, arranged to bias the or the respective locking member in or towards its locking pivotal position in which it can engage the or the respective latch member to lock it in its closed configuration.

It is a particularly preferable feature of many embodiments of the invention that the splicing device may be constructed and configured such that the configuring of the anchoring portion and the operation or actuation of the gate means may be effected preferably substantially only from outside, i.e. radially eternally of, the reinforcement cages. In some embodiments the constructional arrangement may be such that this, or at least the actuation of the gate means, may be effected substantially automatically by the action of bringing the first and second reinforcement cages together into their splicing relationship and the suspension band (on the first cage) being inserted through and/or past the gate means into the suspension gap (defined by the device on the second cage), with no need for any manual manipulation of any of the moveable component parts by an operator. In other embodiments the constructional arrangement may be such that this, or at least the actuation of the gate means, may be effected by some degree of manual intervention or manipulation of one or more moveable component parts by an operator (e.g. by hand or by use of a tool), but even in this case this may be achieved without the operator having to, or being tempted to, place their arms or hands inside the periphery of the cages during the splicing operation, as is generally prohibited nowadays by health and safety criteria.

Although in many embodiments of the invention the portion of the second reinforcement cage which carries the anchoring portion of the device may be a cage bar, or a portion of a cage bar, of the second reinforcement cage, in certain alternative embodiments, the splicing device may instead be attached to the second reinforcement cage via at least one attachment band. Such an attachment band may furthermore provide respective anchoring sites for other ones of a plurality of splicing devices, especially a plurality of splicing devices which are angularly spaced apart around the second cage, which may also be provided in the overall arrangement for splicing the first and second reinforcement cages together.

In such embodiments the attachment band may be similar in form and construction to the suspension band on the first reinforcement cage, and may be attached, e.g. by welding, to one or more of the cage bars of the second reinforcement cage, and the one or more splicing devices may be attached (again e.g. by welding) to the attachment band, rather than being attached directly to one or more cage bars of the second reinforcement cage itself.

Such arrangements using an attachment band to attach the one or more, especially a plurality of, splicing devices to the second reinforcement cage may lend themselves particularly favourably to the use of a modular attachment band, wherein the attachment band may comprise a plurality of segments or sections, e.g. arcuate segments, each of which may carry an attached splicing device according to any embodiment of the invention. Each such module of the complete attachment band may for example advantageously be assembled off-site in a dedicated pre-manufacturing stage on a bench-scale set-up, e.g. using an accurate jig, and this may allow a greater degree of accuracy to be achieved in the placement of the splicing devices at the correct locations—especially at correct longitudinal positions relative to the second reinforcement cage axis—so that all the splicing devices end up being attached in as accurate longitudinal positions as possible on the second reinforcement cage bars. This may provide for optimum, stable and secure engagement of the suspension band on the first reinforcement cage with the closed gate means of the respective splicing devices once the two reinforcement cages have been securely spliced together and are ready for lifting.

As already mentioned, in the practising of many embodiments of the invention, any number of individual splicing devices may be used to splice together the first and second reinforcement cages, as desired or as necessary. In many practical embodiments of the invention, the first and second reinforcement cages may be spliced using a plurality of devices, each device being a device, preferably a like device, as any embodiment device defined hereinabove or described hereinbelow. Such a plurality of splicing devices may be arranged substantially equi-angularly or equi-spaced around the periphery of the reinforcement cages. In practice the number of splicing devices used may for example depend on the size, scale or weight of the reinforcement cages to be spliced. Frequently, and for example in the case of splicing e.g. a pair of 0.5 tonne pile cages, three splicing devices each disposed at 120° to each other around the pile cage assembly may typically be suitable.

Whilst in many practical embodiments of the invention the reinforcement cages to be spliced by the device may be substantially circular in cross-section, in order to form generally cylindrical shaped piles, it is to be understood that the invention may not be limited to reinforcement cages of circular cross-section, but other cross-sectional shapes may also be possible. For example, reinforcement cages of the pile- or diaphragm wall-types which may be spliced by use of embodiments of the invention may have cross-sections which are non-circular, e.g. elliptical, rectangular, square, L-shaped, T-shaped, or even of other shapes. By use of such alternative shaped cages, correspondingly alternatively shaped piles, diaphragm walls or other concrete structures may thus be formed. Of course, in the process of drilling the initial hole for insertion therein of the spliced reinforcement cages (optionally in combination with an appropriate shoring device or material), an appropriately shaped drill or form of drilling rig and/or excavation equipment or arrangement may need to be employed in order to form the correctly shaped hole or void for receiving the correspondingly shaped reinforcement cages therein.

In the case of such embodiments involving the use of non-circular, e.g. rectangular or even other shaped, pile- or diaphragm wall-, or other reinforcement-, cages, where a "radius" is not strictly definable, it is to be understood that as used herein the term "radial" as applied to the suspension gap between the anchoring portion of the device and the second reinforcement cage, or as applied to that general direction which is perpendicular to the direction of relative movement of adjacent reinforcement cages as they are brought together during splicing, and any like or corresponding term used in a corresponding context, is to be construed as meaning "transverse", "perpendicular", normal or "directed towards the centre" relative to the outer peripheral boundary, wall or face of the alternatively-shaped cage in question. Likewise, in the same context any reference to a "circumferential" or "tangential" or "chordal" direction should therefore be construed accordingly as meaning "lateral", i.e. generally substantially parallel to that outer peripheral boundary, wall or face of the cage in question.

Accordingly, in some embodiments of the present invention in any of its aspects each of the above-defined first and second reinforcement cages may be independently selected from a pile cage or a diaphragm wall cage.

Within the scope of this application it is expressly intended that the various aspects, embodiments, examples and alternatives set out in the preceding paragraphs, in the claims and/or in the following description and drawings, and in particular the individual features thereof, may be taken independently or in any combination. Thus, any one or more features referred to or described with reference to one particular embodiment should be construed as being applicable to any or all embodiments, unless expressly stated otherwise or such features are incompatible.

BRIEF DESCRIPTION OF THE DRAWINGS

Various embodiments of the present invention in its various aspects will now be described in detail, by way of example only, with reference to the accompanying drawings, in which:

FIG. 1(*b*) is a schematic front elevational view of an alternative constructional form of lower pile cage 10' (only) to the one shown in FIG. 1(*a*), which may likewise be used in conjunction with any upper pile cage 20 provided with any suitable number of splicing devices according to any embodiments of the invention;

FIG. 2(*b*) is a side view of the same embodiment of splicing device as FIG. 1(*a*), but showing the combined anchoring portion and gate means in their open configuration, prior to the suspension band being trapped in the suspension gap;

FIG. 3(*b*) is a radial front view of the splicing device arrangement shown in FIG. 3(*a*);

FIG. 4(*b*) is a radial front view of the splicing device arrangement shown in FIG. 4(*a*);

FIG. 5(*b*) is a radial front view of the splicing device arrangement shown in FIG. 5(*a*);

FIG. 8(*b*) is a side view of an alternative version of the splicing device of FIG. 8(*a*), shown in position splicing together the pile cages, this alternative version being according to yet another embodiment of the invention;

FIG. 9(*b*) is a radial rear view (from radially internally of the cages looking outwards) of the splicing device arrangement shown in FIG. 9(*a*);

FIG. 10(*b*) is a radial front view of a modified form of seating flanged shoulder element for use in the splicing device arrangement shown in FIG. 10(*a*);

FIG. 10(*c*) is a perspective view of a modified version of the splicing device of the embodiment arrangement shown in FIG. 10(*a*);

FIG. 11(*b*) is a perspective view of an alternative version of the splicing device of FIG. 11(*a*), shown in position splicing together the pile cages, this alternative version being according to yet another embodiment of the invention;

FIG. 19(*b*) is a top plan view of the latch member alone of the splicing device arrangement shown in FIG. 19(*a*);

FIG. 19(*c*) is a top plan view of an alternative form of latch member for use in the splicing device arrangement shown in FIG. 19(*a*);

FIG. 19(*d*) is a top plan view of another alternative form of latch member for use in the splicing device arrangement shown in FIG. 19(*a*);

FIG. 19(*e*) is a top plan view of yet another alternative form of latch member for use in the splicing device arrangement shown in FIG. 19(*a*);

FIG. 20(*b*) is a side view of a modified form of splicing device according to yet another embodiment of the invention, this one being similar in principle to that of FIG. 20(*a*) but with a modified form of latching gate arrangement;

FIG. 20(*c*) is a side view of another modified form of splicing device according to yet another embodiment of the invention, this one again being similar in principle to that of FIG. 20(*a*) but with another modified form of latching gate arrangement;

FIG. 25(*b*) is a side view of a modified form of the arrangement shown in FIG. 25(*a*), showing a modified form of the dual contra-pivotable latch members;

DETAILED DESCRIPTION OF EMBODIMENTS

Figure 1A:
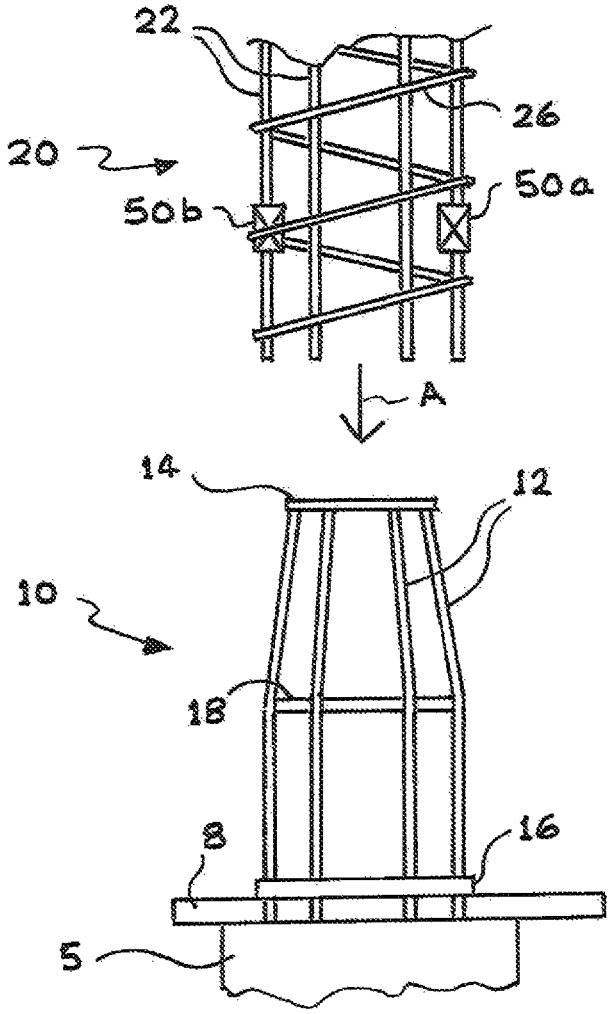
FIG. 1(*a*) is a schematic front elevational view of a pair of pile cages about to be spliced using a device according to any of various embodiments of the invention.
Figure 1B:
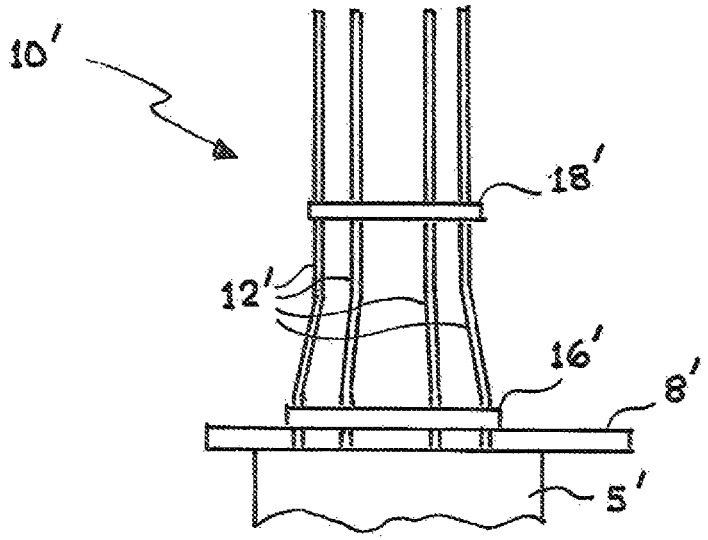

Referring firstly to FIG. 1(*a*), here there is shown schematically a pair of pile cages—namely lower pile cage 10 and upper pile cage 20—ready for bringing together for splicing in an overlapping end-to-end relationship, as depicted by arrow A. Each pile cage comprises a respective array of e.g. six generally axially arranged elongate steel pile cage bars or rods 12, 22 (although only four are explicitly shown for clarity) of a conventional type, and the cage bars of each group are united into the respective cage 10, 20 by means of a framework comprising a helical steel wire 26 wound therearound and welded thereto (but again only the helical wire frame 26 of the upper cage 20 is explicitly shown for clarity in FIG. 1(*a*)).

In an alternative form of basic construction of each cage 10, 20, instead of a helical wire 26 to unite the respective cage bars 12, 22 of each cage, a series of metal rings or bands, e.g. a plurality of circumferential, especially circular, rings or bands, preferably spaced apart in the longitudinal axial direction of the respective cage, may be employed instead.

By way of example, the upper end portion of the lower pile cage 10 is shown as tapered radially inwardly (or "cranked"), and is optionally fitted at its uppermost terminal end with a terminal end band 14 welded to the cage bars 12 (and which may lie internally or externally of the cage bars 12) in order to stabilise the free end portions of the bars 12.

The lower pile cage 10 is shown in FIG. 1(*a*) in a typical condition during a pile construction operation, in which the majority of the length of the lower pile cage 10 has already been lowered into a pile casing 5 located within a pre-drilled hole in the ground, leaving just an upper end section of the lower cage 10 exposed and ready for splicing to a second, upper pile cage 20 as shown. The lower pile cage 10 is suspended in the casing 5 by means of a steel trapping band 16 welded onto the cage bars 12 (and which may lie externally or internally of the cage bars 12) at the lower end of the exposed upper end section of the lower cage 10. This trapping band 16 is used to trap beneath it, i.e. between it and the upper (open) end of the casing 5, an elongate trapping bar or rod 8, which thereby prevents the lower pile cage 10 from dropping down further into the casing 5 and thus effectively suspends it at a desired height location ready for splicing to the upper cage 20. Once the cages 10, 20 have been spliced together, they can then be lowered together down inside the casing 5 which lines the pile hole and wet concrete poured therein to form the pile. Prior to curing of the concrete, the casing 5 is removed for re-use in the forming of another pile.

The lower pile cage 10 is fitted midway up its upper end section with a further welded steel band, this one being suspension band 18, which may likewise be arranged to sit internally or externally of the cage bars 12. It is this suspension band 18 which is to be used as part of the means by which the lower pile cage 10 is spliced to the upper pile cage 20, the other part of the means being the novel splicing devices 50*a*, 50*b*. Each such splicing device 50*a*, 50*b* may be a splicing device according to any of various embodiments of the invention, as will be described further below by way of examples with reference to the subsequent Figures of the drawings.

Any number of splicing devices 50*a*, 50*b* etc, from 1 up to several, e.g. 3, 4, 5, 6 or possibly more than 6, may be provided in the arrangement of FIG. 1, and they are preferably spaced apart circumferentially and equi-angularly around the pile cage assembly. By way of example, however, only two such splicing devices 50*a*, 50*b* are shown in FIG. 1 for clarity, but typically at least three such splicing devices may be used, e.g. spaced at 120° relative to each other around the periphery of the assembly. In some cases more than three like splicing devices may be utilised, if that is desired or necessary, for example depending on the dimensions and/or weight of the lower pile cage 10 to be spliced to and carried by the upper pile cage 20.

The or each splicing device 50 that is used in the arrangement of FIG. 1 to splice together the two pile cages 10, 20 may be of a wide variety of constructions and arrangements, various examples of which are described further below and illustrated in FIGS. 2 to 27 of the accompanying drawings. Such example arrangements represent various embodiments of the present invention, which is characterised by the uniting feature that the gate means, which selectively opens or closes the radial suspension gap to either permit the suspension band to be inserted (or received) therein or to be trapped therein, involves a pivoting mechanism.

As an alternative to the constructional form of lower pile cage 10 as depicted in FIG. 1(*a*), there may instead be used—as is currently more typical in the industry—the alternative constructional form of lower pile cage 10' as shown (alone) in FIG. 1(*b*) (where corresponding features are shown with the same reference numerals but suffixed with "'"). The basic construction and operation of this alternative form of lower pile cage 10' is much the same as the form of lower pile cage 10 of FIG. 1(*a*), expect that now the cage bars 12' are cranked radially inwardly further down the cage towards its lower end, the upper ends of the various cage bars 12' are left substantially unattached to each other (which is generally sufficient given their uniting only a short distance further down by the suspension band 18'), and the upper terminal end band 14 (as in the version of FIG. 1(*a*)) is dispensed with.

In the various FIGS. 2 to 27 many of the illustrated features of these various embodiments correspond to or are structurally and/or functionally analogous to one other as they apply to each respective embodiment. Therefore, in moving from one embodiment to the next in successive Figures, corresponding reference numerals are used for such features where possible and appropriate but incremented by "100" each time in moving from one main Figure or embodiment to the next.

Figure 2A:
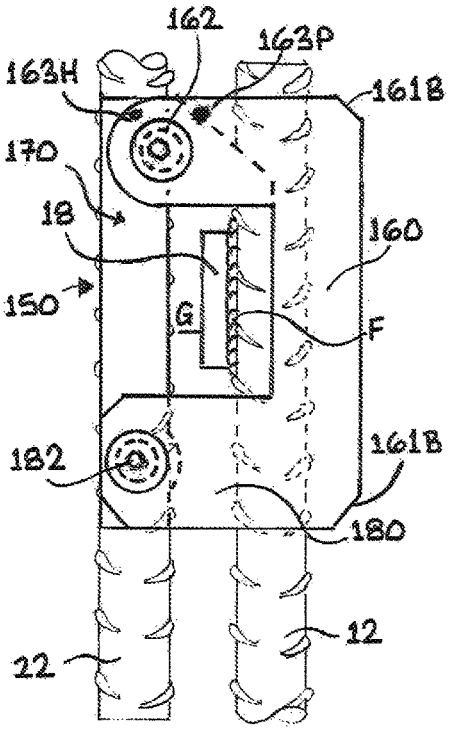
FIG. 2(*a*) is a side view of a splicing device according to one embodiment of the invention, shown in position splicing together the pile cages shown in FIG. 1(*a*)
Figure 2B:
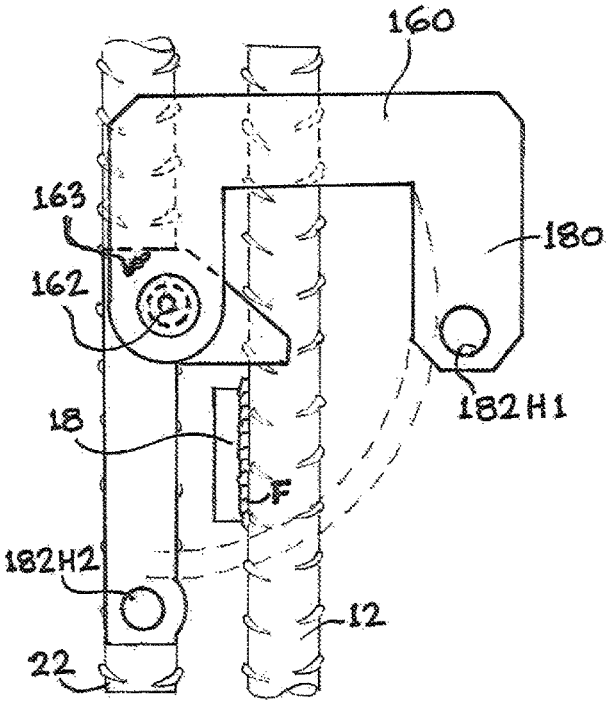

Referring firstly to the embodiment shown in FIGS. 2(*a*) and 2(*b*), here the splicing device, shown generally as 150, is mounted on a cage bar 22 of the second, upper pile cage 20 and comprises a unitary anchoring portion 160 and gate member 180, which in this embodiment are formed as a unitary plate or strip of material, e.g. weldable steel, such as by laser or high pressure water-jet cutting from a single sheet or strip of the material. The anchoring portion 160 is mounted at its upper end on the cage bar 22 via a bridging plate or strip 170 (shown hatched) welded to the cage bar 22, on which bridging plate 170 the anchoring portion 160 is rotationally pivotally mounted via mounting bolt or pin arrangement 162. In the "closed" pivotal position shown in FIG. 2(*a*), the anchoring portion 160 defines a suspension gap G between it and the cage bar 22 on which it is carried, and the gate member 180, angled at 90° to the anchoring portion 160, provides the means for closing the suspension gap G as the unitary anchoring portion 160 and gate member 180 are together pivotally rotated through 90° from the "open" configuration shown in FIG. 2(*b*) to the "closed" configuration shown in FIG. 2(*a*). The suspension gap G thus formed is of a radial width at least sufficient to comfortably accommodate therewithin the radial thickness of the suspension band 30 on the lower pile cage 10.

Thus, once in the open position shown in FIG. 2(*b*), the gate member 180, with the integrally attached anchoring portion 160, are together pivotable up and out of the way so as to leave the space corresponding to the suspension gap G (still to be defined as such in this embodiment) clear and open to allow the suspension band 18 on the first, lower pile cage 10 to be received in or inserted into the suspension gap G (once formed) as the two pile cages 10, 20 are brought mutually together into their splicing relationship with their respective end sections overlapping. In practice this is achieved by lowering the upper pile cage 20, typically by use of a crane, as indicated by arrow "A", to approach the lower pile cage 10 anchored in its pile hole casing 5, until it reaches the required location with the suspension band 18 received in the space to be defined as the said suspension gap G. The suspension band 18 itself is attached to a cage bar 12 of the lower pile cage such as by welding via a fillet weld F (which fillet-type welds are labelled as such as "F" wherever they occur in all embodiments throughout all Figures of the drawings).

Once the gate member 180, together with the integrally attached anchoring portion 160, has been pivoted down into the closed position shown in FIG. 2(*a*), with the suspension band 18 having been received in or inserted into the thus-formed suspension gap G, at the same time the gap G is closed by the gate member 180, thereby trapping the suspension band 18 in the gap G and preventing it being withdrawn therefrom (in the downward direction as illustrated) via the gate arrangement. Moreover, the suspension band 18 is also prevented from being withdrawn from the suspension gap G in the opposite (upward as illustrated) direction by virtue of the anchoring portion 160 which bounds the suspension gap G at its upper limiting region.

In order to selectively maintain the combined anchoring portion 160 and gate member 180 in their open (upward as illustrated) pivotal position as shown in FIG. 2(*b*), a locking grub screw arrangement is provided, comprising a grub screw or pin 163P provided in the anchoring portion 160 adjacent an upper edge thereof and a corresponding receiving hole or recess 163H provided in the bridging plate 170 adjacent a radially outer edge thereof (or such locking grub screw components may be reversed in the components of the device in which they are provided). Thus, prior to the upper pile cage 20, with its splicing device 150 attached, being presented to the lower pile cage 10 for splicing, the combined anchoring portion 160 and gate member 180 are pivoted into their open configuration as shown in FIG. 2(*b*) and the grub screw arrangement actuated to temporarily lock the arrangement in this open configuration, in which configuration it remains while the two pile cages 10, 20 are brought together and the suspension band received/inserted in the space which is to become the defined suspension gap G. Once in this position, the grub screw arrangement is de-actuated or released, e.g. by unscrewing or releasing grub screw or pin 163P from its cooperating hole or recess 163H in the bridging plate 170, thereby allowing the combined anchoring portion 160 and gate member 180 to pivot back down about rotational mounting joint 162, preferably under gravity due to its own weight, so as to assume the closed configuration shown in FIG. 2(*a*). In this configuration therefore the suspension band 18 is now trapped in the thus-defined/formed suspension gap G and prevented from being withdrawn therefrom, thus allowing the two pile cages 10, 20 to be lifted together with the suspension band 18 abuttingly bearing against an upper edge or side of the closed gate member 180.

In order to maintain the closed gate member 180 in this closed configuration as shown in FIG. 2(*a*), a locking bolt or pin arrangement 182 is provided on a lower foot or downward extension of the bridging plate 170 (which is welded to the cage bar 22). By way of example, the terminal radially outer end of the gate member 180 is formed with a through-hole 182H1 which cooperates with a corresponding screw-threaded-apertured locking flange 182H2 attached (again e.g. by welding) to the lower foot or downward extension of the bridging plate 170 (or instead e.g. a corresponding nut welded thereto) for receiving a respective locking bolt, screw or pin (not shown). Such a locking bolt or pin arrangement 182 is thus readily accessible from radially outside the pile cages 10, 20, even when in their spliced condition, as is also the grub screw arrangement 163P, 163H, therefore removing the dangers associated with operators needing or being tempted to insert their hands or arms radially inside the spliced cages 10, 20 during one or more stages in the overall splicing procedure.

In order to enhance the utility of this embodiment splicing device 150, the upper, and optionally also (or alternatively) lower radially inner corners 161B of the anchoring portion 160 may be bevelled or chamfered, in order to ease the insertion into the interior of the spliced cages of a tremmie (wet concrete pouring tube) during the pouring step of the pile-forming process, and/or to reduce the propensity for fouling thereagainst of neighbouring cage bars of the lower pile cage 10 as the two cages 10, 20 are brought together.

Once the lower and upper pile cages 10, 20 have been spliced together by actuation of the gate arrangement to trap the suspension band 18 in the suspension gap G, they may now be lifted or lowered together—accurately, stably and safely—either for further movement around the site or, more typically, for lowering into the pile hole casing 5 ready for splicing yet another pile cage to the upper end of the upper pile cage 20 (which itself then becomes a new "lower" pile cage in the new splicing arrangement) in a corresponding like manner.

It is to be understood that in this embodiment, as in common with several other embodiments of the invention disclosed herein, the fact that the gate member or gate arrangement is supported and/or anchored, when in its closed configuration, generally at both its radial ends, means that the main downward axial loading forces arising from the weight of the lower pile cage as the spliced cages are lifted together are experienced by an intermediate portion of the gate member/arrangement, i.e. a portion thereof intermediate its ends. Since by this arrangement any such downward loading force on the gate member/arrangement is resisted at both its axial ends—which is in contradistinction to the prior art cantilevered device proposed in EP1963579A (referred to above) for example, where a suspension bolt is anchored and supported cantilever-fashion at only one of its ends—any tendency of the gate member or arrangement itself to flex or deform (especially asymmetrically so at one end only thereof) may be hindered or minimised, thereby leading to a more reliable and mechanically more stable and safer suspension mechanism for carrying the weight of the lower pile cage using the abutting engagement of the gate member or gate arrangement with the underside of the suspension band.

Figure 3A:
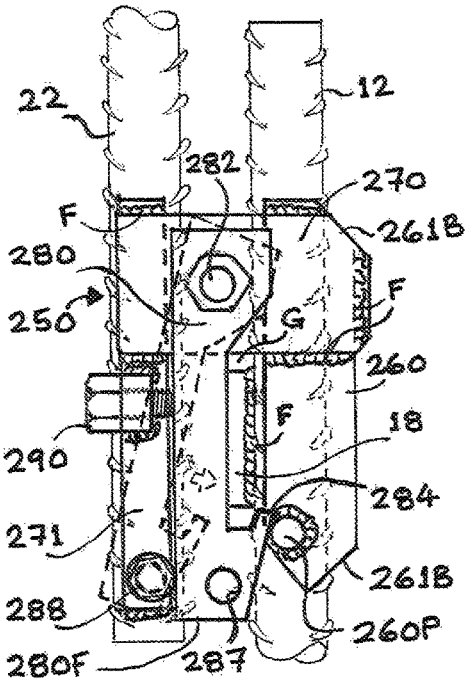
FIG. 3(*a*) is a side view of another splicing device according to another embodiment of the invention, shown in position splicing together the pile cages.
Figure 3B:
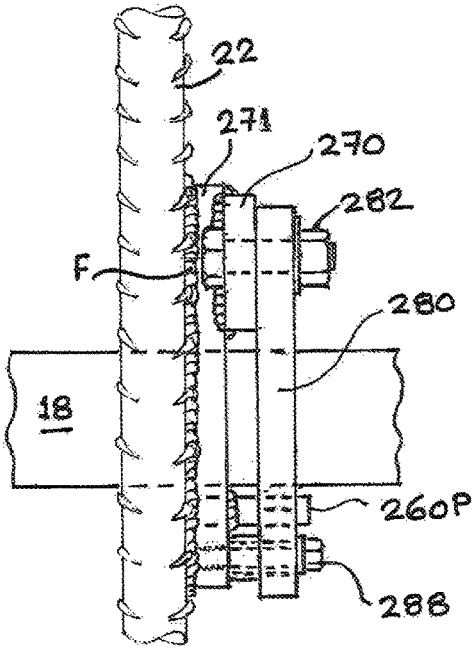

FIGS. 3(*a*) and 3(*b*) show another embodiment of the invention, in which the constructional and operational principles of the splicing device 250 shown here are similar to those in the embodiment of FIGS. 2(*a*) and (*b*). However, here the anchoring portion 260 and gate member 280 are formed and provided as two discrete components. The anchoring portion 260 takes the form of a discrete elongate anchoring plate 260 which is fixedly mounted, again by fillet welding, to a discrete upper bridging plate 270. The upper bridging plate 270 is itself fixedly mounted, again by fillet welding, to a discrete side bridging plate 271, which is welded to the cage bar 22. Thus, the side bridging plate 271, upper bridging plate 270 and the anchoring plate 260 form a fixed, rigid, three-section yoke which can then carry the remaining functional components of the device.

The gate arrangement in this embodiment comprises gate member 280 which is pivotally attached, via rotational pivot bolt mounting 282, to the upper bridging plate 270. The gate member includes an enlarged lower foot portion 280F which terminates at its remote upper end in a protruding toe or detent portion 284. In its radially inward pivotal position (as shown in solid lines in FIG. 3(*a*)) the gate member 280 assumes its closed configuration in which it defines the suspension gap G between the anchoring plate 260 and the cage bar 22, in which gap G may be inserted and trapped, as above, the suspension band 18 on the lower pile cage 10. In its trapped position the suspension band 18 is thus detained by the toe detent portion 284 on the end of the foot portion 280F of the gate member, thus securing it in a secure relatively fixed condition bound on all its four sides by the main central section of the gate member 280, upper bridging plate 270, anchoring plate 260 and the toe and/or foot portion(s) 284/280F of the gate member 280. In its radially outward pivotal position (as shown in phantom lines in FIG. 3(*a*)) the gate member 280 assumes its open configuration in which its lower foot portion does not occlude the suspension gap G and is withdrawn radially outwardly past the cage bar 22 a short distance. In this position the suspension band can thus be inserted into and received in the suspension gap G as the upper pile cage 20 is lowered onto and into splicing relationship with the lower pile cage 10.

In order to enhance the utility of this embodiment splicing device 250, a limiting stop pin 260P may be mounted on the lower end portion of the anchoring plate 260, in order to limit the radially inward pivoting movement of the gate member 280. Furthermore, in order to maintain the gate member 280 in its open (radially outward) pivotal position as shown by the phantom lines in FIG. 3(*a*), a temporary locking bolt arrangement 288 may be provided, comprising a locking bolt selectively engageable in a locking hole 287 formed in the foot portion 280F of the gate member 280. Thus, in this condition the upper pile cage 20, with the splicing device 250 attached and the gate member 280 pivoted radially outwardly into its open position and out of the way of the suspension gap G, may be presented to and lowered onto the lower pile cage 10 for splicing therewith, with the suspension band 18 being received in the suspension gap G. Upon the locking bolt 288 being removed or released, which may conveniently and safely be done from radially outside the cages, the gate member 280 can thus now pivot back down and radially inwardly about its rotational mounting joint 282 and into the closed configuration as shown by the solid lines in FIG. 3(*a*).

In order to maintain the closed gate member 280 in this closed configuration as shown by the solid lines in FIG. 3(*a*), a locking bolt or pin arrangement 290 (not shown in FIG. 3(*b*) for clarity) may be provided mounted on the side bridging plate 271, which may be selectively actuated, again conveniently and safely from radially outside the cages, to push against and so lock the gate member 280 in its closed position once the cages' splicing has been effected.

Figure 4A:
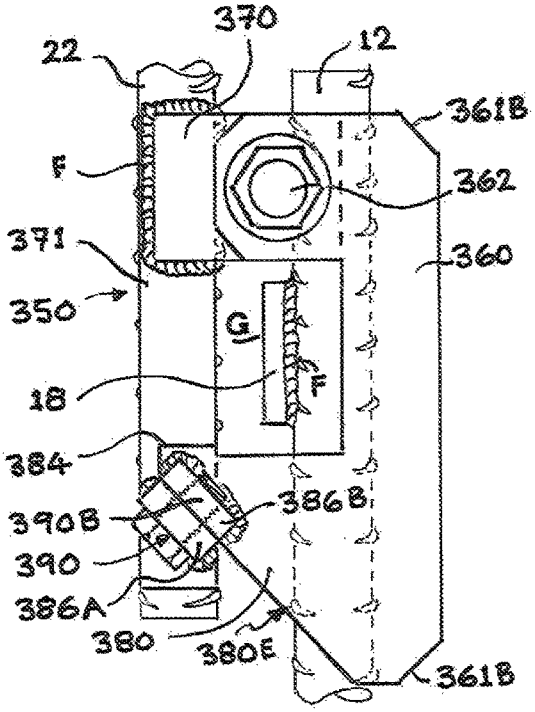
FIG. 4(*a*) is a side view of another splicing device according to another embodiment of the invention, shown in position splicing together the pile cages.
Figure 4B:
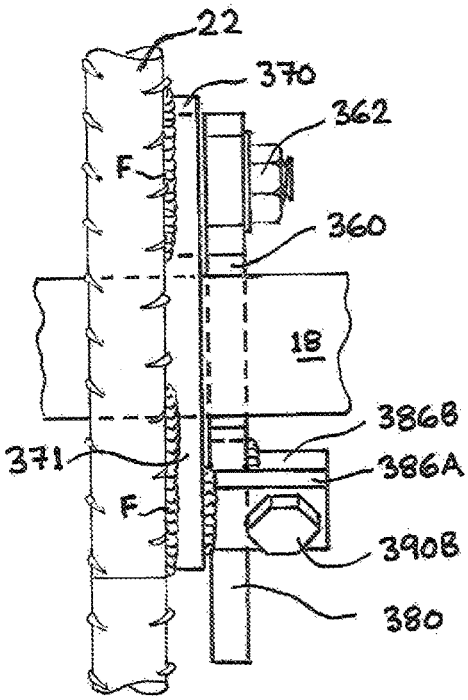

FIGS. 4(*a*) and 4(*b*) show another embodiment of the invention, in which the constructional and operational principles of the splicing device 350 shown here are much the same as those in the embodiment of FIGS. 2(*a*) and (*b*), although the shape and configuration of some of the components are slightly different.

The anchoring plate 360 and gate member 380 are again formed as a unitary component, e.g. cut from the same sheet of steel, the anchoring plate 360 being pivotally mounted at its upper end, via rotational pivot bolt or pin mounting arrangement 362, to upper bridging plate. The upper bridging plate 370 is itself welded to the cage bar 22 via side bridging pate 371.

In this embodiment, however, the pivotable gate member 380 itself is shaped as a generally triangular plate portion which presents an oblique or angled (e.g. at an angle of around 30-60°, especially around 45°) lower side or edge 380E to the suspension band 18 as it is inserted into the suspension gap G during the lowering of the upper cage 20 onto the lower cage 10. This obliquely oriented lower side or edge 380E of the gate member 380 therefore abuttingly engages the suspension band 18 as it passes up into the suspension gap G, thereby pushing the gate member 380 and integral anchoring plate 360 pivotally to one side—radially inwardly in the arrangement as illustrated—as the suspension band 18 enters the suspension gap G. Once it has reached that location, the natural weight of the gate member 380 and integral anchoring plate 360 causes it then to pivot back down, about pivot mounting 362, into the closed configuration as shown in FIG. 4(*a*). Thus, this pivoting motion of the combined gate member 380 and integral anchoring plate 360 unitary component can be effected automatically by the inherent action of lowering the upper pile cage 20 on the lower pile cage 10, without any necessity for manual intervention.

Also in this embodiment, in order to maintain the closed gate member 380 (and integral anchoring plate 360) in its closed configuration as shown in FIG. 4(*a*), once it has pivotally dropped down into this position with the suspension band 18 trapped in the suspension gap G, the locking bolt arrangement 390 now comprises a locking bolt 390B which is insertable through an aperture in a locking flange or plate 386A welded onto the lower end of the side bridging plate 371 and lockable in e.g. an internally screw-threaded locking aperture in a locking extension flange or plate 386B which is welded onto the terminal locking nose portion 384 of the gate member 380. The locking flanges or plates 386A, 386B are themselves angled e.g. at around 45° as shown with respect to the longitudinal axis of the cages, in order to provide a stable and secure abutment seating and locking site for the locking nose portion 384 of the gate member 380.

Figure 5A:
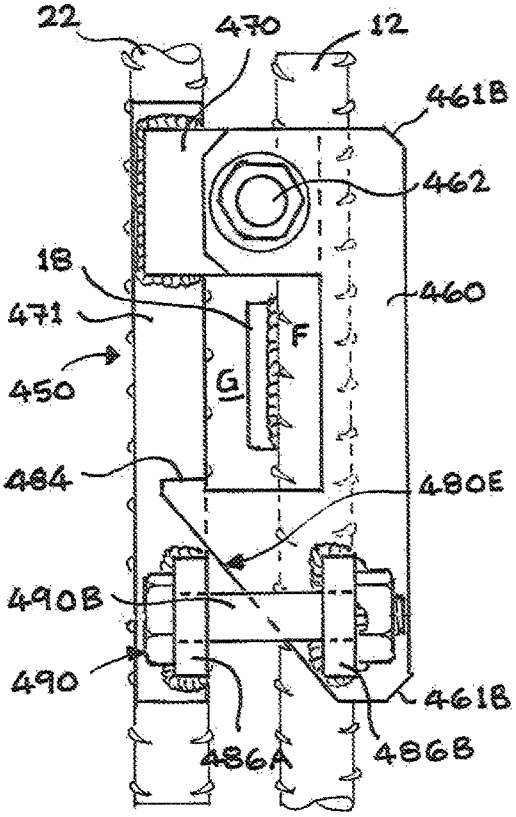
FIG. 5(*a*) is a side view of another splicing device according to another embodiment of the invention, shown in position splicing together the pile cages.
Figure 5B:
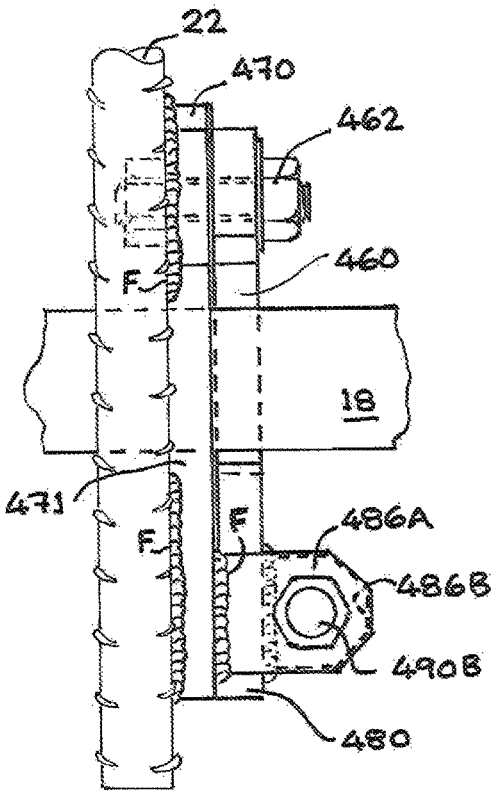

FIGS. 5(*a*) and 5(*b*) show a modified version of the embodiment of FIGS. 4(*a*) and 4(*b*). Here the locking bolt arrangement 490, by which the integral gate member 480 and anchoring plate 460 are locked in their locked pivotal position as shown in FIG. 5(*a*), is arranged slightly differently. In this embodiment the locking flange or plate 486A (welded onto the lower end of the side bridging plate 471) and the locking extension flange or plate 4868 (welded onto the gate member 480) are now spaced apart from one another in the radial direction, and a longer locking bolt 490B is employed instead. Thus, the locking extension flange or plate 486B is now welded further along the gate member 480 in the direction of its main central portion (i.e. no longer on the nose portion 474 thereof). Moreover, the locking flanges or plates 486A, 486B may themselves now not be obliquely angled with respect to the longitudinal axis of the cages, i.e. they may be approximately parallel thereto, since in this arrangement they may still provide, in combination with locking bolt 490B, a stable and secure locking arrangement, given that in this case the obliquely oriented lower side or edge 480E of the gate member 480 may abuttingly engage the edge of the locking flange or plate 486A (welded onto the lower end of the side bridging plate 471) as the integral gate member 480 and anchoring plate 460 are pivoted down into their closed position.

Figure 6:
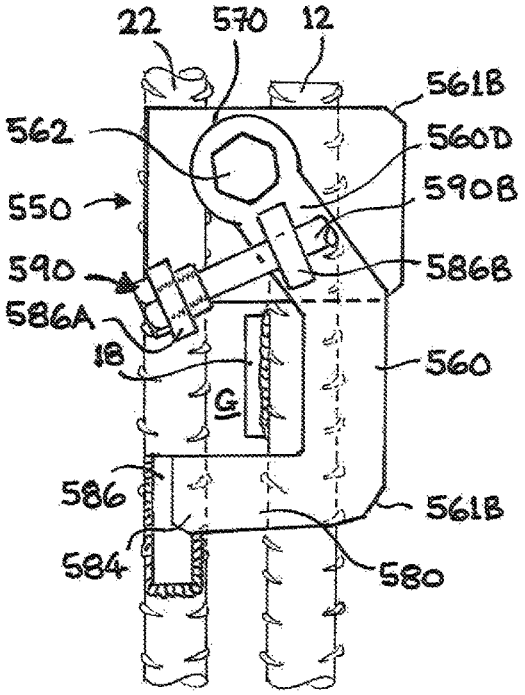
FIG. 6 is a side view of yet another splicing device according to another embodiment of the invention, shown in position splicing together the pile cages.

FIG. 6 shows another modified version of the embodiment of FIGS. 4(*a*) and 4(*b*). Here the combined integral anchoring plate 560 (which in this example is angled around midway along its length) and gate member 580 are again pivotally mounted on the (this time merely a single) upper bridging plate 570, but additionally now the pivoting movement of the integral gate member 580 and anchoring plate 560 is restricted and/or controlled by a locking bolt arrangement 590 placed further up the device adjacent the rotational pivot mounting 562. Here the locking bolt arrangement comprises locking bolt 590B which is seated and freely rotatable in an aperture in a first, radially outer locking flange or plate 586A welded to the bridging plate 570, and extends generally radially inwardly towards a second, radially inner locking flange or plate 586B welded to the anchoring plate 560, this second, radially inner locking flange or plate 586 being internally screw threaded so as to be able to receive the threaded shaft of the bolt 590A therein. The portion of the anchoring plate 560 to which the second, radially inner locking flange or plate 586B is welded is, in this illustrated embodiment, the obliquely oriented angled upper section 560D thereof, via which the main anchoring portion 560 is itself pivotally mounted on the bridging plate 570 via the rotational pivot mounting 562.

Thus, as the locking bolt 590B is rotated, e.g. manually or by use of a tool conveniently and safely from radially outside the cages, the locking flange 586B moves along the threaded shaft of the bolt 590B, taking and moving with it the combined anchoring plate 560 and integral gate member 580, which thereby are forced to move to respectively close or open the suspension gap G depending on which rotational direction in which the bolt 590A is turned.

In order to take account of the small degree of displacement of the rotational axis of the locking bolt 590B as the integral gate member 580 and anchoring plate 560 pivot about their rotational pivot mounting 562, either or both of the locking flanges or plates 586A, 586B may itself/themselves be pivotable on its/their own respective pivot mounting(s) on the respective bridging plate 570 or anchoring plate 560.

Because the locking bolt mechanism 590 which now effectively controls the pivoting movement of the integral anchoring plate 560 and gate member 580, including locking them in their pivotally downward, closed position, is now moved further up the arrangement, it is not now necessary to provide such a locking mechanism at the foot end portion 584 of the gate member 580. Instead, the terminal foot portion 584 of the gate member 580 may simply abut a correspondingly shaped seating flange or detent 686 which is welded to the cage bar 22.

Figure 7:
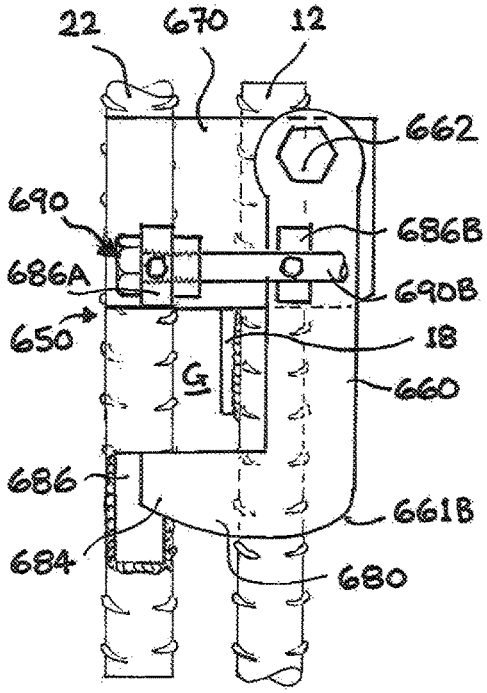
FIG. 7 is a side view of yet another splicing device according to another embodiment of the invention, shown in position splicing together the pile cages.

FIG. 7 shows a very similar embodiment to that of FIG. 6, except that here the main portion of the anchoring plate 660 is not obliquely angled around midway therealong. Thus, the locking bolt arrangement 690, which effectively controls the pivoting movement of the integral anchoring plate 660 and gate member 680, including locking them in their pivotally downward, closed position, can be oriented generally radially, instead of obliquely angled relative thereto as in the embodiment of FIG. 6. Otherwise the two embodiments function in the same way.

Figure 8A:
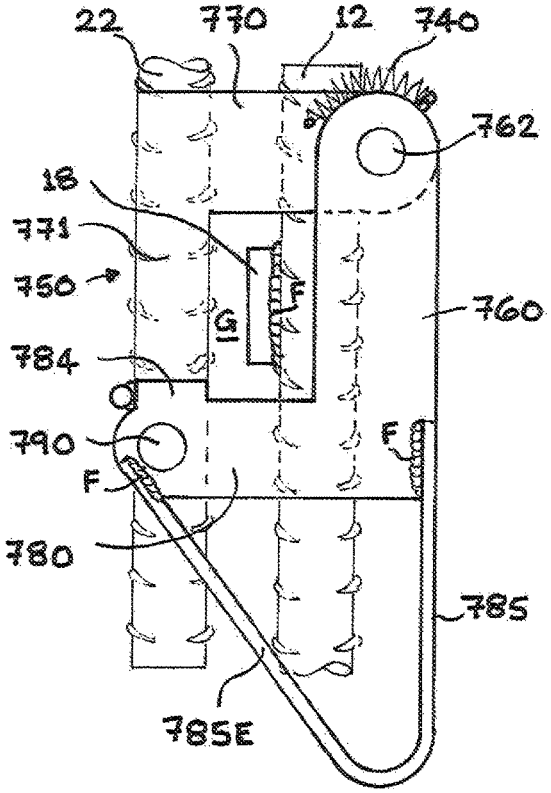
FIG. 8(*a*) is a side view of yet another splicing device according to another embodiment of the invention, shown in position splicing together the pile cages.
Figure 8B:
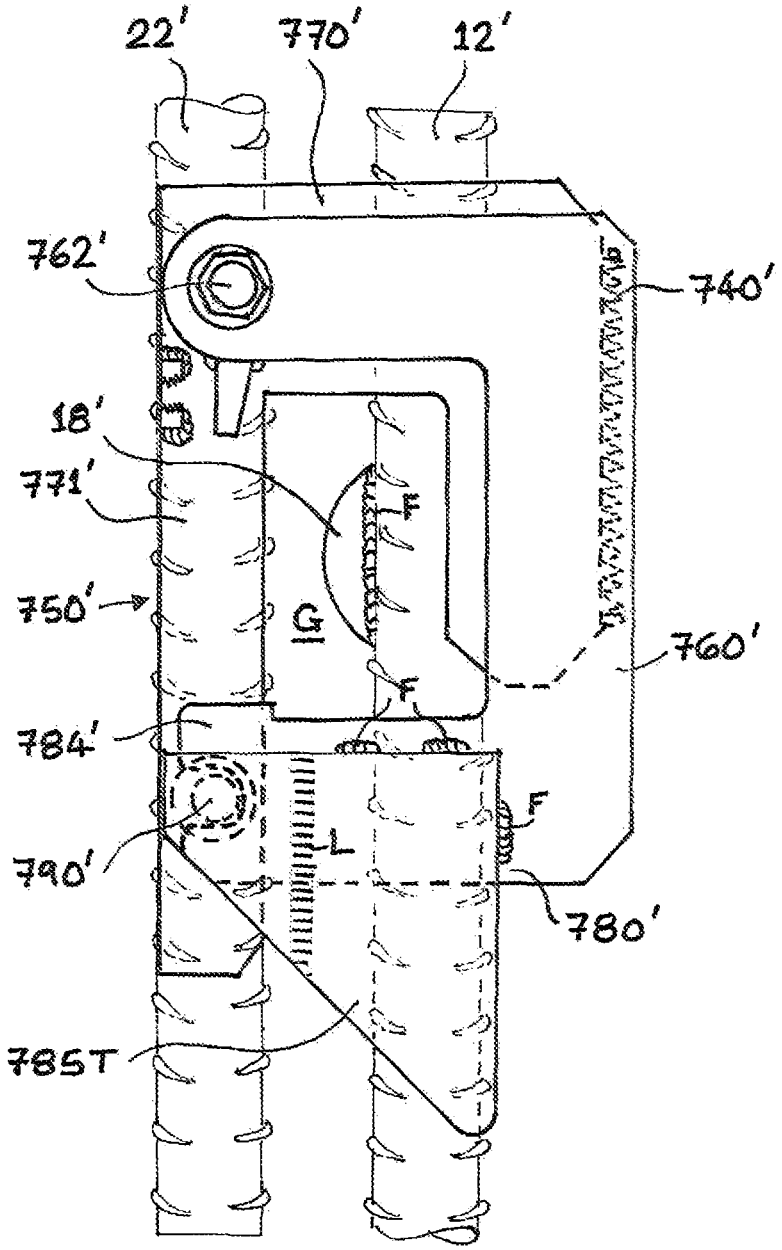

FIG. 8(*a*) shows another embodiment of the invention, in which many of the constructional and operational principles of the splicing device 750 shown here are similar to the embodiment of FIGS. 4(*a*) and 4(*b*). Here, however, instead of an enlarged triangular lower integral portion of the gate member 780 providing the oblique or angled lower side or edge to abut and deflect the suspension band 18 as it is inserted into the suspension gap G during the lowering of the upper cage 20 onto the lower cage 10, a simpler arrangement may be used for the same purpose. Here, therefore, a length of stiff metal wire 785, e.g. of steel, is welded to the lower extremities of the gate member 780, and shaped in a similar manner to the oblique or angled lower side or edge 380E (in the embodiment of FIG. 4), so as to present a similar obliquely angled deflecting section 785E of the wire to the incoming suspension band 18. This arrangement therefore uses somewhat less steel material than the embodiment of FIG. 4. As before, a locking bolt arrangement 790 may be provide for locking the gate member 780 in its pivotally closed position.

This embodiment of FIG. 8(*a*) also demonstrates the use of another useful feature of various embodiments of the invention, which is the presence of a coil (or other) spring 740 in conjunction with the rotational mounting 762 in order to bias the combined anchoring plate 760 and gate member 780 into their pivotally closed position, as shown in FIG. 8(*a*). Thus, in this manner it may be possible to do away altogether with a discrete locking bolt (or other locking) mechanism to lock the combined anchoring plate 760 and gate member 780 in their closed position, this function being replaced by the biasing of the spring 740, optionally also in combination with the weight against the gate member 780 of the suspension band 18 (and thus the lower pile cage 10 carried by it) during the lifting operation of the spliced cages.

As an alternative to the constructional form of splicing device as shown in FIG. 8(*a*), there may instead be employed the alternative version of device 750' as shown in FIG. 8(*b*) (where corresponding features are shown with the same reference numerals but suffixed with "'"). The general construction and operation of this alternative form of splicing device 750' is very similar to that of the splicing device 750 of FIG. 8(*a*), except that now the rotational mounting 762' about which the gate member 780' pivots has been moved as far to the left-hand side of the arrangement (as illustrated) as possible and instead of the obliquely angled deflecting section of stiff wire 785E (FIG. 8(*a*)) there is provided a triangular shield member 785T welded onto the lower portion of the gate member 780'.

In the arrangement shown in FIG. 8(*b*), the side bridging plate 771' is welded to the cage bar 22' of the upper cage and itself carries the rotational pivot mounting (e.g. bolt) 762' for the combined (e.g. unitary) anchoring plate 760' and gate member 780'. As the suspension band 18' on the lower cage engages the lower obliquely inclined edge of the triangular shield member 785T (welded onto the lower portion of the gate member 780') as the two cages are brought together, the (combined, unitary) gate member 780' and anchoring plate 760' are pivoted about the mounting 762' so as to temporarily open the suspension gap G to allow the suspension band 18' to enter it and into the final trapped position as shown in FIG. 8(*b*). As it is shown here, the suspension band 18' may, in order to facilitate this movement of the combined gate member 780' and anchoring plate 760', have an alternative, arcuate or convex outer shape, in order to facilitate its sliding along and past the lower obliquely inclined edge of the triangular shield member 785T. Once the suspension band 18' has entered the suspension gap G, the gate member 780' (with the combined anchoring plate 760') self-closes itself by pivoting back in the opposite direction under the biasing of the spring 740', whereupon the terminal foot portion 784' of the gate member 780' abuts a flanged locking pin 790', e.g. by virtue of engagement of the latter (in particular its portion behind the flange thereon) in a cut-out portion on the end of the foot portion 784', which flanged locking pin 790' is mounted on the lower end of the side bridging plate 771'.

Once in this closed position, if the trapped suspension band 18' then abuttingly engages the top edge of the gate member 780', this then forces the pivoted gate member 780' even more firmly into its closed position with its foot portion 784' held against the locking pin 790'. Furthermore, the triangular shield member 785T may itself be "cranked" (i.e. bent or ramped) generally along the line L, so that a foot or outer portion of the shield member 785T (i.e. that part beyond the line L) lies out of the general plane of the remainder of the shield member 785T so that the foot or outer portion thereof clears the flange on the locking pin 790' as it pivots therepast, which in turn urges the cut-out in the end of the foot portion 784' of the gate member 780' even more firmly onto the locking pin 790'. Thus, in this illustrated embodiment the triangular shield member 785T serves both to open the gate member 780' as the suspension band 18' slides past it, and it also serves to prevent the upper edge of the suspension band 18' fouling the cut-out in the foot portion 784' of the gate member 780' as it swings open.

Figure 9:
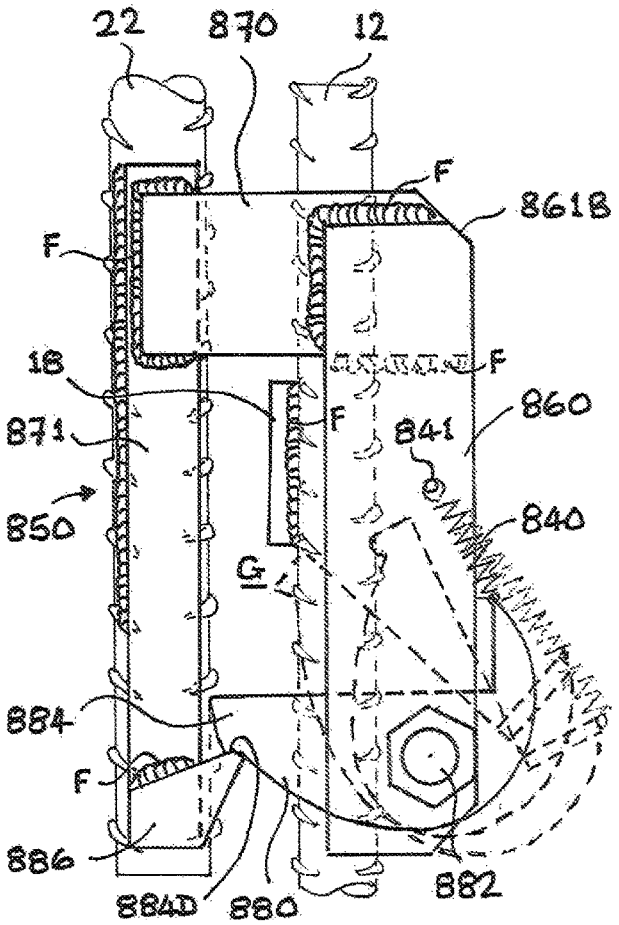
FIG. 9(*a*) is a side view of yet another splicing device according to another embodiment of the invention, shown in position splicing together the pile cages.
Figure 9:
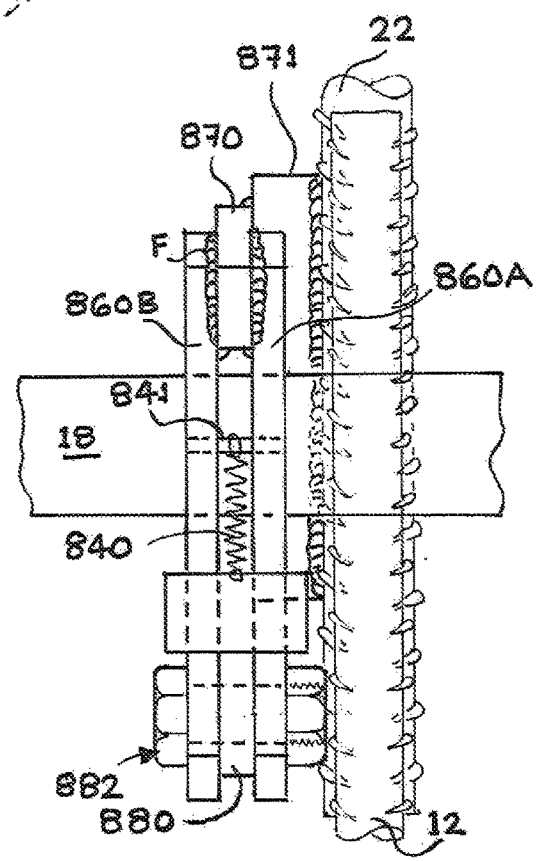

FIGS. 9(*a*) and 9(*b*) show yet another embodiment of the invention, this time the splicing device 850 comprising a discrete pivotable latch member 880 mounted at the lower end of a fixed anchoring plate 860. The anchoring plate 860 is again fixedly welded to the cage bar 22 via fixed upper and side bridging plates 870, 871, but now the pivotable latch member 880 is that part which constitutes the sole gate means by which the suspension gap G is openable and closable.

In this illustrated embodiment the latch member 880 is in the form of an asymmetrical cam member with an enlarged nose portion 884 and mounted via rotational pivot bolt or pin mounting 882. As with the embodiment of FIG. 8, the cam latch member 880 is biased into its closed position by tension coil spring 840 affixed thereto, with the spring 840 for example being anchored at its remote end to the anchoring plate 860 via pin 841. The variable orientational configurations of the cam latch member 880 and associated tension spring 840 during its pivoting motion are represented by the various phantom lines in FIG. 9(*a*). Again, the shape and pivotability of the cam latch member are such that as the suspension band 18 on the lower pile cage 10 enters the suspension gap G, its abutment against the obliquely angled underside of the cam nose portion 884 causes it to pivot upwards—against the force of the spring 840—and further into the suspension gap G, i.e. towards the upper bridging plate 870, and out of the way of the incoming suspension band 18. Once the suspension band 18 has entered the suspension gap G and moved past the cam latch member 880, so the latter is free to snap pivotally back down again (urged in that direction by the spring 840), thereby securely closing the suspension gap G.

To provide a firm and secure limiting feature to enable the pivotable cam latch member 880 to securely and safely carry the weight of the suspension band 18 (and thus the lower pile cage 10 carried by it) during the lifting operation of the spliced cages), the nose portion 884 of the cam latch member 880 is formed with a protruding detent portion 884D which bears against a seating surface of a seating flange or shoulder 886 which is welded to the cage bar 22.

Figure 10A:
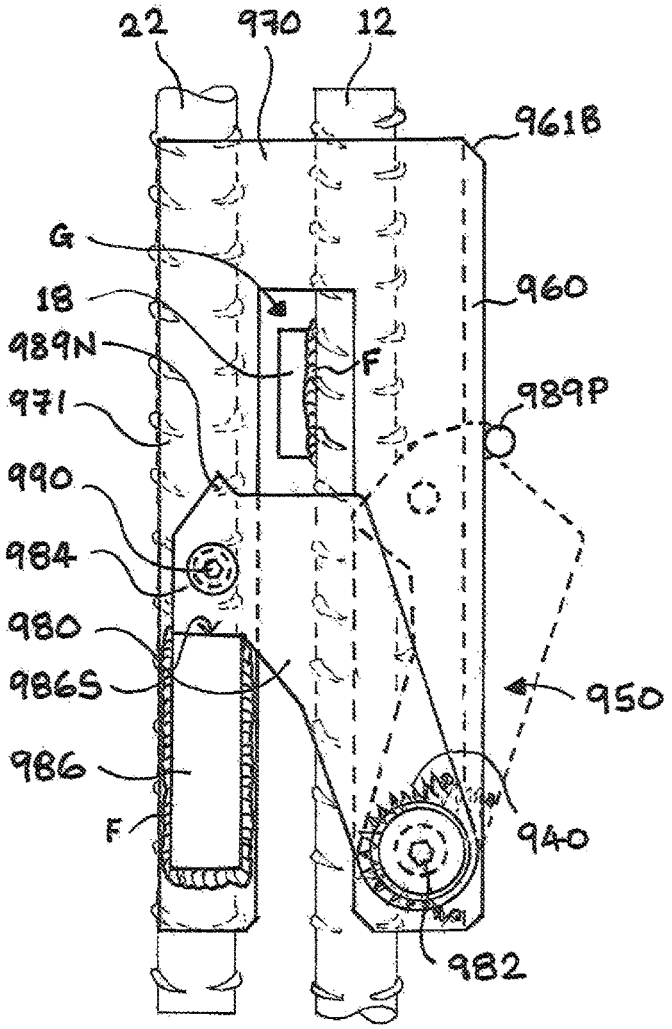
FIG. 10(*a*) is a side view of yet another splicing device according to another embodiment of the invention, shown in position splicing together the pile cages.
Figure 10B:
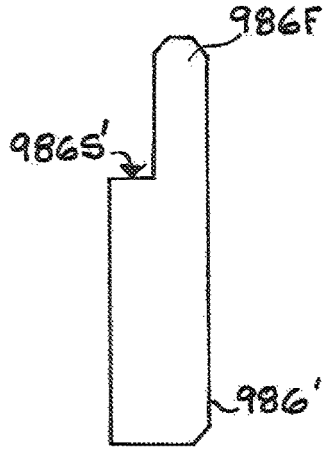
Figure 10C:
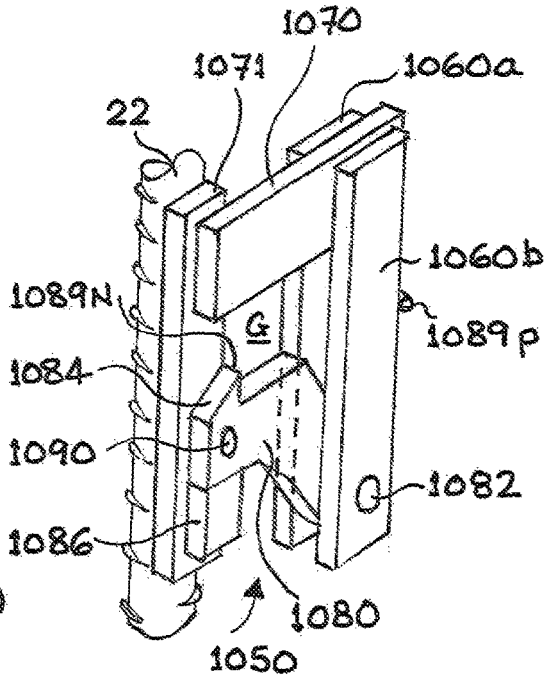

FIG. 10(*a*) shows a modified version of the embodiment of FIGS. 9(*a*) and 9(*b*), which works on the same basic principles but in which the shape of the cam latch member 980 is different. As shown here, the cam latch member 980 is pivotally mounted via spring-biased (by spring 940) rotational bolt or pin mounting 982 on the lower end of the anchoring plate 960 (which is shown as being integral with the upper and side anchoring plates 970, 971, the latter of which is welded to the cage bar 22), but is now configured with a more elongate shape with an enlarged head portion 984. Again, the variable orientational configuration of the cam latch member 980 during its pivoting motion is represented by the phantom lines in FIG. 10(*a*).

Also again, to provide a firm and secure limiting feature to enable the pivotable cam latch member 980 to securely and safely carry the weight of the suspension band 18 (and thus the lower pile cage 10 carried by it) during the lifting operation of the spliced cages), the head portion 984 of the cam latch member 980 itself constitutes a protruding detent portion which bears against a seating surface 986S of a seating flange or shoulder element 986 welded to the cage bar 22. In this particular embodiment, in order to provide extra security and stability of the closed latch arrangement, the head portion 984 of the cam latch member 980 may be provided with its own locking bolt or pin device 990 for locking the cam latch member 980 in its pivotally closed position once it has snapped back into place following reception of the suspension band 18 in the suspension gap Gas it pushes past, and forces out of the way, the cam latch member 980.

As shown in FIG. 10(*b*), as an alternative to such a locking bolt or pin device 990, or even in addition thereto, as an optional modification of this illustrated arrangement there may optionally be provided on the front of the seating flange or shoulder element 986' an upwardly extending retaining flange element 986F, behind which the head portion 984 of the cam latch member 980 may be inserted and retained as it pivots down into its closed position to bear against the seating surface 986S'.

Also in this embodiment, in order to limit the upward and radially inward pivoting movement of the cam latch member 980, there may be provided a stop pin 989P mounted, e.g. welded, onto a radially inward side edge of the anchoring plate 960, which engages against a nib portion 989N on the head portion 984 of the cam latch member 980.

FIG. 10(*c*) shows a slightly modified version of the embodiment of FIG. 10(*a*). Here the anchoring plate is split into a pair of discrete circumferentially outer and inner anchoring plate members 1060*a*, 1060*b*, which define therebetween a gap into which is mounted—again via mounting bolt or pin arrangement 1082—the cam latch member 1080. This arrangement may possibly in principle be beneficial over that of FIG. 10(*a*), because now the plane in which the cam latch member pivotally rotates is more in line with—indeed, may be substantially coincident with—the planes of both the bridging plate 1070 and the median plane of the pair of anchoring plate members 1060*a*, 1060*b*. In this manner a better distribution of loading forces in the overall splicing device 1050 may be achieved, which may be beneficial particularly in the case of particularly heavy pile cages.

Figure 11A:
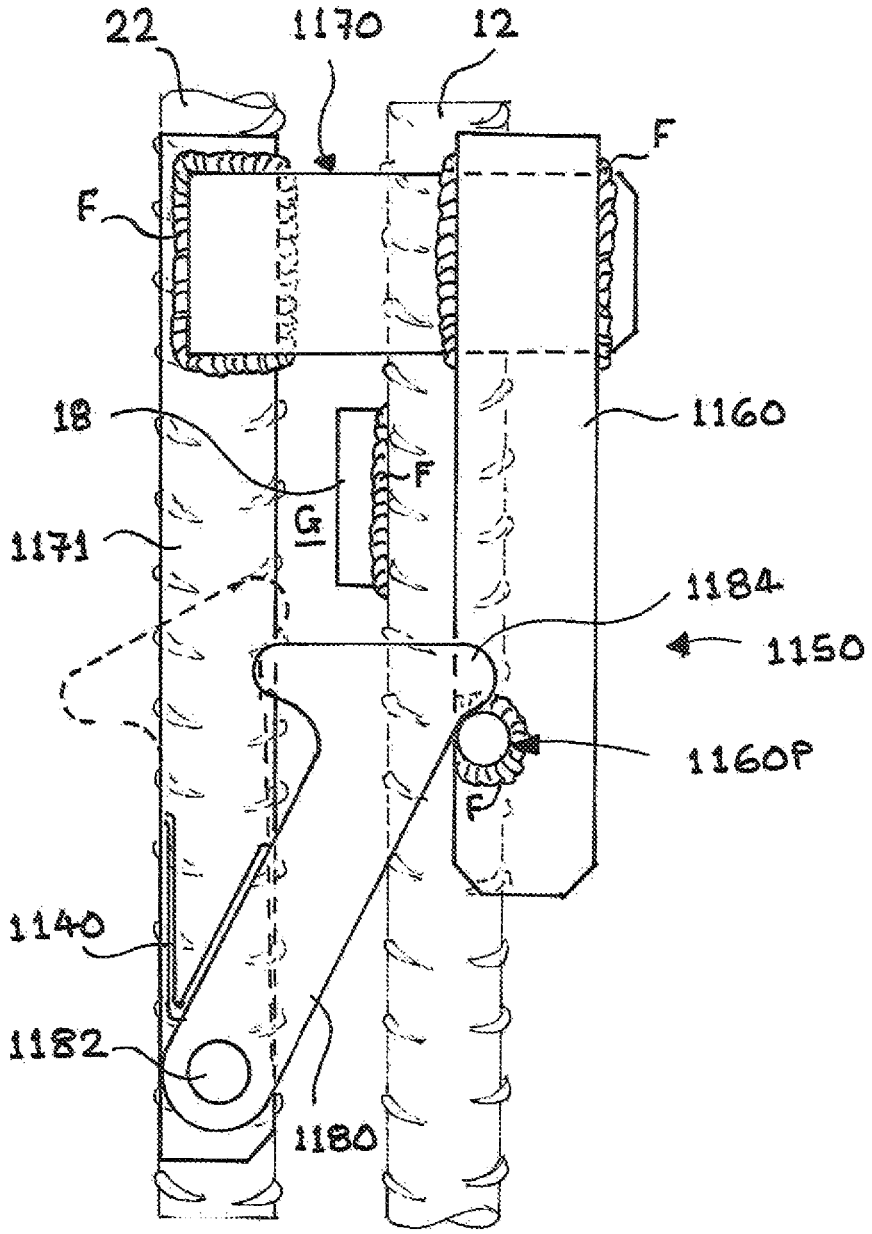
FIG. 11(*a*) is a side view of yet another splicing device according to another embodiment of the invention, shown in position splicing together the pile cages.
Figure 11:
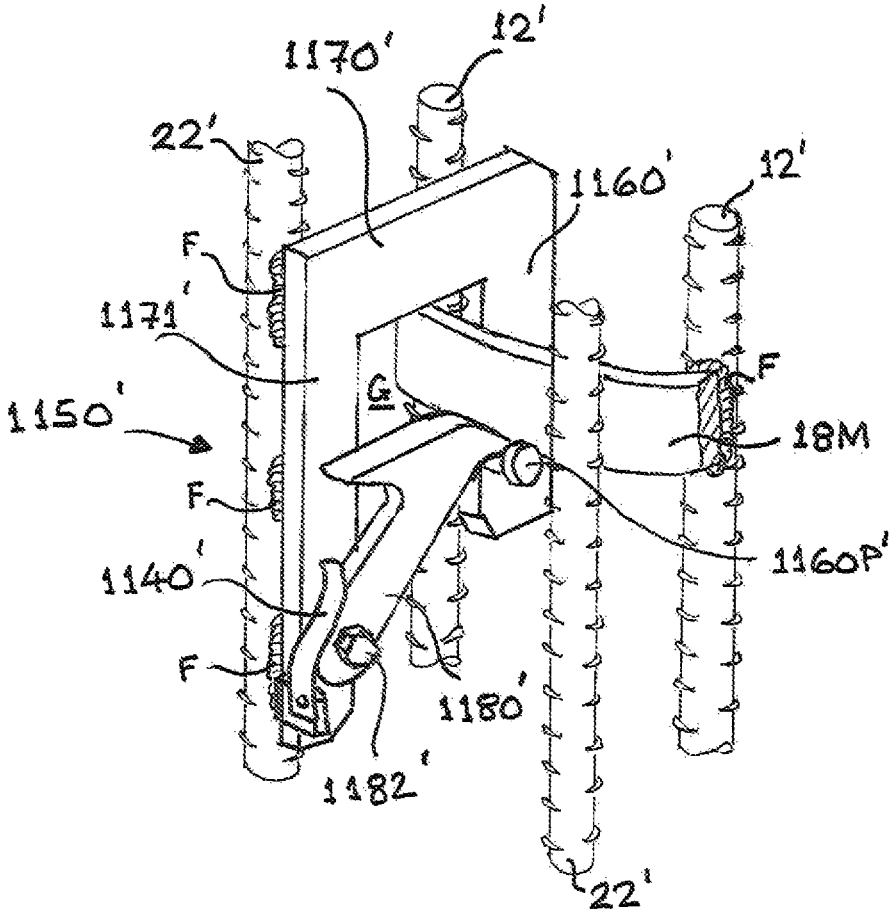

FIG. 11(*a*) shows a modified version of the embodiment of FIG. 10(*a*). Here the latch member 1180 is in the form of an elongate latch arm, but in this embodiment its mounting location and radial orientation are reversed. Thus, it is again pivotally mounted at a location below the anchoring plate 1160 and upper bridging plate 1170 (which are shown here as discrete plates welded together, the latter being welded to side bridging plate 1171 which is itself welded to the cage bar 22), but now its rotational bolt or pin mounting 1182 is on the lower end of the side bridging plate 1171. Thus, in this embodiment the latch arm 1180 pivots between a closed position as shown in solid lines, and an open position as shown in phantom lines. The upper end portion of the latch arm 1180 is conveniently shaped in the style of a hammerhead, to provide a stable planar upper side edge for bearing against the suspension band 18 trapped in the suspension gap G, and includes a nose portion 1184 for abuttingly bearing against a stop pin 1160P mounted adjacent the lower end of the anchoring plate 1160 when the latch arm is pivoted into its closed position, as shown.

A leaf spring 1140 is mounted in conjunction with the latch arm's rotational pivot mounting 1182 in order to bias the latch arm 1180 arm towards its closed position with its nose portion 1184 abutting the stop pin 1160P. Its being held securely in this closed position may be further assisted during the lifting of the spliced cages by the offset distance in the radial direction between the latch arm's rotational pivot mounting 1182 and the longitudinal axis through which acts the main downward loading force exerted by the suspension band 18 as it bears against the upper side edge of the upper hammerhead of the latch arm 1180, this offset distance giving rise to a torque about the pivot mounting 1182 which tends to further urge the latch arm into its closed position against the stop pin 1160P.

In a modification of the arrangement shown in FIG. 11(*a*), if desired or appropriate the anchoring plate 1160 may be replaced—in an analogous manner to the anchoring plate arrangement in FIG. 10(*c*)—with a pair of circumferentially spaced face-to-face arranged pair of anchoring plate members 1060*a*, 1060*b*, which define therebetween a gap into which is mounted—via the stop pin arrangement 1160P—the latch arm 1180. This may have corresponding advantages as mentioned above for the analogous arrangement of FIG. 10(*c*).

As an alternative to the constructional form of splicing device as shown in FIG. 11(*a*), there may instead be employed the alternative version of device 1150' as shown in FIG. 11(*b*) (where corresponding features are shown with the same reference numerals but suffixed with "'"). This alternative embodiment form of the splicing device 1150' illustrates inter alia some useful alternative constructional features of the device which may be employed in many other embodiments of the invention:

For instance, as shown in FIG. 11(*b*), the anchoring plate 1160', the upper bridging plate 1170' and the side bridging plate 1171' may all be integrated into a single-piece yoke which may for example be pre-cut as a single component from a sheet of the relevant plate material. The side bridging plate 1171' only is welded (such as by fillet welds F) to the cage bar 22', and thus the inherent structural strength and rigidity of the three-section one-piece yoke 1171', 1170', 1160' enables it to fulfil its function, just like the plural-welded-components yokes of other embodiment forms of device as shown in many other of the drawings.

Also for instance, as shown in FIG. 11(*b*), the suspension band 18 on the lower cage may here be formed not as a continuous circular or annular band whose length extends all the way round the lower cage, but instead it may be formed as a modular suspension band, comprising a plurality of discrete modular suspension band segments 18M. Each such suspension band segment 18M has a suitable circumferential positioning and length e.g. sufficient to span a circumferential distance of at least that distance between, e.g. between the centres of, two adjacent cage bars 12 of the lower cage, so that the respective band segment 18M is able to be anchored at or adjacent each of its respective ends to those adjacent cage bars 12, again e.g. by fillet welds F.

Figure 12:
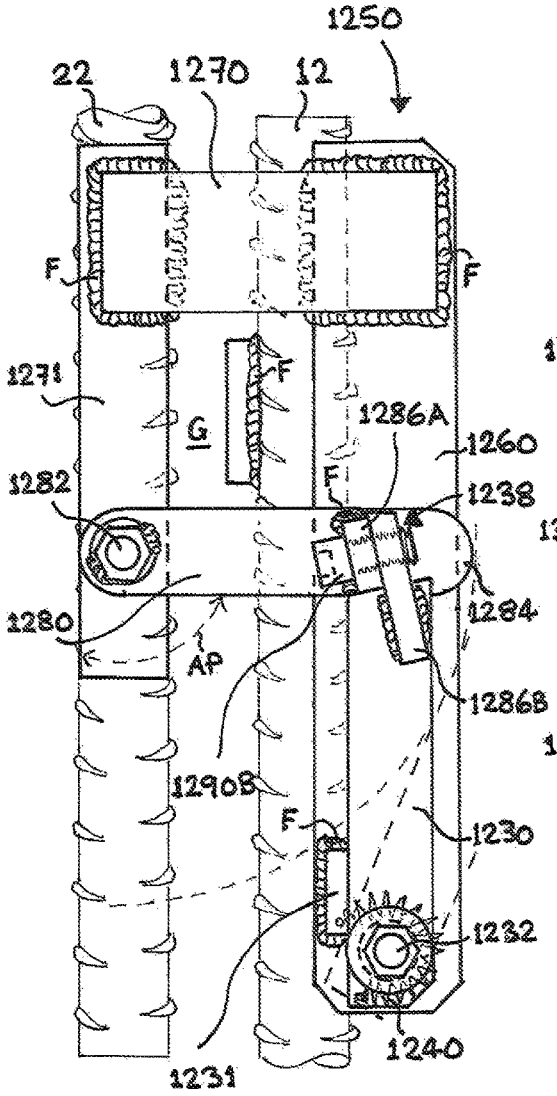
FIG. 12 is a side view of yet another splicing device according to another embodiment of the invention, shown in position splicing together the pile cages, this arrangement showing the use of a pivotal escutcheon-type locking member to lock the latch member in its closed configuration.

FIG. 12 shows another embodiment of the invention, this time the splicing device 1250 comprising a more advanced latch mechanism for selectively maintaining the pivotable latch member 1280 in its closed position occluding the suspension gap G and trapping the suspension band 18 therein. The latch member 1280 is pivotally mounted on or adjacent the lower portion of the side bridging plate 1271 again via a rotational pivot bolt or pin mounting 1282, and its maximum pivoting movement through approximately 90° is represented by arrow AP, thereby defining the latch member's respective open and closed positions. Here, therefore, the latch member 1280 pivots out of the suspension gap G in a direction away from the upper bridging plate 1270 as it pivots into its open position. For locking the latch member 1280 in its closed position, as shown in the Figure, there is provided a locking plate or escutcheon 1230, which is itself pivotally mounted by its own respective rotational bolt or pin mounting 1232 on the lower end of the anchoring plate 1260. The locking escutcheon 1231 is spring biased by coil spring 1240 in a radially outward direction, and its distance of pivoting travel in that radially outward direction is limited by stop plate or shoulder 1231 welded also the lower end portion of the anchoring plate 1260.

For assisting the locking of the latch member 1280 in its secure closed configuration once it has been swung upwardly so that is terminal detent portion 1284 engages the upper obliquely inclined end of the locking escutcheon 1230, a locking bolt arrangement 1238 may be provided, which may be similar in construction and operation to that same feature as seen in the embodiment of FIG. 4(*a*). Thus, here a locking bolt 1290B, e.g. actuatable conveniently and safely from radially outside the cages by use of an allen key, is insertable through an aperture in a first locking flange or plate 1286A welded onto the latch member 1280, and lockable in e.g. an internally screw-threaded locking aperture in a second locking flange or plate 1286B which is welded onto the locking escutcheon 1230. The locking flanges or plates 1286A, 1286B are themselves slightly angled e.g. at an angle of around 10° to 20° as shown with respect to the longitudinal axis of the cages, in order to provide a stable and secure abutment seating and to take account of the pivoting rotational motion of the latch member 1280 and locking escutcheon as they are brought into their locking mutual engagement.

Figure 13:
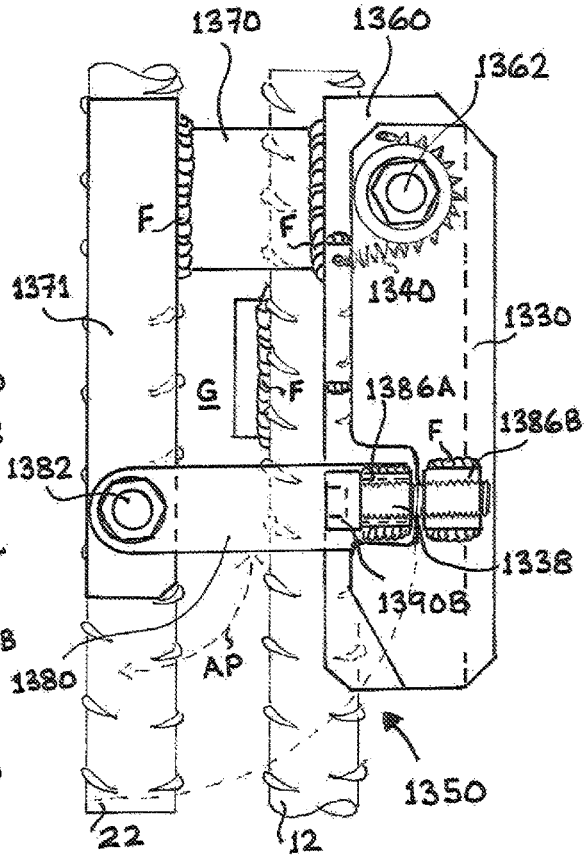
FIG. 13 is a side view of yet another splicing device according to another embodiment of the invention, shown in position splicing together the pile cages, and showing a modified form of pivotal escutcheon-type locking member to lock the latch member in its closed configuration.

FIG. 13 shows a modified version of the embodiment of FIG. 12, which works on the same basic principles but in which the spring-biased rotational pivot mounting 1362 of the locking escutcheon 1330 is moved upwards to the top of the anchoring plate 1360. However, in all other material respects, the two embodiments of FIGS. 12 and 13 are constructed and operate in the same manner, with corresponding reference numerals denoting corresponding features but incremented by 100.

Figure 14:
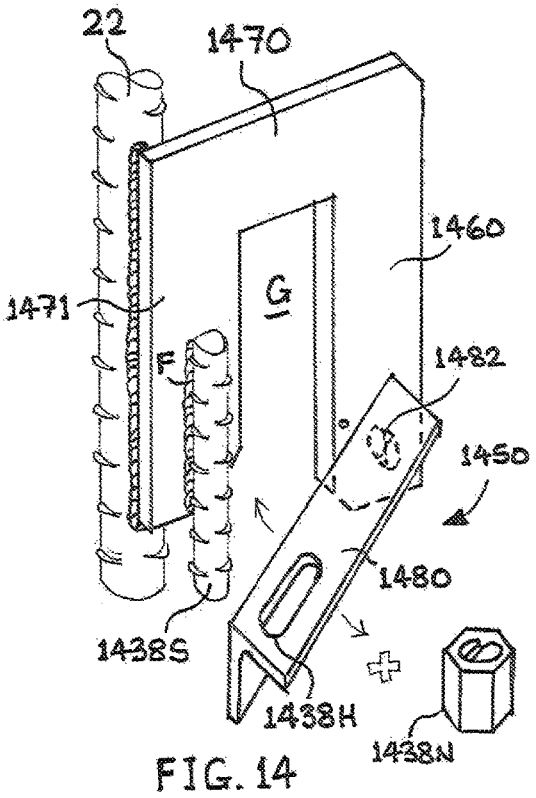
FIG. 14 is an exploded perspective view of yet another splicing device according to another embodiment of the invention.

Each of FIGS. 14, 15, 16, 17, 18 and 19(*a*) show some further example splicing devices according to further embodiments of the invention. For the most part each of these variants will be self-explanatory, with corresponding reference numerals denoting corresponding features but incremented by 100 each time, although their respective main differentiating features may be summarised as follows:

In the embodiment of FIG. 14, a single-piece unitary yoke provided the anchoring plate 1460, upper bridging plate 1470, and side bridging plate 1471. A L-sectioned latch plate 1480 is pivotally attached, e.g. via pivot bolt or pin arrangement 1482, to the lower end of the anchoring plate 1460, and is lockable in its closed position by means of a locking hole or slot 1438H which can be placed over the lower end of a screw-threaded locking rod 1438S which is welded to the lower end of the side bridging plate 1471. A locking nut 1438N, again conveniently and safely manipulatable from radially outside the cages, engageable with the free end of the locking rod 1438S completes the locking arrangement.

Figure 15:
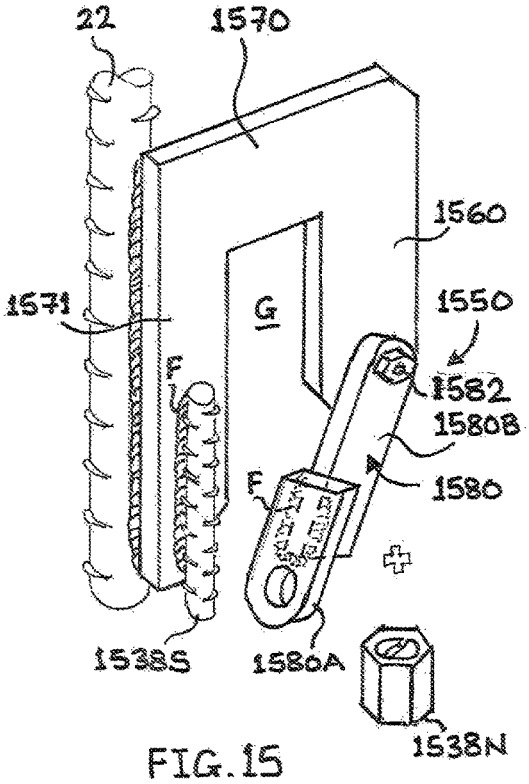
FIG. 15 is an exploded perspective view of yet another splicing device according to another embodiment of the invention, similar in basic principles to that of FIG. 14 but showing a modified form of latch member.

In the embodiment of FIG. 15, the pivotable latch plate 1580 is formed in two sections 1580A, 1580B welded together, with each section being oriented with its main plane perpendicular to the main plane of the other. This arrangement may serve to enhance the strength of the overall latch plate 1580.

Figure 16:
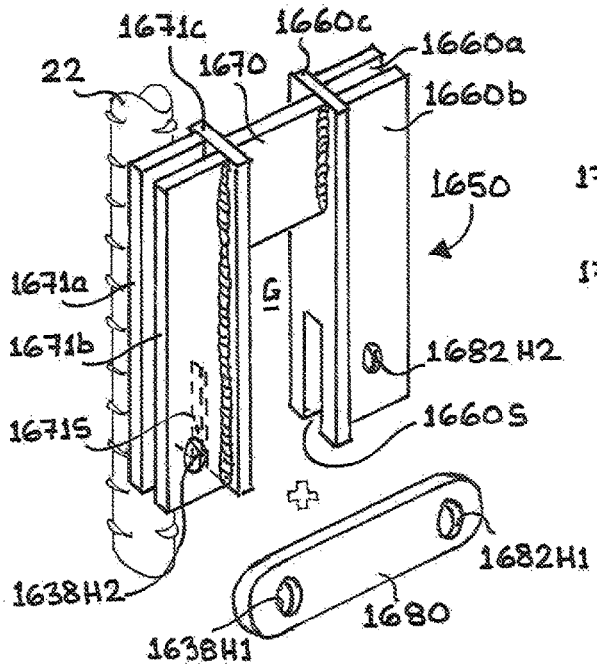
FIG. 16 is an exploded perspective view of yet another splicing device according to another embodiment of the invention, similar in basic principles to that of FIG. 14 but showing another modified form of latch member.

In the embodiment of FIG. 16, the anchoring plate is split into a pair of spaced apart face-to-face anchoring plate members 1660*a*, 1660*b* welded onto a transversely oriented uniting anchoring plate carrying member 1660*c*, and likewise the side bridging plate is also split into a pair of spaced apart face-to-face side bridging plate members 1671*a*, 1671*b* welded onto a transversely oriented uniting side bridging plate carrying member 1671*c*, the two carrying members 1660*c*, 1671*c* being welded to a somewhat short upper bridging plate 1670. Each of the anchoring plate carrying member 1660*c* and side bridging plate carrying member 1671*c* is formed at its lower end portion with a respective mounting slot 1660S, 1671S into which is mountable one respective end of latch plate 1680. Corresponding pairs of mounting holes 1682H1, 1682H2 and 1638H1, 1638H2 are arranged to receive a respective locking bolt, or pin (not shown) so that the locking plate 1680 is pivotable yet lockable in its closed position occluding the suspension gap G in a similar manner to the locking plate of the embodiments of FIGS. 14 and 15. Because of the in-line co-planar arrangement of the latch plate 1680 and the upper bridging plate 1670, this arrangement may lead to a better distribution of loading forces in the overall splicing device 1650.

Figure 17:
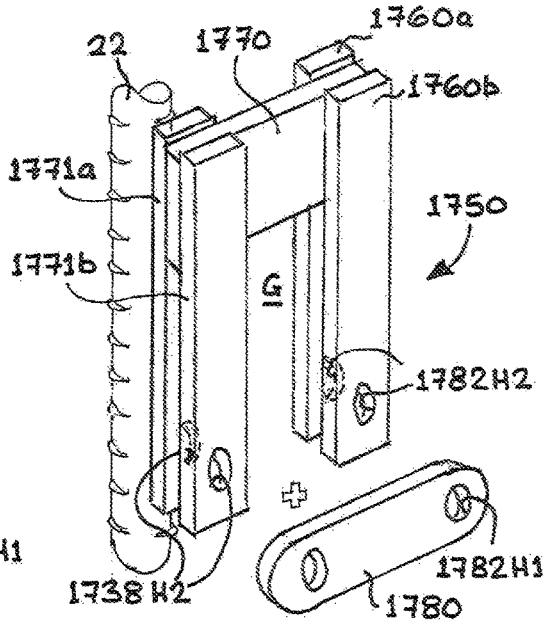
FIG. 17 is an exploded perspective view of yet another splicing device according to another embodiment of the invention, similar in basic principles to that of FIG. 14 but showing yet another modified form of latch member.

In the embodiment of FIG. 17, which is virtually identical to the embodiment of FIG. 16, instead of the respective pairs of anchoring plate members 1660*a*, 1660*b* and side bridging plate members 1671*a*, 1671*b* being welded respectively to uniting anchoring plate carrying member 1660*c* and side bridging plate carrying member 1671*c*, they may be welded instead directly to opposite side faces of a single, somewhat longer upper bridging plate 1770. As illustrated here by way of example, one only of the locking holes 1738H2 may be internally screw-threaded for receiving therein a threaded shaft of the relevant locking bolt or pin, thereby avoiding the need for a discrete locking nut.

Figure 18:
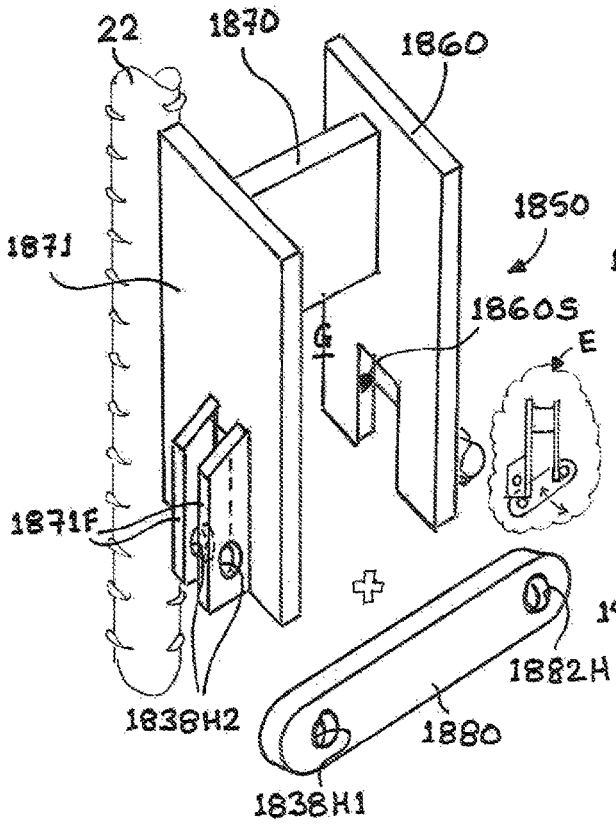
FIG. 18 is an exploded perspective view of yet another splicing device according to another embodiment of the invention, similar in basic principles to that of FIG. 14 but showing yet another modified form of latch member.
Figure 19A:
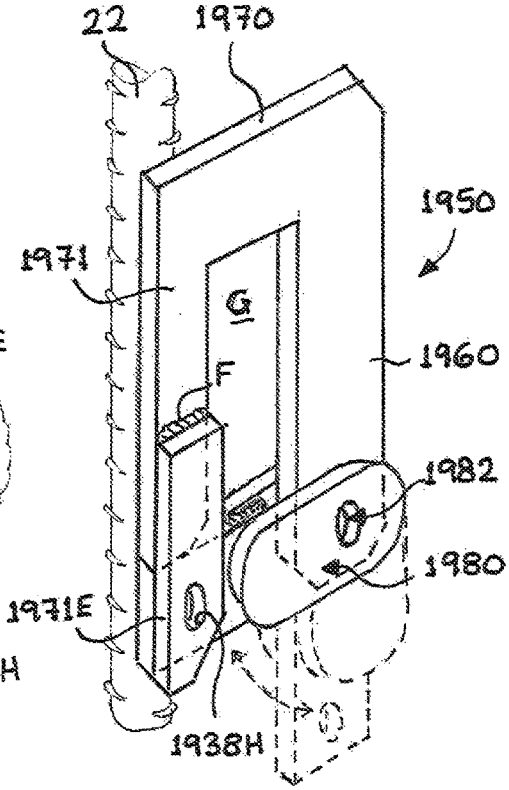
FIG. 19(*a*) is a perspective view of yet another splicing device according to another embodiment of the invention, similar in basic principles to that of FIG. 14 but showing yet another modified form of latch member.
Figure 19B:
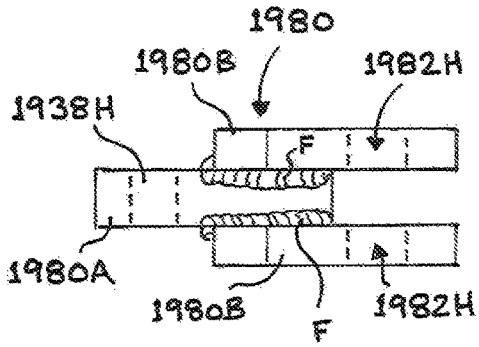
Figure 19C:
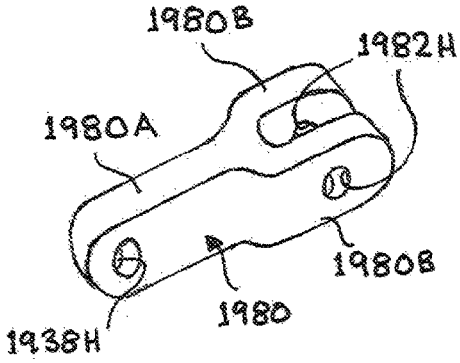
Figure 19D:
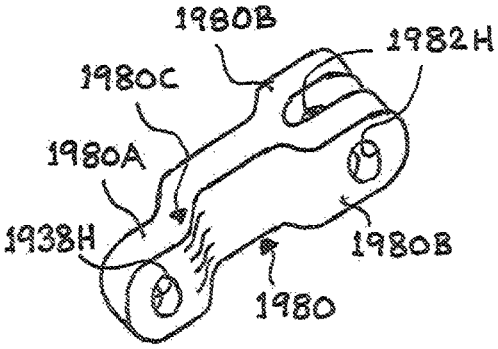
Figure 19E:
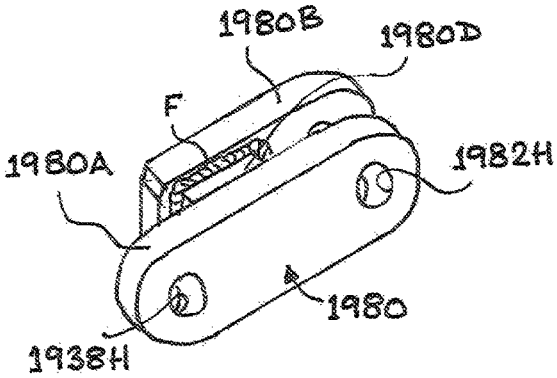

In the embodiment of FIG. 18, which is very similar in construction and operation to the embodiment of FIG. 16, each of the pairs of anchoring plate members and side bridging plate members are now in effect reduced or shortened in height to form mere respective pairs of spaced apart flange members 1860F, 1871F for the anchoring therein and therebetween of the respective ends of latch plate 1880. As a consequence, the device 1850 is now fixedly attached by welding to the cage bar 22 via the main uniting side bridging plate 1871. The inset E shows the arrangement from the side with the latch plate already pivotally attached and in the process of being pivoted upward into its closed portion.

In the embodiment of FIG. 19(*a*), which is very similar in construction and operation to the embodiment of FIG. 15, the latch plate 1980 is shown here as, to its radially inner end, being bifurcated, so that the same in-line co-planar advantage is obtained as employed in the embodiments of FIGS. 16 and 17. However, given the use of a uni-planar unitary yoke to provide the side bridging plate 1971, upper bridging plate 1970 and anchoring plate 1960, the same simple type of latch plate pivoting and locking arrangement is employed as in the embodiment of FIGS. 16 and 17. To enhance the in-line co-planar advantage associated with the radially outer end of the latch plate 1980, the lower end of side bridging plate 1971 is itself provide with a bifurcated flange extension 1971E, behind which (i.e. between it and the cage bar 22) the radially outer single-limbed end of the latch plate 1980 fits and is lockable.

FIG. 19(*b*) shows in top plan view the bifurcated latch plate 1980 alone of the splicing device 1950 of FIG. 19(*a*). Its radially inner end portion comprises a pair of symmetrically bifurcated latch plate limb portions 1980B, each formed with a respective mounting hole 1982H for accommodating therein a respective pivot mounting bolt or pin (not shown) via which the latch plate 1980 is pivotally mounted on the lower end of anchoring plate 1960, whereas its radially outer end portion comprises a single latch plate limb portion 1980A welded onto and inbetween the pair of bifurcated latch plate limb portions 1980B, and formed with a single mounting hole 1938H for accommodating therein a respective pivot mounting bolt or pin (not shown) via which the latch plate 1980 is lockable in its closed pivotal position, occluding the suspension gap G, on the lower end of side bridging plate 1971.

FIG. 19(*c*) shows in top plan view a modified, simpler configuration of the latch plate 1980, but which works in the same way as that of FIG. 19(*b*).

FIG. 19(*d*) shows in top plan view a modified version of the latch plate 1980 of FIG. 19(*c*). Here the radially outer end portion 1980A is laterally displaced or "kinked", as at 1980C, out of the general plane of the main central portion of the latch plate 1980, so that when the latch plate 1980 is finally pivotally mounted and locked in its closed position in the device 1950 of FIG. 19(*a*), the main central portion of the latch plate 1980 is more closely matched and more symmetrically aligned with the general plane through which the main axial load is exerted through the yoke plate arrangement 1971, 1970, 1960 upon lifting of the pile cages when the latch plate 1980 is finally locked in place in its closed position and supporting the trapped suspension band 18.

FIG. 19(*e*) shows in top plan view another modified version of the latch plate 1980, this one combinedly embodying the desirable main constructional features of the versions of both FIGS. 19(*b*) and 19(*d*) discussed above.

Figure 20A:
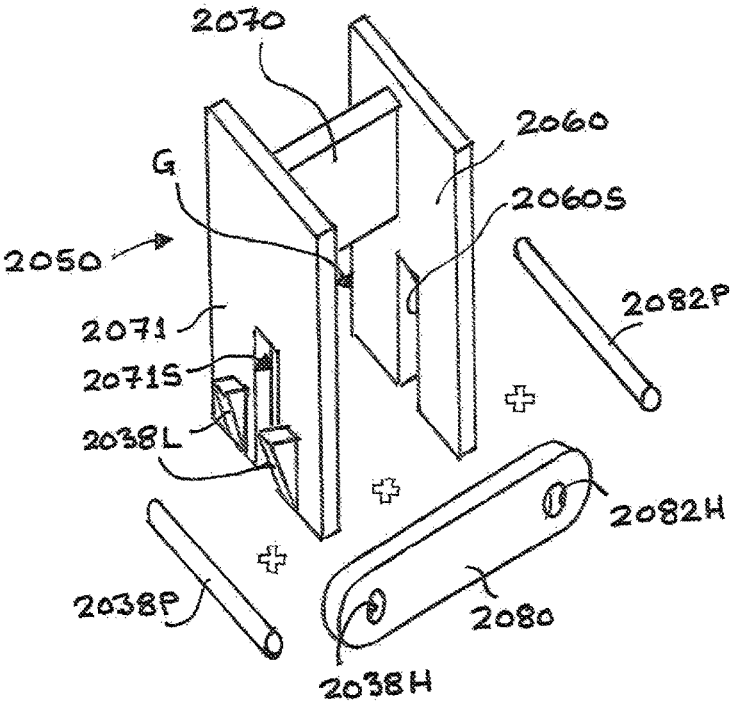
FIG. 20(*a*) is an exploded perspective view of yet another splicing device according to another embodiment of the invention, shown absent the cage to which it is attached and showing yet another form of latching gate arrangement.
Figure 20:
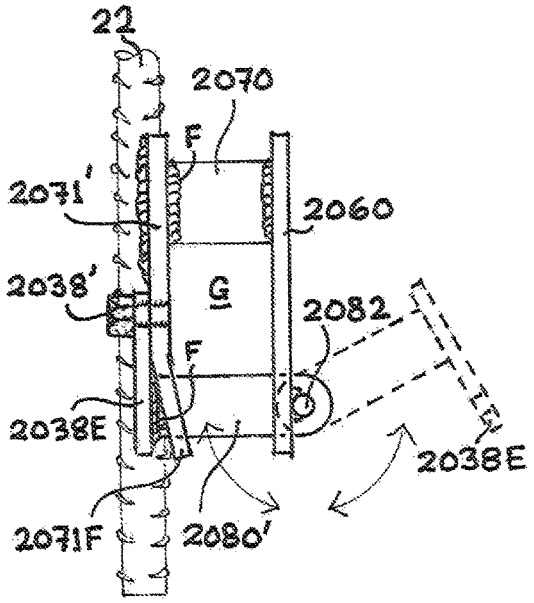
Figure 20:
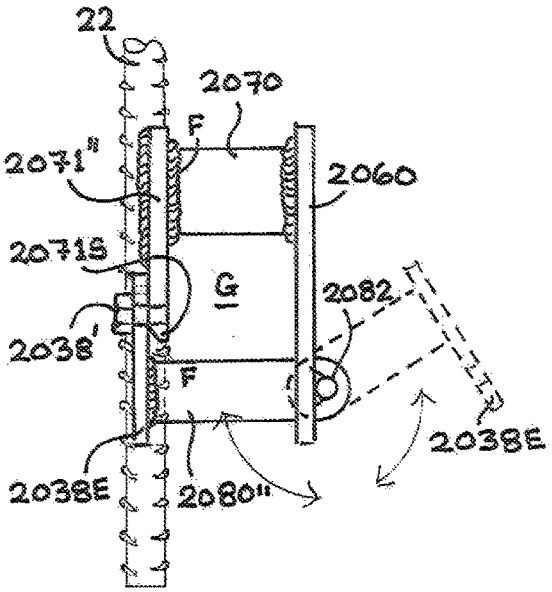

FIG. 20(*a*) shows yet another embodiment of the invention, this time the splicing device 2050 being virtually identical in construction and operation to that of FIG. 18. However, here the respective pairs of spaced apart flange members 1860F, 1871F (in FIG. 18), for the anchoring in the respective holes 1838H therein and therebetween of the respective ends of latch plate 2080 are now replaced by respective pairs of still further shortened seating lugs 2038L. Thus, instead of the respective pivot bolt/pin 2082P and locking bolt/pin 2038P being insertable through respective through-holes formed in respective portions of the device, they can instead simply be abuttingly supported atop the respective seating lugs 2038L, with the downward loading force of the suspension band 18 from the weight of the spliced cages helping to securely hold the latch plate 2080 in place in its thus locked closed position.

FIG. 20(*b*) shows a modified version of the arrangement of FIG. 20(*a*). Here, the latch plate 2080' and the side bridging plate 2071' are modified in shape in order to provide a somewhat simpler and more easily actuated latching gate mechanism. Accordingly, the latch plate 2080' now comprises at its radially outer end a transversely oriented flange extension portion 2038E, welded to the main central portion of the latch plate 2080', and with a through-hole in its upper end portion, while the side bridging plate 2071' now comprises an angled foot portion 2071F at its lower end, angled toward the radially inward direction e.g. at an angle of from around 5° up to around 15 or 20° to the general plane of the main body of the side bridging plate 2071'. Thus, as the latch plate 2080', already pivotally mounted on the lower end of the anchoring plate 2060 via rotational pivot bolt or pin mounting 2082, is pivoted from its open position (shown in phantom lines) into its closed position occluding the suspension gap G (shown in solid lines), the transverse flange extension portion 2038E of the latch plate 2080' passes by and overlaps with the angled foot portion 2071F of the side bridging plate 2071', as shown. The latch plate 2080 may then be finally locked securely in its closed position by the insertion/actuation of locking bolt or pin arrangement 2038'.

FIG. 20(*c*) shows a further slightly modified version of the arrangement of FIG. 20(*b*). Here the same transverse flange extension portion 2038E of the latch plate 2080" is employed, but the side bridging plate 2071" is modified so that its lower foot portion now comprises a shortened and bevelled abutment foot 2071S. The resulting arrangement works in the same way as that of FIG. 20(*b*), including the final deployment of the locking bolt or pin arrangement 2038' to lock the latch plate 2080" securely in its closed position occluding the suspension gap G.

Figure 21:
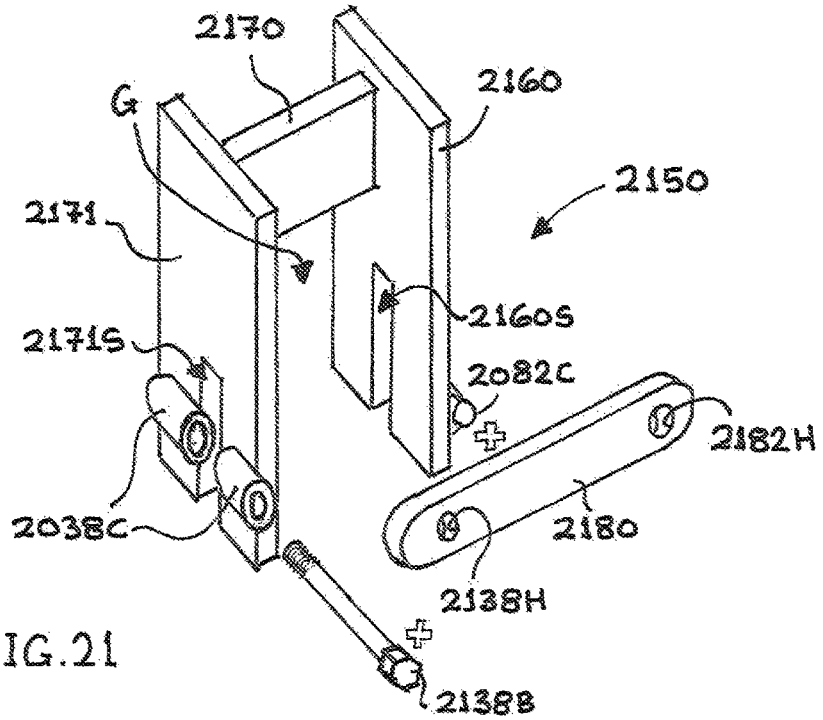
FIG. 21 is an exploded perspective view of part of yet another splicing device according to another embodiment of the invention, again shown absent the cage to which it is attached and showing yet another form of latching gate arrangement.

FIG. 21 shows yet another embodiment of the invention, this time the splicing device 2150 being virtually identical in construction and operation to that of FIG. 20(*a*). Here, however, the respective pairs of shortened seating lugs 2038L (in FIG. 20(*a*)) are replaced with respective cylindrical locking tubes 2038C, each welded to the respective plate on which it is located. (If desired, such locking tubes may even be mounted atop the previously provided seating lugs 2038L, if such are retained in this modified construction.) Each such locking tube 2038C is internally threaded to receive therein the threaded shaft of a respective locking bolt or pin 2038B.

Figure 22:
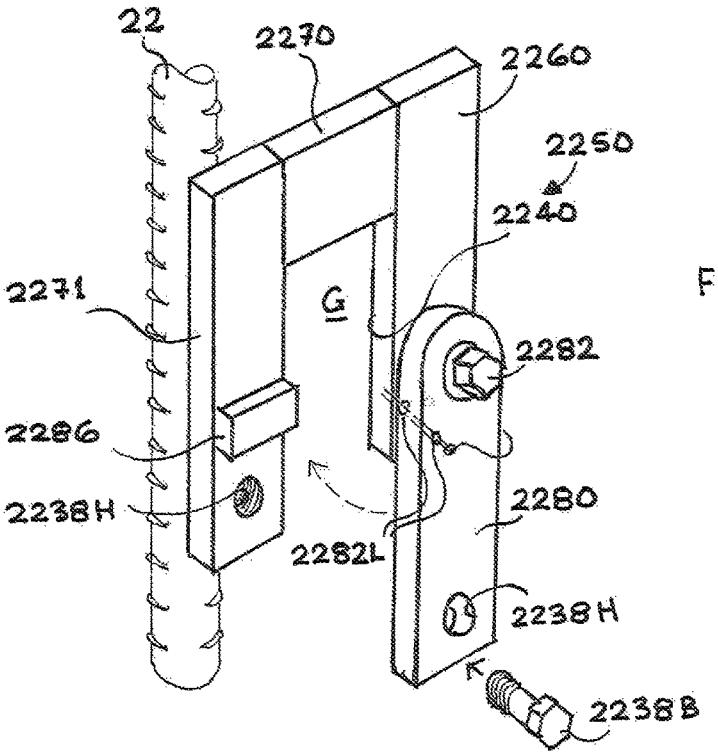
FIG. 22 is an exploded perspective view of yet another splicing device according to another embodiment of the invention, showing yet another form of latching gate arrangement.

FIG. 22 shows yet another embodiment of the invention, this time the splicing device 2250 being similar in construction and operation to that of FIG. 15, but now the rotational pivot bolt or pin mounting 2282 by which the latch plate 2280 is pivotally attached to the lower end portion of the anchoring plate 2260 is spring-loaded by spring 2240, so as to bias the latch plate 2280 towards its upward, closed position once it is free to pivot. For presenting the device, already attached to the upper pile cage 20, ready for insertion of the suspension band 18 into the suspension gap G, the latch plate may be detained in its downwardly pivoted open position (as shown in the Figure) by means of a pin-in-hole arrangement 2282L, which pin may be released or retracted manually or by use of a tool once the suspension is safely trapped in the suspension gap G and the latch plate 2280 ready to be released to snap back up into its closed position, in which final position it may be locked using locking bolt/pin and hole arrangement 2238B, 2238H as before. To limit the upward pivoting travel of the latch plate 2280 as it moves up into its closed pivotal position, a limiting stop plate or shoulder element 2286 is welded onto the side bridging plate 2271 at the required location so that the respective locking holes 2238H in the latch plate 2280 and the foot of the side bridging plate 2271 end up in register, ready for insertion of the locking bolt 2238B.

Figure 23:
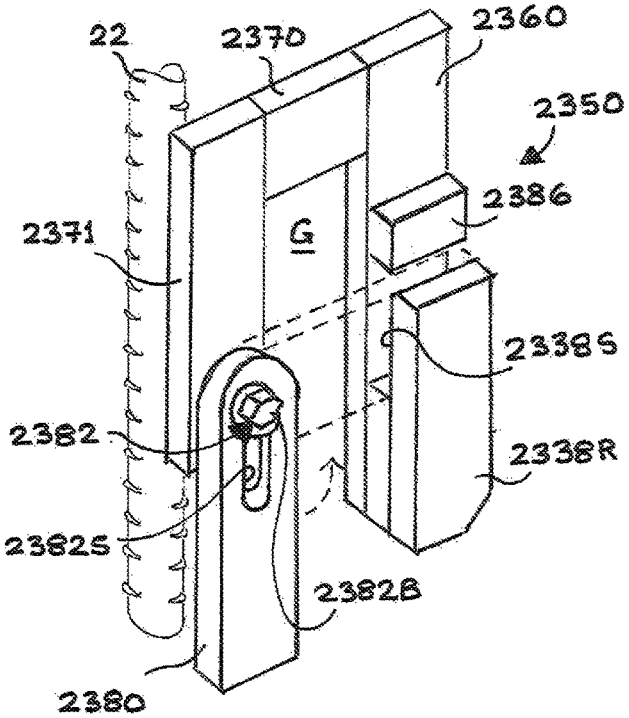
FIG. 23 is an exploded perspective view of yet another splicing device according to another embodiment of the invention, showing yet another form of latching gate arrangement.

FIG. 23 shows yet another embodiment of the invention, this time the splicing device 2350 comprising a mechanically simpler form of latch plate 2380 pivoting mechanism, where the pivoting action may be effected manually or by use of a tool again conveniently and safely from radially outside the cages. In this version the latch plate 2380 is initially provided pre-attached pivotally to the lower end of the side bridging plate 2371' via rotational bolt or pin mounting 2382, as before. Here, however, that pivot mounting is via an elongate mounting slot 2382S in the latch plate 2380, along which slot 2382S the mounting bolt or pin 2382B is freely slidable. The weight of the latch plate 2380 maintains it in its open position, as shown. Now, however, for pivoting the latch plate 2380 upwards into its closed position as and when required (once the suspension band 18 has been received in the suspension gap G), the latch plate 2380 may be pulled upwardly so that the mounting bolt or pin 2382B slides along the mounting slot 2382S, until it reaches the opposite end of the slot 2382S. The latch plate 2380 may then be rotated upwards through 90°, and then slid in a radially inward direction to push the latch plate 2380 into a retained location in which its radially inward end portion is retained behind a retaining flange plate 2338R welded onto the lower end portion of the anchoring plate 2360. During this radial sliding motion the mounting bolt or pin 2382B slides back along the mounting slot 2382S in the opposite direction. To enhance the security of the latch plate 2380 thus pivoted into and retained in its closed position, the mounting bolt or pin 2382B may be tightened up, if that is possible, or alternatively some other locking bolt or pin arrangement may be employed, e.g. as used in other embodiments disclosed herein. Further optionally, the proper and secure seating of the radially inward end portion of the latch plate 2680 behind the retaining flange plate 2338R may be assisted by means of an upper retaining shoulder or seating plate 2386 welded onto the anchoring plate 2360 at or just above the upper boundary of the retaining slot defined behind the flange plate 2338R.

Figure 24:
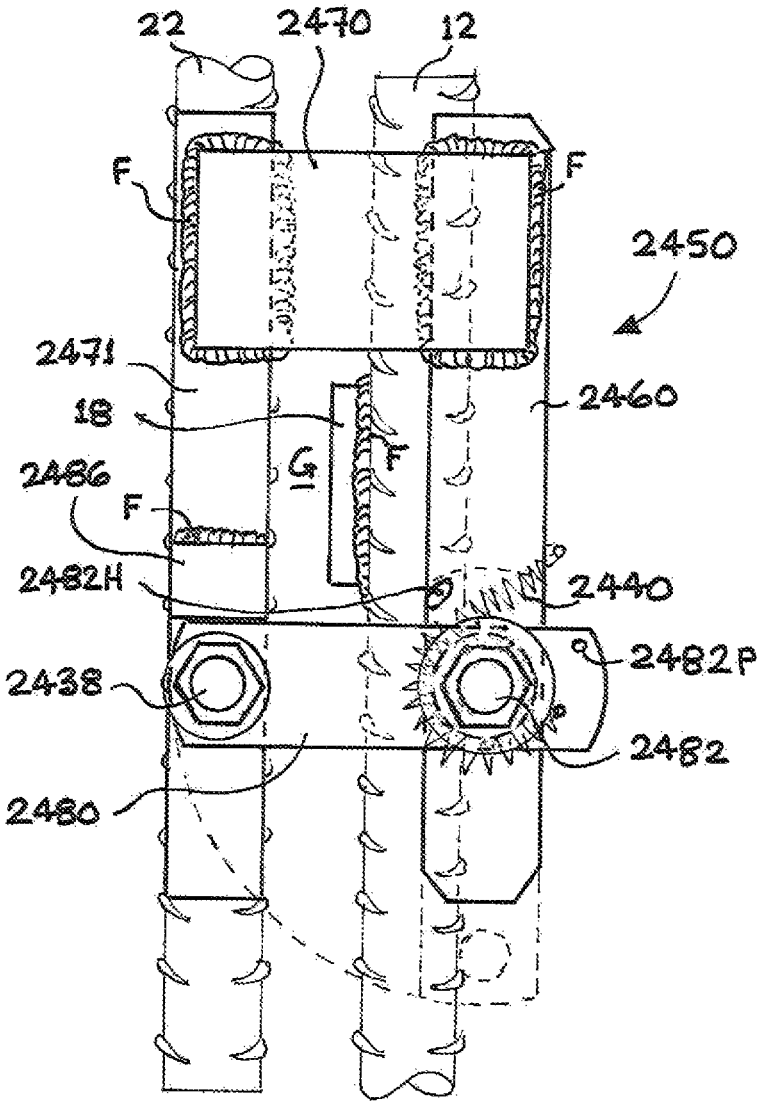
FIG. 24 is a side view of yet another splicing device according to another embodiment of the invention, shown in position splicing together the pile cages, and showing yet another form of latching gate arrangement.

FIG. 24 shows yet another embodiment of the invention, this time the splicing device 2450 being closely similar in construction and operation to that of FIG. 22, where again corresponding constructional features are identified by the same reference numerals but incremented by 100. Here, however, as well as the anchoring plate 2460 defining the suspension gap G being welded to a discrete upper bridging plate 2470 which is welded to side bridging plate 2471 which is itself welded to the cage bar 22, a slightly different arrangement of coil spring-biased rotational pivot mounting 2482 is used to mount the latch plate 2480, via its radially inner end, onto the lower end portion of the anchoring plate 2460. Also, the locking bolt or pin arrangement 2438, by which the latch plate 2480 is locked, conveniently and safely from radially outside the cages, in its closed pivotal position (as shown in the Figure), is more akin to that shown in other embodiments such as those of FIG. 2, 8, 10 or 12. As in the embodiment of FIG. 22, to limit the upward pivoting travel of the latch plate 2480 as it moves up into its closed pivotal position, a limiting stop plate or shoulder 2486 is welded onto the side bridging plate 2471 at the required location so that the respective locking holes in the latch plate 2480 and the foot of the side bridging plate 2471 end up in register, ready for insertion of the locking bolt.

Figure 25A:
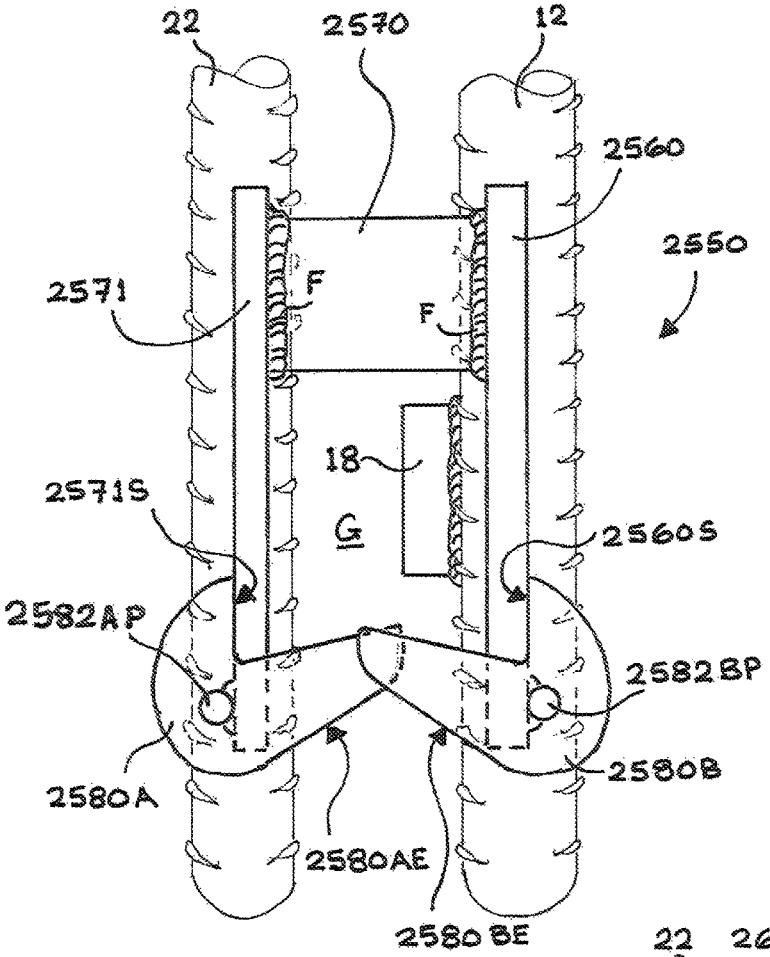
FIG. 25(*a*) is a side view of another splicing device according to another embodiment of the invention, shown in position splicing together the pile cages, showing the use of a pair of contra-pivotable latch members to selectively close or open the suspension gap into which can be trapped the suspension band.
Figure 25B:
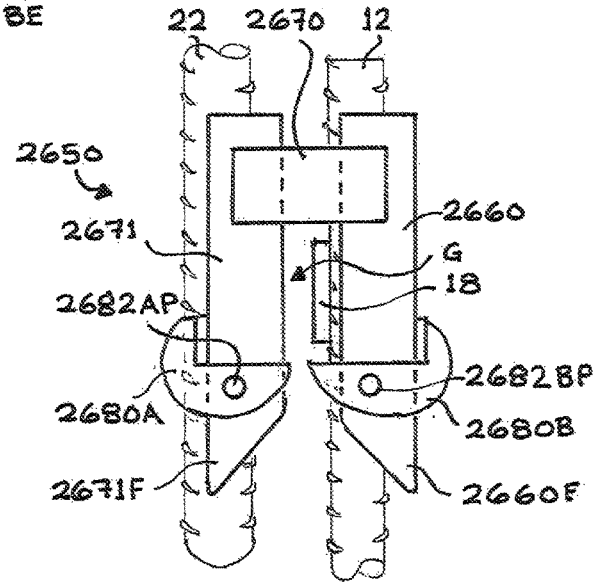

Turning to FIG. 25(*a*), here there is shown another constructional form of pivotal gate means forming part of a splicing device 2550 according to yet another embodiment of the invention. Here the gate mechanism comprises a pair of contra-pivotable cam-like gate members 2580A, 2580B, each mounted on its own respective rotational pivoting bolt or pin mounting 2582AP, 2582BP at, respectively the lower foot portion of side bridging plate 2571 and the lower foot portion of the anchoring plate 2560 (which defines the suspension gap G). As shown here by way of example, each of the side bridging plate 2571 and anchoring plate 2560 is oriented side-on, the side bridging plate 2571 being welded to the cage bar 22 and the anchoring plate 2560 being welded to the side bridging plate 2571 via transversely oriented upper bridging plate 2570. To allow room for the two contra-pivotable gate members 2580A, 2580B to pivot, the foot portions of each of the side bridging plate 2571 and anchoring plate 2560 may be stepped (not shown), as well as to define respective limiting stop portions 2560S, 2571S for limiting the angle of pivoting travel of the respective gate members 2580A, 2580B. Each of the contra-pivotable gate members 2580A, 2580B has a lower side edge 2580AE, 2580BE which is arcuate in shape, in order to facilitate the upward free pivoting of the gate members 2580A, 2580B as the suspension band 18 pushes against them as it travel into the suspension gap G as the upper pile cage 20 is lowered onto the lower pile cage 10. Once the suspension band 18 has been received in the suspension gap G, the weight of the respective gate members 2580A, 2580B causes them to pivotally drop back down into their mutually closed positions, as shown in the Figure, in which condition the suspension band 18 is now trapped securely in the suspension gap G. The slight upwardly pointing of the main bodies of the respective cam-like gate members 2580A, 2580B assists in maintaining them in their mutually closed configuration, even when the suspension bears downwardly against them during the cage lifting operation.

FIG. 25(*b*) shows a modified version of the embodiment of FIG. 25(*a*). Here the passage of the suspension band 18 into the suspension gap G, during which motion it forces the respective contra-pivotable gate members 2680A, 2680B to open by pivoting upwardly into the suspension gap G and towards the upper bridging plate 2670, is facilitated by the provision on each respective foot portion of the side bridging plate 2671 and anchoring plate 2660 a respective mutually angled (e.g. at an angle of around 30 to 60°, such as around) 45° beveled or flared terminal edge. This feature therefore helps to guide the suspension band 18 into the optimum radial location for entering the gate means as the two cages are brought together.

Figure 26:
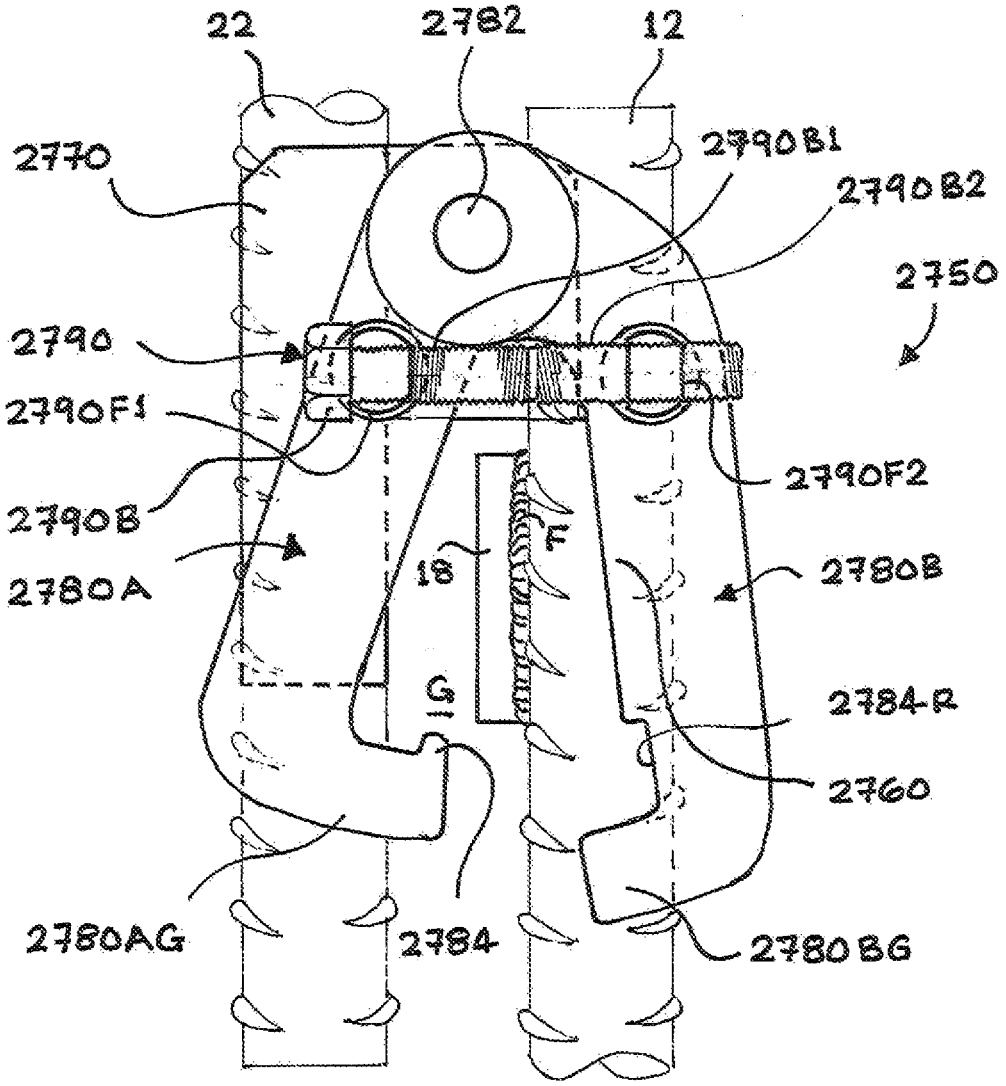
FIG. 26 is a side view of another splicing device according to another embodiment of the invention, shown in position splicing together the pile cages, but here showing the use of a different form of gate arrangement based on a pair of mutually closeable/openable jaws to selectively close or open the suspension gap into which can be trapped the suspension band.

FIG. 26 shows yet another embodiment of the invention, again based on the employment of dual mutually contra-pivotable latch members 2780A, 2780B. Here the two contra-pivotable latch members 2780A, 2780B are mounted on upper bridging plate 2770 (which is welded onto cage bar 22) via a common rotational pivot bolt or pin mounting 2782. Each latch member 2780A, 2780B comprises a respective central section at the lower end of which is formed the respective main generally radially-pointing gate portion 2780AG, 2780BG. However, in this embodiment the central section of the radially inner (i.e. right-hand) latch member 2780B constitutes the anchoring portion of the device 2750 which defines the suspension gap G for receiving therein the suspension band 18 on the lower pile cage 10 as the latch members are pivoted into their respective mutually closed configuration. Thus, the manner in which the suspension gap G is defined during the actual pivoting of the unitary latch member 2780B follows the same principle as the definition and formation of the suspension gap in the embodiments of FIGS. 2 and 4 to 8.

In this embodiment of FIG. 26, to effect the pivoting motion of the respective latch members 2780A, 2780B in mutually opposite radial directions, i.e. to either open or close the suspension gap G, in a similar manner to the locking bolt arrangements 590, 690 in the embodiments of FIGS. 6 and 7, there is provided a locking bolt arrangement 2790. Here, however, the locking bolt 2790B comprises a shaft split into two shaft portions 2790B1, 2790B2 each with a screw-thread which turns in an opposite direction from that of the other. Each oppositely threaded shaft portion 2790B1, 2790B2 is mounted in its own respective internally threaded apertured locking flange 2790F1, 2790F2, each of which is mounted on the respective face of the respective latch member 2780A, 2780B. Thus, as the locking bolt 2790B is rotated, again conveniently and safely from radially outside the cages, either manually or by use of a tool, e.g. an allen key, screwdriver etc, the latch members 2790B1, 2790B2 are caused to pivot in mutually opposite directions, enabling them to be controllably pivoted to selectively open or close the suspension gap G.

To assist the mutual cooperation and seating together of the terminal end portions of the respective gate portions 2780AG, 2780BG as they are brought into their mutually closed configuration, at least one of those terminal end portions may be provided with a protruding nose or lip 2784 for retaining therebehind the suspension band 18 as it bears against the upper edge of that gate portion during the cage lifting operation. Also, to assist the closing together of the two terminal end portions of the respective gate portions 2480AG, 2780BG, one thereof may be provided with a radial recess 2784R therein, into which fits the other of those terminal end portions.

Figure 27:
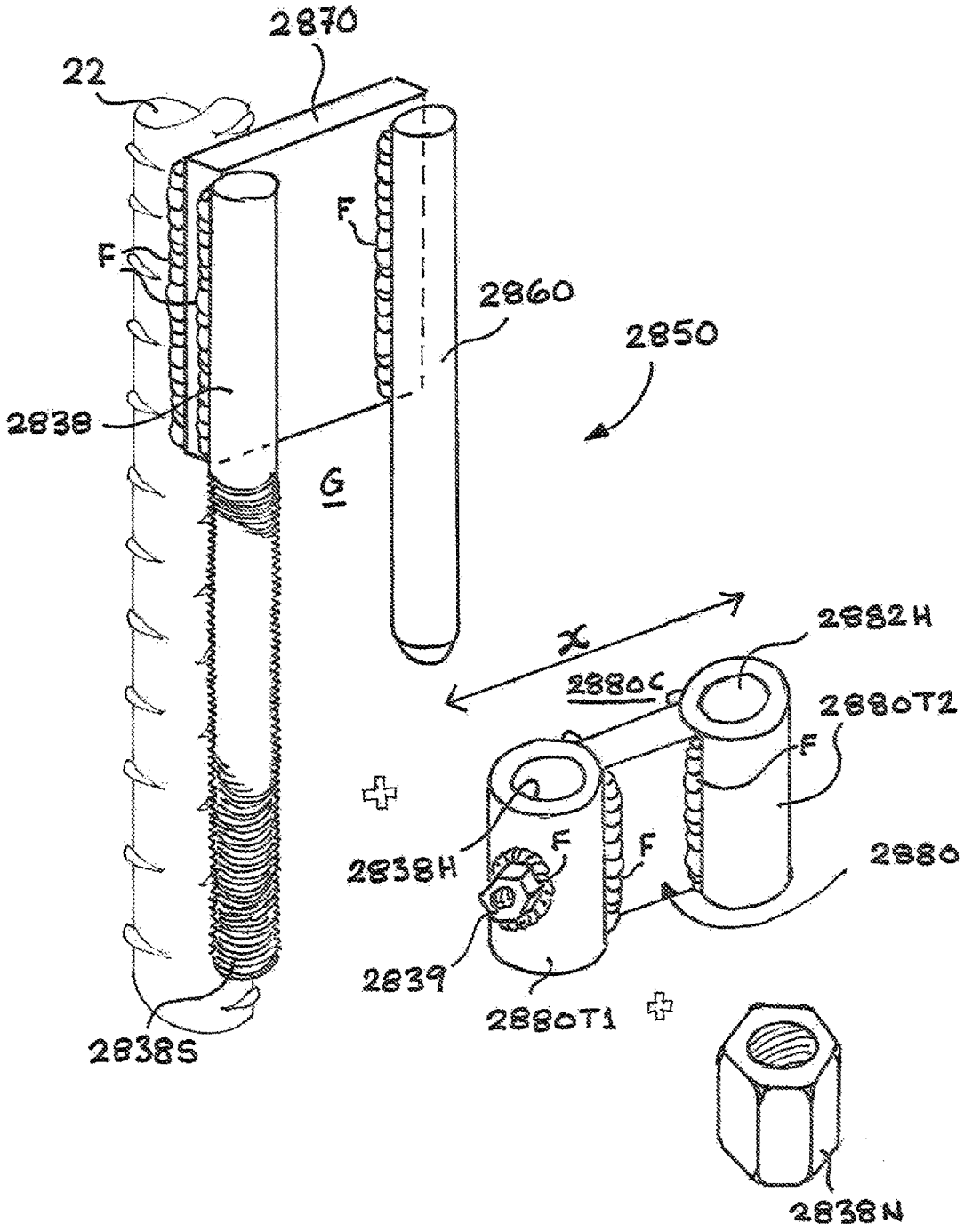
FIG. 27 is an exploded perspective view of another splicing device according to another embodiment of the invention, shown in position splicing together the pile cages, and showing the use of another form of latching gate arrangement in which the latch member is pivotable between its closed and open configurations about a vertical, as opposed to a horizontal, axis.

Turning to FIG. 27, here there is shown another embodiment of splicing device 2850 according to the invention, but here the device is based on a gate arrangement in which the pivoting movement of the relevant part(s) of the gate means occurs about a vertical axis, i.e. an axis substantially parallel to the longitudinal axis of the upper pile cage 20 carrying the device (which of course may be substantially coincident with the longitudinal axis of the lower pile cage 10, especially when the two cages are in their spliced together relationship), instead of a generally horizontal axis (i.e. an axis generally transverse or circumferential or chordal or tangential to that longitudinal axis of the cage(s)) as in the preceding embodiments of the other Figures.

As shown in FIG. 27, in the splicing device 2850 the anchoring portion which defines the suspension gap G now takes the form of an anchoring cylindrical pivot rod 2860 rigidly welded via upper bridging plate 2870 to the cage bar 22 of the upper pile cage 20. To the other lateral side of the bridging plate 2870 is welded a generally cylindrical locking rod 2838, which has a lower section which is externally screw-threaded and which forms part of the means by which a latch plate 2880 is lockable in its pivotally closed configuration occluding the suspension gap G (defined between the anchoring pivot rod 2860 and the cage bar 22) once the pile cages have been brought together and the suspension band (not shown) received in the suspension gap G.

The latch plate 2880 itself comprises a central main body plate portion 2880C, oriented with its general plane generally parallel to the axial direction of the cage bars 22 of the upper cage, and which carries (e.g. welded thereto) at its respective ends each respective one of a pair of cylindrical locking tubes 2880T1, 2880T2, each having smooth internal walls. The radially inner locking tube 2880T2 thus presents a cylindrical pivot hole 2882H to the anchoring pivot rod 2860, whilst the radially outer locking tube 2880T1 presents a cylindrical pivot hole 2838H to the locking rod 2838. The overall length "x" of the latch plate 2880 is such as to match the radial spacing of the locking rod 2838 and anchoring rod 2860. The anchoring pivot rod 2860 has a longitudinal length which is shorter than that of the threaded length of the locking rod 2838 by a distance which is at least equal to, preferably slightly more than, the height of the latch plate central section 2880C (and thus also the height of the locking tubes 2880T1, 2880T2).

In the device's normal configuration as pre-assembled onto the upper pile cage ready for being presented to the lower pile cage as the two cages are brought together, the latch plate 2880 is attached to the locking rod 2838 by means of the threaded section of the locking rod 2838 being inserted into and through the radially outer locking tube 2880T1 and a locking nut 2838N screwed short distance onto the free end of the threaded locking rod 2838. This step may for example be facilitated by use of a tool, e.g. engageable in a carrier nut 2839 attached (e.g. welded) to the radially outer end of the outer locking tube 2880T1. In this manner the latch plate is thus anchored on the lower portion of the locking rod but is still free to pivot rotationally thereabout, so it can be configured e.g. circumferentially of the cage bars 22 of the upper pile cage, i.e. out of the way of the anchoring pivot rod 2860 and thus leaving the suspension gap G open and free for receiving therein the suspension band (not shown) as the two pile cages are brought together.

When it is required to close the suspension gap G, i.e. once the suspension band has been received therein, the latch plate 2880 may be reconfigured simply and efficiently into its closed configuration by pivoting about the locking rod 2838. To this end, the latch plate 2880 is pivoted thereabout until its radially inner locking tube 2880T2 comes into register with the anchoring rod 2860, and whilst maintained in that position the locking nut 2838N is then screwed up and onto the main threaded section of the locking rod 2838 (again conveniently and safely from radially outside the cages), and in so doing the latch plate is translated upwards and the anchoring rod 2860 inserted down into the radially inner locking tube 2880T2. If desired a power tool may be used to power-turn the nut 2838N, given the relatively large axial distance it often will need to be screwed onto the threaded locking rod 2838 to fully insert the anchoring rod 2860 into the radially inner locking tube 2880T2.

For proper operation of this constructional embodiment, it may be preferred that the overall length of the latch plate "x" is no greater than the circumferential spacing of adjacent cage bars 22 of the upper pile cage 20, so that the latch plate can be pivotally swung completely out of the way of the suspension gap G so as to lie e.g. in-line circumferentially with those cage bars 22, whilst still being able to be pivotally swung back inside the upper cage to align with and be anchored to the anchoring rod 2860.

Figure 28A:
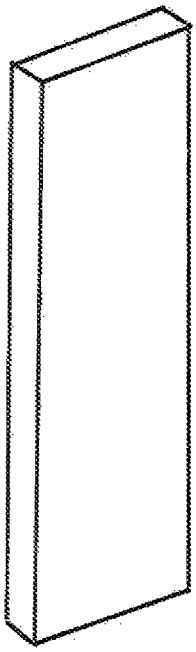
FIGS. 28(*a*), 28(*b*) and 28(*c*) are schematic perspective views of some alternative cross-sectional shapes of diaphragm wall cages which may be spliced together by use of various embodiments of splicing device according to the invention in the formation of correspondingly alternatively-shaped diaphragm walls or other concrete structures.
Figure 28B:
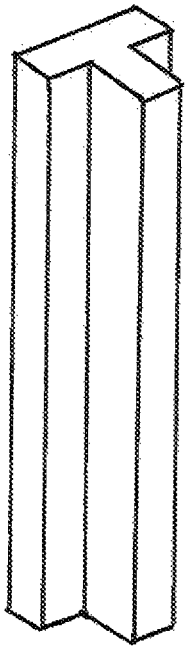
Figure 28C:
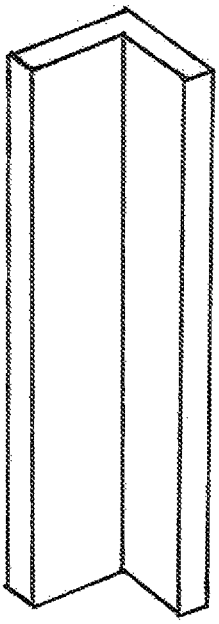

As already mentioned hereinabove, it is possible within the scope of this invention for reinforcement cages to be employed which are non-circular in cross-section, for use in forming correspondingly non-circular shaped piles, diaphragm walls or other concrete structures. FIGS. 28(*a*), 28(*b*) and 28(*c*) show schematically some examples of such alternative cross-sectional peripheral outer shapes of reinforcement cages which may be spliced by use of any of the embodiments of the invention disclosed herein. For example, FIG. 28(*a*) shows a reinforcement cage having a generally rectangular cross-section (i.e. is generally "mattress"-shaped), FIG. 28(*b*) shows a T-sectioned reinforcement cage, and FIG. 28(*c*) shows an L-shaped or "corner" reinforcement cage.

The manner in which such alternatively shaped reinforcement cages may be spliced using devices in accordance with embodiments of the invention will be readily understood by persons skilled in the art from the foregoing descriptions taken in conjunction with the accompanying drawings showing the splicing of circular pile cages using various embodiment splicing devices within the scope of the invention.

Figure 29:
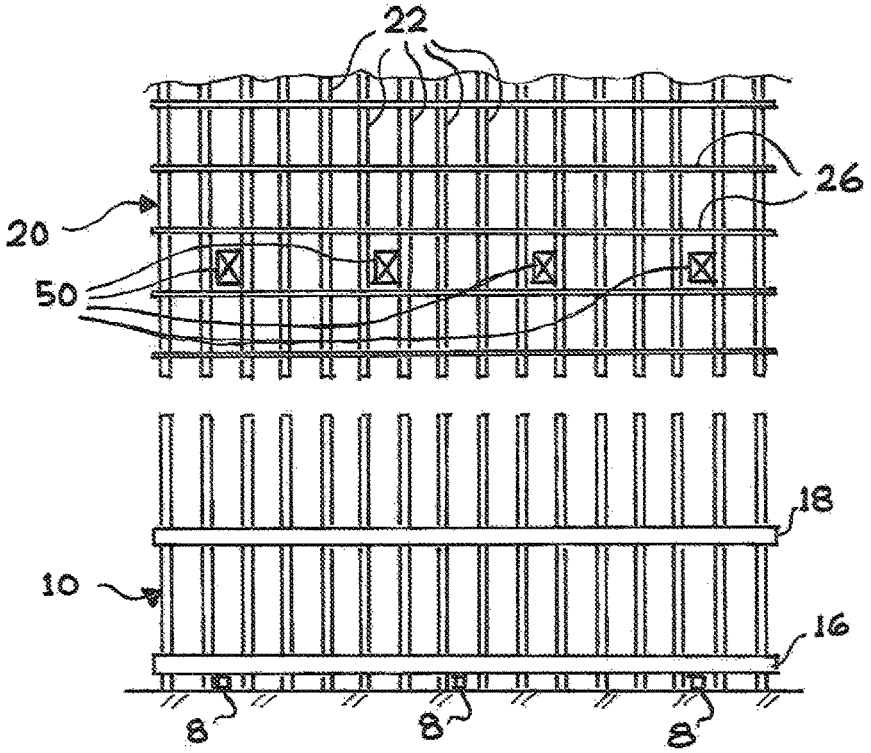
FIGS. 29(*a*) and 29(*b*) are, respectively, a side elevational view and a cross-sectional view through that of FIG. 29(*a*) of an example of the splicing together of a pair of mattress-shaped reinforcement cages, each of which corresponds to the alternative cross-sectional shape of cage shown in FIG. 28(*a*).
Figure 29:
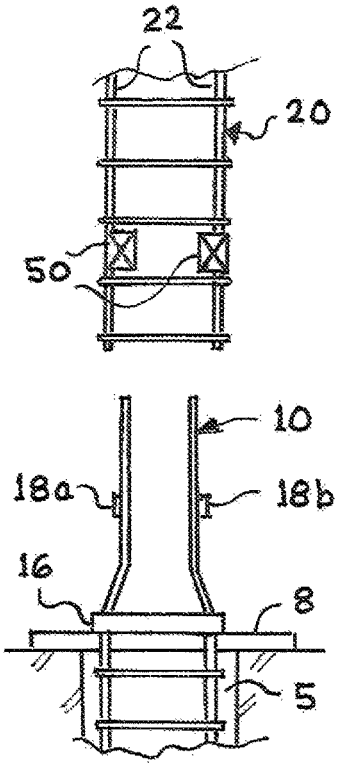

However, by way of an additional example, FIGS. 29(*a*) and 29(*b*) (the latter being a median sectional view through the former) show the splicing together of a pair of mattress-shaped reinforcement cages, e.g. each of the shape shown in FIG. 28(*a*). As shown in FIGS. 29(*a*) and (*b*), an upper reinforcement cage 20 is being spliced to a lower reinforcement cage 10 by use of a series of laterally equi-spaced like splicing devices 50, each device 50 being a device according to any foregoing embodiment of the invention, e.g. any of those described and illustrated with reference to any of FIGS. 2 to 27. Any suitable number and spacing of the splicing devices 50 may be used in this arrangement, e.g. depending on its overall dimensions and/or weight. To effect the splicing arrangement the lower reinforcement cage 10 comprises a pair of lateral linear suspension bands 18*a*, 18*b*, instead of the circular suspension band 18 of the arrangement shown in FIGS. 1(*a*) and 1(*b*), although the construction and operation of the respective splicing devices themselves may be substantially unaltered as compared with their application to such other embodiments of FIGS. 2 to 17.

It is to be understood that in the foregoing descriptions of various constructional arrangements and variations thereof of splicing devices according to embodiments of the invention that any and all individual features thereof may be taken independently or in any combination and applied in that manner to any and all embodiments, not only to those in the context of which such feature(s) have been specifically introduced, described or illustrated. In other words, any feature(s) described with reference to one embodiment is/are applicable to any and all embodiments, unless expressly stated otherwise or such features are incompatible.

It is furthermore to be understood that the above description of embodiments of the invention in terms of their various features and aspects has been by way of non-limiting example(s) only, and various modifications may be made from what has been specifically described and illustrated whilst remaining within the scope of the invention as claimed.

The invention claimed is:

1. A device for splicing together a first reinforcement cage and a second reinforcement cage, each of the first and second reinforcement cages extending in a respective longitudinal axial direction between respective ends thereof, the first reinforcement cage comprising a suspension band adjacent one of its ends and the second reinforcement cage carrying the said device adjacent one of its ends, wherein the device is arranged in splicing relationship to the first and second reinforcement cages and comprises:

an anchoring portion carried on a portion of the second reinforcement cage adjacent its one end and configured or configurable such that at least a portion thereof is spaced from the second reinforcement cage in a radial or transverse direction relative to the longitudinal axial direction of at least the second reinforcement cage so as to define a radial suspension gap between the said portion and the second reinforcement cage, the suspension gap being configured for receiving therein the suspension band on the first reinforcement cage as the first and second reinforcement cages are brought together into a splicing spatial relationship by relative movement thereof in said axial direction; and gate means constructed and arranged so as to be selectively configurable in either an open configuration, in which the suspension band on the first reinforcement cage can be inserted into or received in the suspension gap via the gate means during said axial relative movement of the first and second reinforcement cages, or a closed configuration in which the suspension band on the first reinforcement cage, once located in the suspension gap, is prevented from being removed therefrom via the gate means, wherein the gate means is moveable between its open and closed configurations by virtue of at least a portion thereof being moveable by pivoting.

2. The device of claim 1, wherein the gate means is constructed and arranged such that when it is configured into its pivotally closed configuration, the suspension band on the first reinforcement cage, once located in the suspension gap, is abuttingly engageable by or with a portion of the gate means, whereby the suspension band is prevented from being withdrawn therefrom via the gate means.

3. The device of claim 1, wherein the second reinforcement cage on which the device is carried is that reinforcement cage which is the uppermost one of the pair of reinforcement cages, the lowermost reinforcement cage of the pair being the first reinforcement cage and having the suspension band attached thereto.

4. The device of claim 1, wherein:

either (i) the anchoring portion is configured or configurable such that at least a portion of the anchoring portion is radially inwardly spaced from the second reinforcement cage, whereby the suspension gap is formed or defined radially inwardly of the main structure of the second reinforcement cage, and, when the first and second reinforcement cages are in their spliced together relationship an end portion of the first reinforcement cage is overlappingly spliced with an end portion of the second reinforcement cage with the former being located radially inwardly of the latter;

or (ii) the anchoring portion is oriented or orientable such that its general longitudinal dimension is generally substantially parallel to the axial direction of at least the second reinforcement cage, so that the anchoring portion is configured or configurable to bound the suspension band of the first reinforcement cage on a radial side of the suspension band opposite the radial side thereof facing the second reinforcement cage itself.

5. The device of claim 1, wherein the anchoring portion is carried directly on the portion of the second reinforcement cage, optionally via a mounting or attachment stub, boss, spigot, flange, bracket or other protruding member provided on the said portion of the second reinforcement cage;

and wherein one of the following (i) or (ii) is satisfied:

(i) the anchoring portion is fixedly mounted on the portion of the second reinforcement cage on which it is carried, and configured such as to define a said radial suspension gap which is of substantially fixed width, and the anchoring portion carries, at an end thereof distal from the portion of the second reinforcement cage on which it is mounted, at least a portion or component of the gate means; or (ii) wherein the anchoring portion is pivotally mounted on the portion of the second reinforcement cage on which it is carried, and thereby configurable relative to the second reinforcement cage such as to define a said radial suspension gap which is of variable width, optionally wherein a portion of the anchoring portion constitutes or provides the said portion of the gate means which is pivotable so as to enable the gate means to be variably configurable in either of its open or closed configurations, whereby the pivotal mounting of the anchoring portion itself constitutes or contributes to the variable configuration of the gate means which enables the gate means to be variably configurable in either of its open or closed configurations.

6. The device of claim 1, wherein the anchoring portion is carried indirectly on the portion of the second reinforcement cage via a bridging member, and wherein the bridging member is substantially fixedly mounted on the portion of the second reinforcement cage, and the anchoring portion carries, at an end thereof distal from the bridging member, at least a portion or component of the gate means, and optionally wherein the bridging member is constituted by an intermediate arm or leg section of a plural-sectioned yoke, of which one other arm or leg section thereof constitutes the said anchoring portion of the device.

7. The device of claim 6, wherein:

(i) the anchoring portion carries, at an end thereof distal from the bridging member, at least the said portion of the gate means which is itself pivotable so as to render the gate means configurable in either of its open or closed configurations; or (ii) the anchoring portion carries, at an end thereof distal from the bridging member, a portion or component of the gate means other than that portion thereof which is pivotable to render the gate means configurable in either of its open or closed configurations, and the said portion of the gate means which is so pivotable is constituted or provided by one or more other portions or components of the gate means; or (iii) the anchoring portion itself is pivotally mounted on the bridging member.

8. The device of claim 1, wherein the anchoring portion comprises at least one side or edge or corner portion which is chamfered, bevelled or convexly curved.

9. The device of claim 1, wherein:

(i) the anchoring portion is itself pivotable relative to the second reinforcement cage, or where such is provided to the bridging member via which the anchoring portion is carried on the second reinforcement cage, and the device further comprises locking means for locking the anchoring portion in at least one selected pivotal positon thereof; and (ii) wherein the said at least one selected pivotal position of the anchoring portion is a closed pivotal position which effects or contributes to the closed configuration of the gate means, whereby actuation of the locking means to lock the anchoring portion in said closed pivotal position, once it has been pivoted into that relative pivotal position, serves to lock the gate means into its closed configuration also;

optionally wherein the locking means is constructed and arranged for locking the anchoring portion in each of at least two selected pivotal positions thereof, one of which is the said closed pivotal position and the other of which is an open pivotal position which effects or contributes to the open configuration of the gate means, whereby actuation of the locking means to lock the anchoring portion in said open pivotal positon, once it has been pivoted into that relative pivotal position, serves to lock the gate means into its open configuration also.

10. The device of claim 9, wherein the locking means comprises one, or a combination of two or more, of any of the following:

(iii) a nut and bolt combination, one of the nut and bolt being provided on one of the pivotal anchoring portion and a fixed location on a portion of the second reinforcement cage and the other of the nut and bolt being provided for engagement with the first mentioned one of the nut and bolt, the said nut and bolt combination optionally including an apertured bracket, flange, lug or plate at or on at least one of said pivotal anchoring portion and fixed location and through which the said bolt may be passed before engagement with said nut; or (iv) a rotatable screw, bolt or pin provided on one of the pivotal anchoring portion and a fixed location on a portion of the second reinforcement cage, and an engagement hole or aperture, optionally screw-threaded, in the other of the said pivotal anchoring portion and fixed location and into which the screw, bolt or pin can be inserted, optionally by screwing; or (v) one or more detents or interengageable elements; or (vi) a cam member, or a weighted nose provided on the anchoring portion and abuttingly engageable with a portion of the second reinforcement cage, wherein the weight of the enlarged or protruding part of the cam member or nose, optionally under the additional force of the suspension band on the first reinforcement cage bearing thereagainst when the cages are in their spliced relationship and being lifted, urges the locking cam or nose into its closed position.

11. The device of claim 1, wherein the anchoring portion is pivotable about a mounting thereof, and the device additionally comprises one or more resilient members arranged to urge or bias the anchoring portion into or towards either, or each of one or more respective ones of, its respective limiting pivotal positions.

12. The device of claim 1, wherein:

(a) the said pivotal portion of the gate means is constituted by a discrete pivotal portion or component or group of components of the gate means itself; or (b) the said pivotal portion of the gate means is constituted by a portion or component of the anchoring portion of the device and optionally wherein:

(c) the gate means comprises at least one portion which is independent of the anchoring portion and is itself moveable by pivoting, and the said at least one portion of the gate means comprises at least one pivotable latch member, the latch member being pivotable between the said open and closed configurations to respectively permit insertion of or to trap, as the case may be, the suspension band in the formed suspension gap, optionally wherein one of the following (i) or (ii) is satisfied:

(i) the latch member is rotationally pivotable and the axis of rotational pivoting thereof is oriented generally substantially circumferentially or tangentially or chordally or transversely relative to the general longitudinal axial arrangement of the reinforcement cages; or (ii) the latch member is rotationally pivotable and the axis of rotational pivoting thereof is oriented generally substantially axially or longitudinally relative to the general longitudinal axial arrangement of, or parallel to the longitudinal axis of, the reinforcement cages.

13. The device of claim 12 wherein (c) is satisfied, and wherein:

(d) the anchoring portion is carried indirectly on the portion of the second reinforcement cage via a bridging member, and wherein the at least one pivotable latch member is pivotally moveable at least in a direction further into or within the said suspension gap as it pivots into its open position; and (e) the said at least one pivotable latch member is pivotable such as to be pivotally moveable at least in a direction towards the said bridging member as it pivots into its open position, optionally wherein the at least one pivotable latch member is pivotable such that when it assumes the gate means' open configuration it lies within the suspension gap towards or adjacent a or a respective radial side thereof, whereby when in this open configuration:

(ei) the at least one latch member allows the suspension band on the first reinforcement cage to pass substantially freely by it as the suspension band is inserted or received into the suspension gap as the two reinforcement cages are brought together into their splicing relationship; or (eii) as the suspension band is inserted or received into the suspension gap it engages or abuts a side or edge of the at least one latch member to cause it to pivot out of the way towards the or the respective said radial side of the suspension gap;

wherein in either case (ei) or (eii) once the suspension band has been inserted or received in the suspension gap to assume its trapped position therein, the at least one latch member is pivotable back in the opposite direction to assume the gate means' closed configuration, in which the suspension band is trapped within the suspension gap such as to be unable to be withdrawn therefrom via the gate means.

14. The device of claim 12, wherein (c) is satisfied, and wherein the anchoring portion is carried indirectly on the portion of the second reinforcement cage via a bridging member, and wherein the at least one pivotable latch member is pivotally moveable at least in a direction out of the said suspension gap as it pivots into its open position, and the said at least one pivotable latch member is pivotable such as to be moveable at least in a direction away from the said bridging member as it pivots into its open position.

15. The device of claim 12, wherein (c) is satisfied, and wherein:

either (d) the pivoting of the at least one latch member is assisted or forced in one direction only, optionally that in which the at least one latch member assumes the gate means' closed configuration, by means of at least one resilient member provided in or on the device;

or (e) the pivoting of the at least one latch member is effected or assisted by use of a tool manually manipulatable by an operator from radially outside the cages during the splicing operation;

and optionally wherein one of the following (f)(i) or (f)(ii) is satisfied:

(f)(i) the gate means comprises a single pivotable latch member, which single latch member is shaped and/or configured and/or positionable, optionally in combination or interaction with a portion of the second reinforcement cage or other portion of the device, to respectively open or close the said suspension gap; or (f)(ii) the gate means comprises a pair of pivotable latch members, which are each or mutually shaped and/or configured and/or mutually positionable, optionally in combination or interaction with a portion of the second reinforcement cage or other portion of the device, to respectively open or close the said suspension gap, optionally wherein the gate means comprises a pair of symmetrically arranged and symmetrically pivotable latch members, pivotable in mutually opposite rotational pivoting directions, and each being mounted on its own respective rotational pivot mounting.

16. The device of claim 12, wherein (c) is satisfied and wherein:

the gate means comprises the said at least one pivotable latch member which is pivotable between the said open and closed configurations to respectively permit insertion of or to trap, as the case may be, the suspension band in the formed suspension gap, and a or a respective locking member, optionally a or a respective locking escutcheon, which is constructed and arranged for engaging and thereby locking or securing the or the respective latch member in its closed configuration, or alternatively in its open configuration; and the or the respective locking member is constructed and arranged for engaging and thereby locking or securing the or the respective latch member selectively in either one of, or each of both of, its closed and/or open configurations;

and optionally wherein the or the respective locking member is constructed and arranged to permit the or the respective latch member to be pivoted into its open configuration without hindrance from the or the respective locking member, whereby the locking member acts as a catch or detent to engage and thereby maintain the or the respective latch member at least in its closed configuration only once the latch member has been configured therein.

17. The device of claim 16 wherein the locking member is pivotally mounted on or in the device, and optionally wherein the pivot mounting of the or the respective locking member is provided with a resilient urging member arranged to bias the or the respective locking member in or towards its locking pivotal position in which it can engage the or the respective latch member to lock it in its closed configuration.

18. The device of claim 1, wherein:

either (i) the device is constructed and arranged such that the gate means is actuatable to assume its open and/or its closed configuration(s) substantially automatically by the action of bringing the first and second reinforcement cages together into their splicing relationship and the suspension band on the first reinforcement cage being inserted through and/or past the gate means into the suspension gap defined by the splicing device on the second reinforcement cage;

or (ii) the device is constructed and arranged such that the gate means is actuatable to assume its open and/or its closed configurations at least in part by manual intervention or manipulation of one or more moveable component parts of the device by an operator from radially externally of both reinforcement cages.

19. The device of claim 1, wherein the splicing device is attached to the second reinforcement cage via at least one attachment band, the attachment band being attached to one or more of the cage bars of the second reinforcement cage and the splicing device being attached to the attachment band;

and optionally wherein the attachment band is a modular attachment band, the modular attachment band comprising a plurality of segments or sections, one of which carries the said splicing device.

20. The device of claim 1, wherein the suspension band comprises any one of the following:

(i) a continuous suspension band whose length extends over substantially the whole circumferential (in the case of a cylindrical first reinforcement cage) or lateral (in the case of a first reinforcement cage of a rectangular or other cross-sectional shape) length of the first reinforcement cage;

(ii) a part-continuous suspension band whose length is sufficient to extend over and across only some of the individual cage bars of the first reinforcement cage; or (iii) a modular or segmented suspension band which comprises a plurality of discrete modular suspension band segments, each respective segment having a circumferential (in the case of a cylindrical first reinforcement cage) or lateral (in the case of a first reinforcement cage of a rectangular or other cross-sectional shape) length sufficient to span a circumferential or lateral (as the case may be) distance which is at least that distance between the centres of two adjacent cage bars of the first reinforcement cage to which the respective segment is attached.

21. In combination, a second reinforcement cage and a splicing device carried thereon adjacent one of the ends thereof, the second reinforcement cage being for splicing, by means of the device, to a first reinforcement cage comprising a suspension band adjacent one of its ends, each of the first and second reinforcement cages extending in a respective longitudinal axial direction between respective ends thereof, wherein the device comprises:

an anchoring portion carried on a portion of the second reinforcement cage adjacent its one end and configured or configurable such that at least a portion thereof is radially spaced from the second reinforcement cage in a radial or transverse direction relative to the longitudinal axial direction of at least the second reinforcement cage so as to define a radial suspension gap between the said portion and the second reinforcement cage, the suspension gap being definable or configurable such as to be able to receive therein the suspension band on the first reinforcement cage as the first and second reinforcement cages are brought together into a splicing spatial relationship by relative movement thereof in said axial direction; and gate means constructed and arranged so as to be selectively configurable in either an open configuration, in which the suspension band on the first reinforcement cage is insertable into or receivable in the suspension gap via the gate means during said axial relative movement of the first and second reinforcement cages, or a closed configuration in which the suspension band on the first reinforcement cage, once located in the suspension gap, is preventable from being removed therefrom via the gate means, wherein the gate means is moveable between its open and closed configurations by virtue of at least a portion thereof being moveable by pivoting.

22. A method of splicing together a first reinforcement cage and a second reinforcement cage, each of the first and second reinforcement cages extending in a respective longitudinal axial direction between respective ends thereof, the first reinforcement cage comprising a suspension band adjacent one of its ends and the second reinforcement cage carrying adjacent one of its ends a splicing device according to claim 1, wherein the method comprises:

(i) with the gate means of the device configured in its open configuration, bringing together the first and second reinforcement cages into a splicing spatial relationship by relative movement of the first and second reinforcement cages in said axial direction such that the suspension band of the first reinforcement cage is inserted into or received in the suspension gap defined between the anchoring portion of the device and the portion of the second reinforcement cage on which the device is carried; and (ii) configuring the gate means, by pivotal movement of its said at least one pivotable portion, into its closed configuration in which the suspension band is prevented from being removed from the suspension gap via the gate means;

and optionally wherein upon completion of step (ii) at least a portion of the gate means and the suspension band are abuttingly engageable, so that as the upper one of the first and second reinforcement cages is lifted so the other one of the first and second reinforcement cages spliced thereto is lifted with it.

* * * * *